US011559469B2

(12) United States Patent
Raines et al.

(10) Patent No.: US 11,559,469 B2
(45) Date of Patent: Jan. 24, 2023

(54) SYSTEMS AND METHODS FOR CONTROLLING THE PROCESS OF COMPOUNDING ADMIXTURES

(71) Applicants: Derek Raines, Easton, PA (US); Drew Dolan, Northampton, PA (US); Robert Cutler, Allentown, PA (US); Evan Bruck, Coopersburg, PA (US); Mary Jansen, Byers, CO (US); Nicholas Heshelman, Bethlehem, PA (US); Mark Steenbarger, Indianapolis, IN (US)

(72) Inventors: Derek Raines, Easton, PA (US); Drew Dolan, Northampton, PA (US); Robert Cutler, Allentown, PA (US); Evan Bruck, Coopersburg, PA (US); Mary Jansen, Byers, CO (US); Nicholas Heshelman, Bethlehem, PA (US); Mark Steenbarger, Indianapolis, IN (US)

(73) Assignee: BBraun Medical Inc., Bethlehem, PA (US)

( * ) Notice: Subject to any disclaimer, the term of this patent is extended or adjusted under 35 U.S.C. 154(b) by 349 days.

(21) Appl. No.: 16/751,348

(22) Filed: Jan. 24, 2020

(65) Prior Publication Data

US 2021/0228447 A1 Jul. 29, 2021

(51) Int. Cl.

| | |
|---|---|
| ***A61J 3/00*** | (2006.01) |
| ***B01F 33/84*** | (2022.01) |
| ***B01F 35/83*** | (2022.01) |
| *B01F 101/00* | (2022.01) |

(52) U.S. Cl.

CPC ..... *A61J 3/002* (2013.01); *B01F 33/846* (2022.01); *B01F 33/8442* (2022.01); *B01F 35/83* (2022.01); *B01F 2101/2202* (2022.01)

(58) Field of Classification Search

CPC ..... A61J 3/002; B01F 2101/2202; B01F 33/8442; B01F 33/846; B01F 35/83; B01F 35/717611; B01F 35/831

See application file for complete search history.

(56) References Cited

U.S. PATENT DOCUMENTS 5,431,201 A * 7/1995 Torchia ..... B01F 31/23 901/6
5,609,572 A * 3/1997 Lang ..... A61M 5/14224 604/22
5,697,407 A * 12/1997 Lasonde ..... A61J 3/002 141/10

(Continued)

*Primary Examiner* — Anshu Bhatia

(57) ABSTRACT

A compounding apparatus for mixing at least two materials into an admixture can include a processor and software configured to select a non-universal ingredient for substitution as a temporary universal ingredient to be used as a buffer when an original universal ingredient buffer is not available. The processor and software can also include an auto adjust feature to correct for tube wear and other factors creating non-compliant final bag fills. The processor and software can also include a disable station designation feature that allows for disabling a problem station and diverting operation from the designated disabled station to a substitute station. Such operation can ensure continued production of the compounding apparatus.

26 Claims, 47 Drawing Sheets

(56) References Cited

U.S. PATENT DOCUMENTS

| | | | | |
|---|---|---|---|---|
| 5,927,349 | A * | 7/1999 | Martucci | G05D 11/131 73/61.61 |
| 9,475,019 | B2 | 10/2016 | Kaucky | |
| 9,668,940 | B2 | 6/2017 | Kaucky | |
| 2006/0259195 | A1* | 11/2006 | Eliuk | B01F 33/8442 700/245 |
| 2013/0322201 | A1* | 12/2013 | Hitchcock | A61J 3/002 366/182.2 |
| 2015/0021356 | A1* | 1/2015 | Witchell | B01F 33/848 222/23 |
| 2016/0310916 | A1* | 10/2016 | Janders | F16K 99/0042 |
| 2017/0354941 | A1* | 12/2017 | Brown | B01F 25/30 |

* cited by examiner

PRIOR ART

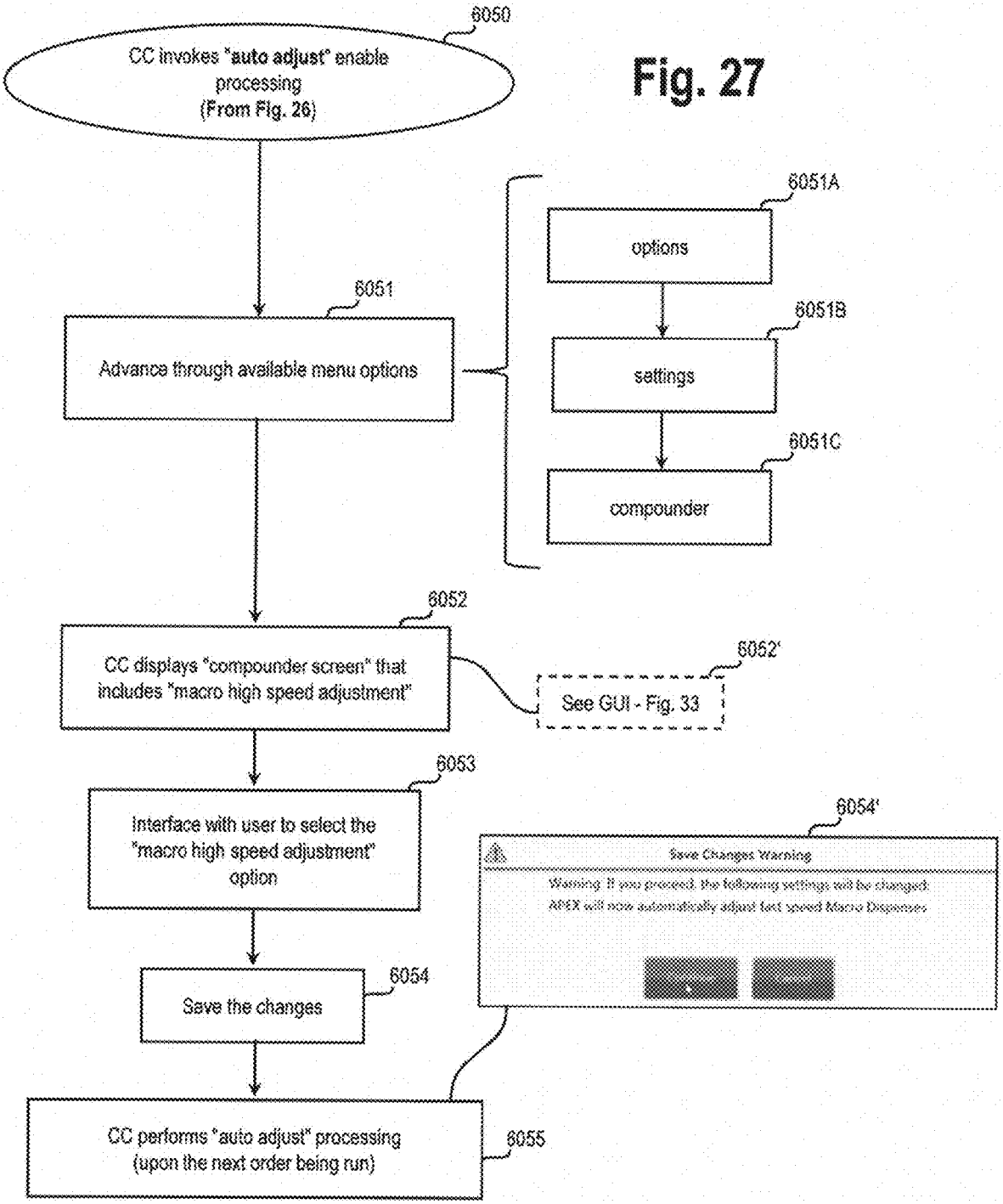
6050
CC invokes "auto adjust" enable processing (From Fig. 26)
Fig. 27
6051A
options
6051
Advance through available menu options
6051B
settings
6051C
compounder
6052
CC displays "compounder screen" that includes "macro high speed adjustment"
6052'
See GUI - Fig. 33
6053
Interface with user to select the "macro high speed adjustment" option
6054'
Save Changes Warning
Warning: If you proceed, the following settings will be changed:
APEX will now automatically adjust text speed Macro Dispenser
6054
Save the changes
CC performs "auto adjust" processing (upon the next order being run)
6055

SYSTEMS AND METHODS FOR CONTROLLING THE PROCESS OF COMPOUNDING ADMIXTURES

BACKGROUND

Field

The embodiments are directed to compounding device systems and methods for controlling the process of compounding admixtures. More specifically, the presently disclosed subject matter relates generally to devices, systems, software, processors, kits, and methods for controlling a process of compounding admixtures of various fluids, such as pharmaceuticals, assays, nutritional fluids, chemicals, and other fluids, for administration to human, animal, plant, mechanical/electrical/chemical/nuclear systems, or other users. In one exemplary embodiment, the disclosed subject matter can relate to devices, systems, software, processors, kits and methods in which a controller controls a process wherein a plurality of parenteral ingredients are mixed or compounded together for delivery to a patient or user via an infusion or intravenous bag (e.g., for intravenous, intra-arterial, subcutaneous, epidural, or other transmission).

Description of the Related Art

Compounding involves the preparation of customized fluid ingredients including medications, nutritional liquids, and/or pharmaceuticals, on a patient-by-patient basis. Compounded medications and solutions can be made on an as needed basis whereby individual components are mixed together to form a unique solution having the strength and dosage needed by the patient. This method allows the compounding pharmacist to work with the patient and/or the prescriber to customize a medication to meet the patient's specific needs. In some situations, compounding can involve the use of a compounding device to produce compounds in an anticipatory fashion, such as when a future or imminent demand for a particular combination of medicaments or pharmaceuticals or other compound components is known. However, in many situations, compounds are prepared per specific patient order. Compounding devices can be used to produce pooled bags, for example, that include certain fluids that are needed for either a number of patients or for the same patient for a number of days or a number of administrations. Thus, the pooled bag(s) can be used by including further specific compounding components, if any, either for a specific patient or for a specific timing for the same patient.

Compounding devices can use three types of measuring methods: gravimetric (e.g., additive gravimetric (weight final container) or subtractive gravimetric (weight the source containers as the pump delivers)), volumetric, or a combination of gravimetric and volumetric where each type can be used to check the other type. Compounders can be further broken down into three categories based on the minimum volumes they can deliver and the number of components they can accommodate: macro, micro, or macro/micro. Compounders typically have a stated minimum measurable volume and accuracy range. When compounding, higher volumes usually have larger absolute deviations, but lower percentage deviations. Operating software has been used to maximize the effectiveness and efficiency of compounding devices.

Gravimetric devices generally use a peristaltic pump mechanism combined with a weight scale or load cell to measure volume delivered. The volume delivered is calculated by dividing the weight delivered by the density of the ingredient. Gravimetric devices are not typically affected by running the source containers empty and delivering air into the final bag. These devices can be calibrated by using a reference weight for each ingredient. For example, the device's load cell can be calibrated using a reference mass on the load cell, and individual amounts of fluid dispensed measured by the load cell can be corrected based on the specific gravity of the fluid being dispensed.

Volumetric devices generally use both a peristaltic pump mechanism and a "stepper" motor to turn the pump mechanism in precisely measurable increments. The device calculates the volume delivered by the precision of the delivery mechanism, internal diameter of the pump tubing, viscosity of the solution, and the diameter and length of the distal and proximal tubing. Delivery from these devices can be affected by many factors including: variances in the pump tubing's material, length, elasticity, and diameter; temperature, which affects solution viscosity and tubing size; total volume pumped; ingredient head height; final bag height; position (e.g., initial and final positions) of the pump rollers relative to the pump platens; and empty source components. Thickness of the pump tubing can significantly affect delivery accuracy, and wear on the pumps over time can also cause diminishing accuracy.

Monitoring and replacing source containers before they are empty can prevent the volumetric devices from delivering air in lieu of the ingredient to the final container.

In some cases, due to injury, disease, or trauma, a patient may need to receive all or some of his or her nutritional requirements intravenously. In this situation, the patient will typically receive a basic solution containing a mixture of amino acids, dextrose, and fat emulsions, which can provide a major portion of the patient's nutritional needs. These mixtures are commonly referred to as parenteral mixtures ("PN"). Parenteral mixtures that do not include lipids are commonly referred to as total parenteral nutritional mixtures ("TPN"), while parenteral mixtures containing lipids are referred to as total nutritional admixtures ("TNA"). Often, to maintain a patient for an extended period of time on a PN, smaller volumes of additional additives, such as vitamins, minerals, electrolytes, etc., are also prescribed for inclusion in the mix.

Compounding devices facilitate the preparation of PN mixtures in accordance with the instructions provided by a medical professional, such as a doctor, nurse, pharmacist, veterinarian, nutritionist, engineer, or other. Compounding devices typically provide an interface that allows the medical professional to input, view, and verify the dosage and composition of the PN to be prepared and afterward confirm what had been compounded. The compounding device can be associated with source containers (i.e., bottles, bags, syringes, vials, etc.) that contain various solutions that can be part of the prescribed PN. The source containers can be hung from a framework that is part of the compounding device or can be mounted to a hood bar that is either part of or separate from the compounding device. A single pump or a plurality of pumps may be provided which, under the control of a controller, pump the selected solutions into a final container, for example, a receiving bag. The receiving bag is typically set on a load cell while being filled so that it can be weighed to ensure that the correct amount of solution is prepared. Once the bag has been filled, it can be released from the compounding device and, in this exemplary embodiment, can be used as a reservoir for intravenous infusion to a patient. Compounding devices are typically designed for operation in aseptic conditions when compounding pharmaceutical or neutraceutical ingredients.

When pharmaceuticals are used, a pharmacist can review instructions that are sent to the compounding device to ensure an improper mixture does not occur. The pharmacist can also ensure the specific sequencing of fluids/liquids is appropriate.

In the medical field, compounding devices can be used to compound fluids and/or drugs in support of chemotherapy, cardioplegia, therapies involving the administration of antibiotics and/or blood products therapies, and in biotechnology processing, including diagnostic solution preparation and solution preparation for cellular and molecular process development. Furthermore, compounding devices can be used to compound fluids outside the medical field.

Recently, there have been efforts to provide a compounding device that can operate more efficiently, with less downtime during source container replacement, and with increased usability features promoting more intuitive use of the system.

SUMMARY

Accordingly, it may be beneficial to provide a compounding device, system, method, processor, kit or software that operates more efficiently, improves set up time, and reduces downtime when an ingredient runs out and needs replacement, and which provides an aesthetically pleasing and intuitively operational structure, method of set up and use, and an associated usable, efficient and aesthetically pleasing computer interface.

The disclosed embodiments provide methods and apparatuses for controlling pumps, including control of the pump motors that are used to govern the starting, stopping and rates at which the pumps operate. The disclosed embodiments further provide methods and apparatuses that prevent incompatible ingredients from being combined under prescribed conditions. The disclosed embodiments further provide methods and apparatuses that provide additional capabilities and ease of use to keep incompatible ingredients from being combined under prescribed conditions. The disclosed embodiments further provide methods and apparatuses that provide additional capabilities to correct for inaccuracies in delivery of an ingredient in a system for compounding. The disclosed embodiments further provide methods and apparatuses that provide additional capabilities to address select stations that are operating poorly or malfunctioning in a system for compounding.

According to one aspect of the disclosure, a compounding apparatus is provided for controlling a compounding device to prepare an admixture from distinct material sources, the compounding apparatus including a delivery device that is configured to deliver the at least three selected materials from the material containers to the admixture container to facilitate formation of the admixture.

The compounding apparatus can be usable (a) with an admixture container that is configured to contain the admixture, and (b) with multiple material containers that are each configured to respectively contain one of the materials. The compounding apparatus can include a delivery device that is configured to deliver the at least two selected materials, including a first selected material and a second selected material, from the material containers to the admixture container to facilitate formation of the admixture. The delivery device can include first and second actuators, the first actuator being configured such that actuation thereof delivers the first selected material from a first associated material container to the admixture container, and the second actuator being configured such that actuation thereof delivers the second selected material from a second associated material container to the admixture container. A processor can include a memory that is configured to store admixture data representing amounts of the at least two selected materials required to form the admixture, and incompatibility data to identify one material as being incompatible with another material. The processor can be configured to selectively actuate the first and second actuators to supply the amounts of the at least two selected materials to the admixture container pursuant to the stored admixture data so as to facilitate formation of the admixture. The processor can be configured to perform processing including input of a first ingredient list, through interfacing with a user, that includes the at least two selected materials. The processing can also include identifying the first selected material as incompatible with the second selected material, such that (a) the first selected material constitutes the one material, and (b) the second selected material constitutes the another material. The processing can also include preventing un-buffered sequential delivery of the at least two selected materials, which are incompatible, including controlling the delivery device to deliver a third material, of the multiple distinct materials, to the admixture container, the third material to separate the two selected materials. The processing can also include identifying an incompatibility in the first input ingredient list based on an insufficiency in the third material acting as a buffer. The processing can also include providing a universal ingredient option in which the processor is configured to: interface with the user to select a universal ingredient (UI) as a substitute for the third material; substitute the UI for the third material in a further ingredient list; and assess compatibility of the further ingredient list; and provide a non-Universal Ingredient (non-UI) option in which the processor is configured to: interface with the user to select a non-UI as a substitute for the third material; substitute the non-UI for the third material in another ingredient list; and assess compatibility of the another ingredient list.

In accordance with another aspect of the disclosed subject matter, a compounding apparatus can be provided for facilitating formation of an admixture that involves mixing at least two materials selected among multiple distinct materials. The compounding apparatus can be usable (a) with an admixture container that is configured to contain the admixture, and (b) with multiple material containers that are each configured to respectively contain one of the materials. The compounding apparatus can include a delivery device that is configured to deliver the at least two selected materials, including a first selected material and a second selected material, from the material containers to the admixture container to facilitate formation of the admixture. The delivery device can include first and second actuators, the first actuator being configured such that actuation thereof delivers the first selected material from a first associated material container to the admixture container, and the second actuator being configured such that actuation thereof delivers the second selected material from a second associated material container to the admixture container. A processor can include a memory that is configured to store admixture data representing amounts of the at least two selected materials required to form the admixture. The processor can be configured to selectively actuate the first and second actuators to supply the amounts of the at least two selected materials to the admixture container pursuant to the stored admixture data so as to facilitate formation of the admixture. The processor can be configured to perform adjustment processing including: engaging with a user for the user to select an auto adjust feature; generating an adjustment ratio for adjusting delivery of the first selected material; and applying the adjustment ratio to the delivery of the first selected material.

In accordance with another aspect of the disclosed subject matter, a compounding apparatus can be provided for facilitating formation of an admixture that involves mixing at least two materials selected among multiple distinct materials. The compounding apparatus can be usable (a) with an admixture container that is configured to contain the admixture, and (b) with multiple material containers that are each configured to respectively contain one of the materials. The compounding apparatus can include a delivery device that is configured to deliver the at least two selected materials, including a first selected material and a second selected material, from the material containers to the admixture container to facilitate formation of the admixture. The delivery device can include first and second actuators, the first actuator, associated with a first station, being configured such that actuation thereof delivers the first selected material from a first associated material container to the admixture container, and the second actuator, associated with a second station, being configured such that actuation thereof delivers the second selected material from a second associated material container to the admixture container. A processor can include a memory that is configured to store admixture data representing amounts of the at least two selected materials required to form the admixture. The processor can be configured to selectively actuate the first and second actuators to supply the amounts of the at least two selected materials to the admixture container pursuant to the stored admixture data so as to facilitate formation of the admixture. The processor can be configured to perform disable station processing including: identifying that the first station is not operating properly so as to deliver the first selected material; engaging with a user for the user to select a disable station feature for disabling the first station; and based on the engaging with a user, disabling the first station.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which:

FIG. 27 is a flowchart showing details of the 37 controller invokes auto adjust enablement processing step 6050, as called upon in FIG. 26, in accordance with the principles of the disclosed subject matter.

DETAILED DESCRIPTION OF EXEMPLARY EMBODIMENTS

Methods and systems for admixture compounding are described. In the following description, for purposes of explanation, numerous specific details are set forth in order to provide a thorough understanding of example embodiments. It will be evident, however, to one of ordinary skill in the art that these embodiments may be practiced without these specific details.

The flow chart blocks in the figures and the description depict logical steps and/or reason code from a reason code module to operate a processor, computer system, controller, compounding system, etc. to perform logical operations and control hardware components and devices of the embodiments using any appropriate software or hardware programming language. In one embodiment, object code in a processor can generate reason codes during execution of the associated logical blocks or steps.

Figure 1:
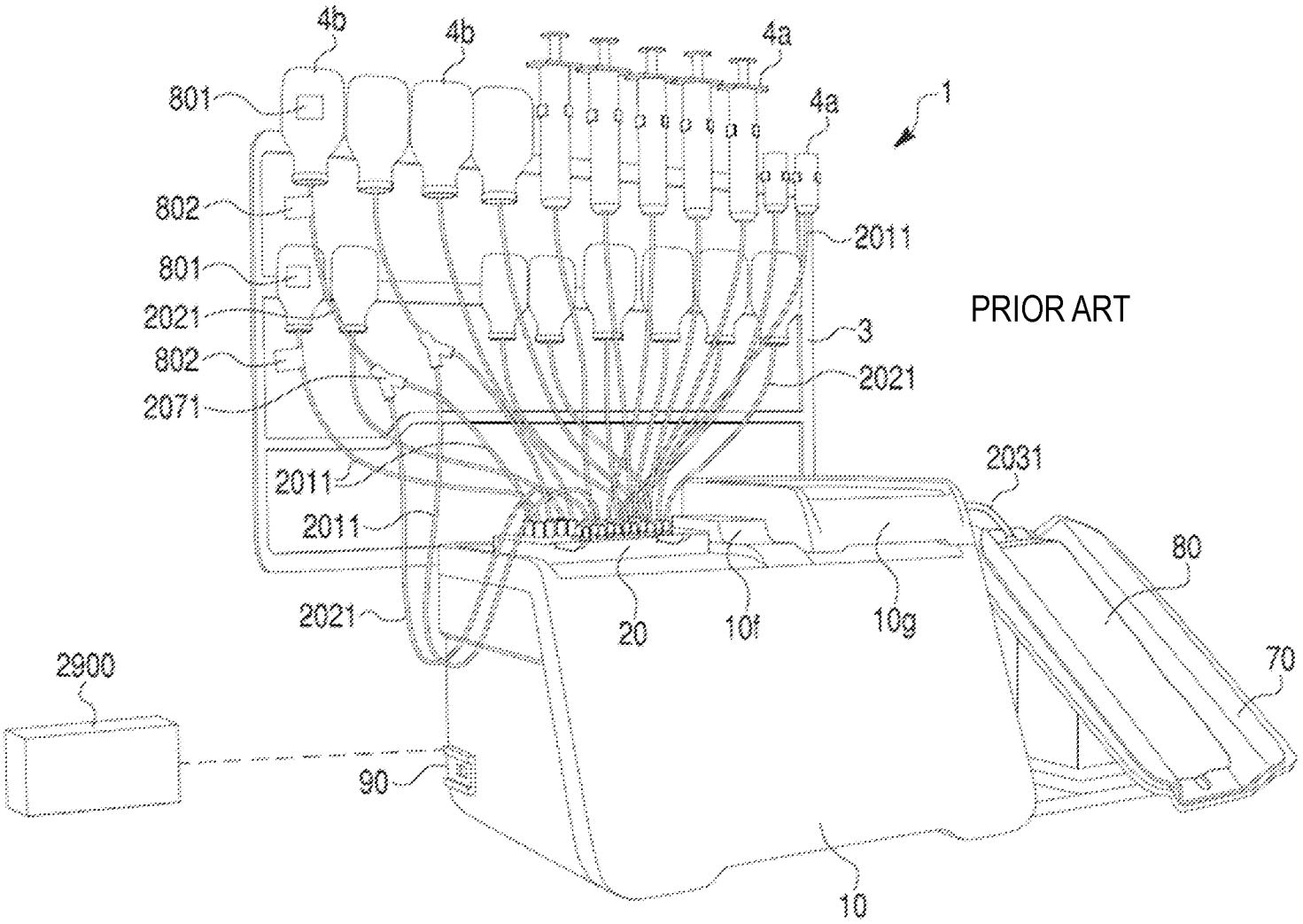
FIG. 1 is a perspective view of an exemplary embodiment of a compounding system made in accordance with principles of the disclosed subject matter.
Figure 2A:
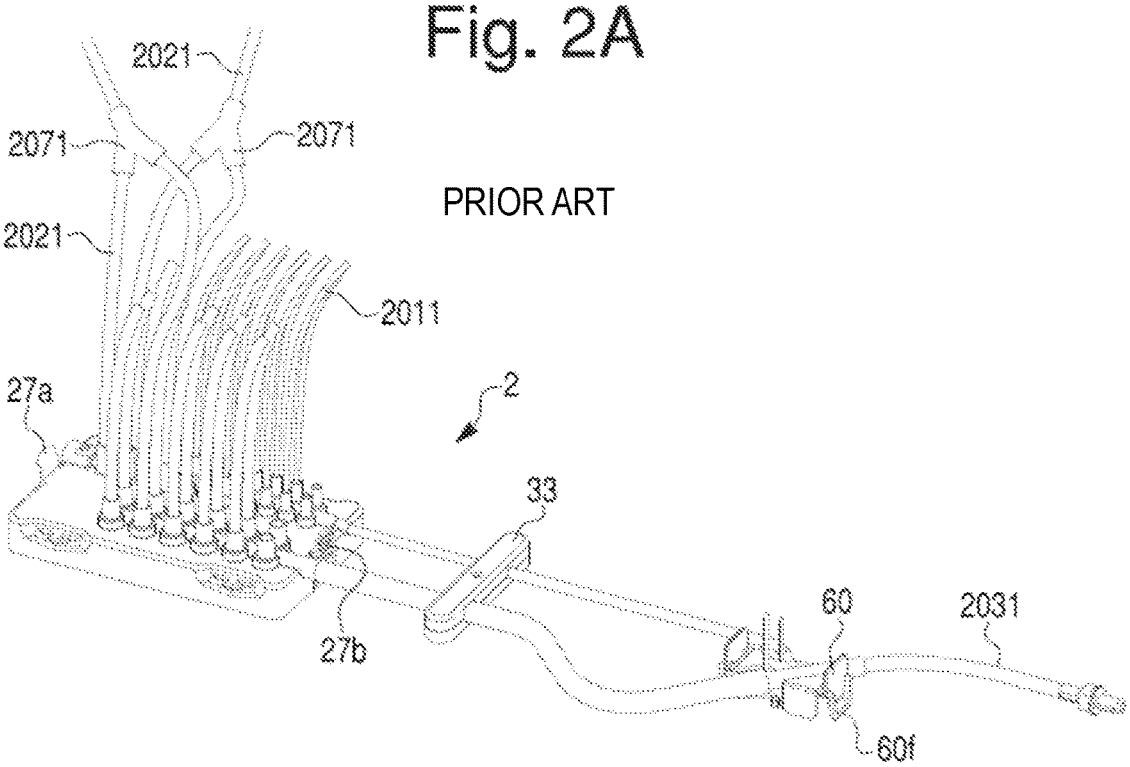
FIG. 2A is a perspective view of the exemplary transfer set of FIG. 1.
Figure 2B:
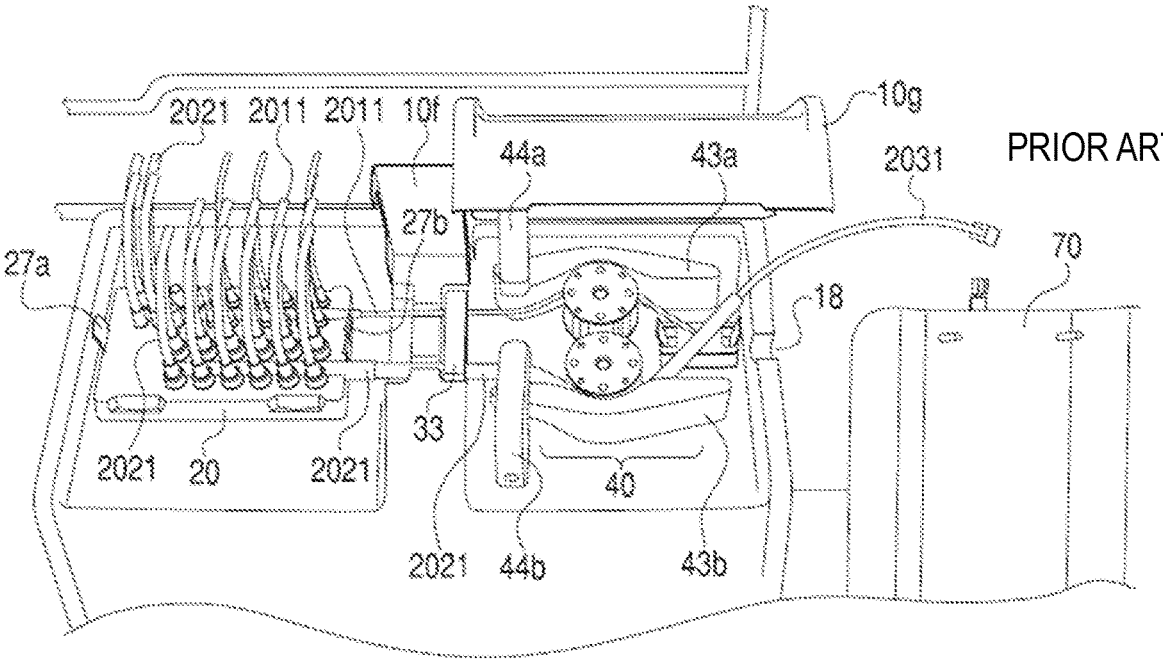
PRIOR ART Fig. 2B
FIG. 2B is a partial perspective view of the exemplary embodiment of FIG. 1.

FIGS. 1 and 2B are two different perspective views of an exemplary embodiment of a compounding system 1 made in accordance with principles of the disclosed subject matter. The compounding system 1 can include safety lids which are also hereinafter referred to as a sensor bridge cover 10*f* and a pump cover 10*g* in a closed position and opened position, respectively. The system 1 can be used to compound or combine various fluids from small or large containers 4*a*, 4*b* and consolidate the fluids into a single/final container, such as an intravenous fluid bag 80, for delivery to a human or animal patient, or to a lab for diagnostics, or to a storage facility for later sales or use. In one example, the system 1 can include a plurality of small supply containers 4*a* and large supply containers 4*b* each attached to an ingredient frame 3, a housing 10 having at least one pump (41, 42) (See FIG. 3A), a transfer set 2 (See FIG. 2A) that is selectively connectable to the housing 10 and that includes a manifold 20 attached to a plurality of micro input lines 2011, macro lines 2021, a controller connection 90, a controller 2900, and a discharge tray 70 in which a final container, such as IV fluid bag 80, can rest while connected to an output line(s) of the transfer set 2. In the embodiments, the pumps 41, 42 can include, but are not limited to peristaltic pumps, gear pumps, vacuum pumps, syringe pumps, reciprocating pumps, constant pressure pumps, or any other appropriate pump that can accomplish the functions of the system 1. The pumps in the current disclosure can be referred to individually as first pump 41 and second pump 42, and in some embodiments as a micro pump 41 and a macro pump 42 when the pumps are connected to the respective micro and macro flow paths in the system 1. In some embodiments, the first and second pumps 41, 42 are reciprocating pumps, and the rotors for the reciprocating pumps can be referred to herein as first, or micro, pump rotor 41 and second, or macro, pump rotor 42. The identification of the pumps 41, 42 are exemplary, and could be substituted for one another such that the macro pump is the first pump and the micro pump is the second pump, depending on the flow path to which each pump connects. Further, the embodiments intend to include, or otherwise cover, a multi-channel pump, where a first channel can function as the first pump 41 and a second channel can function as the second pump 42. The transfer set 2 is intended to be a sterile, disposable item. In particular, the transfer set 2 can be configured to create or compound many different mixtures or prescriptions into appropriate receiving bags 80 for a predetermined time or predetermined volume limit. Once the transfer set 2 reaches its predetermined time and/or volume limit, the set 2 can be disposed of and replaced by a new transfer set 2. In other words, the transfer set 2 is a pharmacy tool that is to be used for a full compounding campaign, for example, for a 24 hour compounding run in which prescriptions for multiple patients are filled during that time period. Before beginning a given compounding procedure, the operator loads the various components of the transfer set 2 to the housing 10 of the compounding system 1.

As shown in FIG. 1, the transfer set 2 (See FIG. 2A) can be connected (or connectable) between the at least one input container (such as micro container(s) 4*a* and/or macro container(s) 4*b*) and the output container (such as an IV fluid bag 80) via a plurality of lines (for example, micro input line(s) 2011 and/or macro line(s) 2021). The transfer set 2 can include a plurality of micro and macro lines 2011, 2021 extending therethrough, a manifold 20, a strain relief clip 33, a union junction 60 and an output line 2031. The micro and macro lines 2011, 2021 run through at least one manifold 20 such that fluids from each of the separate supply containers 4*a*, 4*b* can be at least partially mixed in the manifold 20 prior to further mixing at junction 60 located downstream of pump 40. The transfer set 2 is connectable to the main housing 10 of the system 1 and provides the connection between the input supply container(s) 4*a*, 4*b* and the output container. The housing 10 provides (among other features) pumping and control functionality to safely and efficiently select and deliver exact quantities of various fluids from containers 4*a*, 4*b* through the transfer set 2 to the output container. The manifold 20 can include two separate flow paths such that compounding can continue along a first flow path while the second flow path is interrupted.

The transfer set 2 macro lines 2021 and micro lines 2011 can all be attached to specific inlet tubing ports (i.e., 20*a* and 20*b*) of the manifold 20. The free or upstream ends of these lines are each uniquely marked with a permanent identification tag 802. In this exemplary embodiment, the identification tag 802 is a bar coded flag or sticker. The identification tag 802 provides one-to-one traceability and corresponds to a specific instance of the inlet tubing port (20*a* or 20*b*) to which it is attached. The source containers 4*a* and 4*b* possess unique data identifying the type and kind of fluids contained therein. This data can also be formatted in bar code format and placed on to tag 801. During use, the attached source containers (i.e., 4*a* and 4*b*) can be linked in the controlling software to the specific lines 2011 or 2021 by linking the source container data on the bar code format located on tag 801 to the bar code (or other identification information) located on the attached line identification tag 802. Once connected, correlated and linked in this way, when the compounding device requires the specific ingredient, the software links established above determine which valve actuator 102*a*' or 102*b*' must be turned in order to introduce the required or intended source fluid into the compounded receiving bag 80.

Connection of the transfer set 2 to the main housing 10 can be initiated by connecting the manifold 20 to the housing 10. The manifold 20 can include a plurality of ports, such as micro input line port(s) 20*a* and/or macro input line port(s) 20*b*. The lines of the transfer set 2 can include a plurality of lines, such as micro lines 2011 and/or macro lines 2021 and/or combination micro/macro line(s) referred to as flex line(s). The plurality of lines can correspondingly connect to the above-referenced micro container(s) 4*a* and/or macro container(s) 4*b* at an input end of respective micro and macro line(s) 2011, 2021. An output end of each of the micro and macro line(s) 2011, 2021 can be connected to the manifold 20. The manifold 20 can be selectively connected to the housing 10 such that at least one valve 21*a*, 21*b* located in the manifold 20 can be aligned with a valve actuator 102*a*' and 102*b*' that can be incorporated in a stepper motor 102*a*, 102*b* located in the housing 10 (which will be described in more detail below).

Figure 3A:
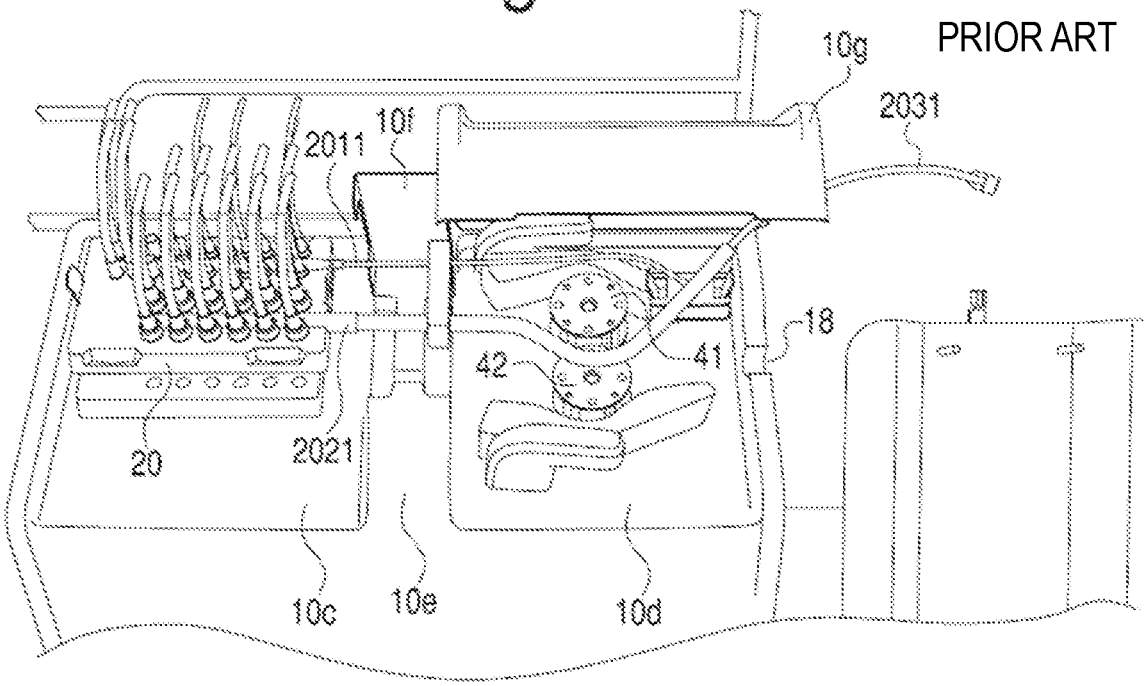
Fig. 3A PRIOR ART
FIGS. 3A-G are partial perspective views of the exemplary embodiment of FIG. 1 in sequential positions in which an exemplary transfer set including manifold and output lines are aligned and connected to exemplary valve actuators, sensor block and pumps.
Figure 3B:
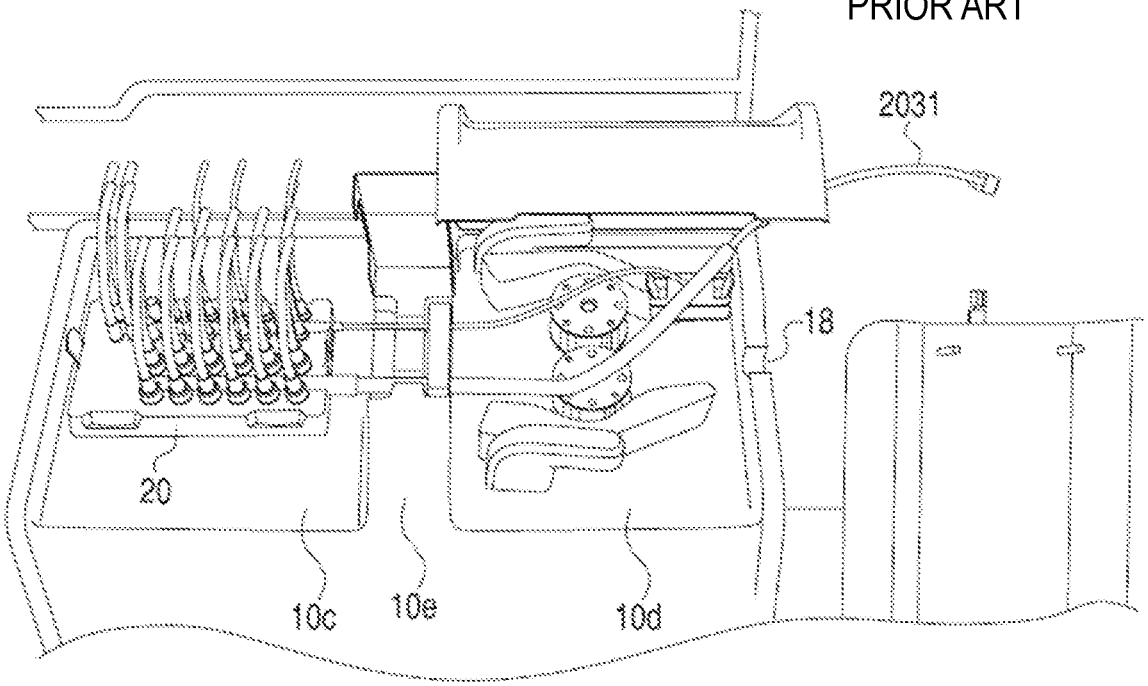
Fig. 3B PRIOR ART

In this exemplary embodiment, as shown in FIGS. 3A and 3B, when installing the transfer set 2 on to housing 10, the manifold 20 is connected to a top left side of housing 10 within a shallow tray indent 10*c* in the upper surface of the housing 10. The shallow tray 10*c* allows spilled fluids or leaks to run off the pump housing 10 in order to prevent ingress of the fluids to the internal electronics and mechanisms of the compounding system 1. In FIG. 3A, transfer set 2 and manifold 20 are not yet in position and are located above the housing 10 as if a user is starting the process of placing the transfer set 2 on to the housing 10 and preparing for use of the compounding system 1. The transfer set 2 includes a manifold 20 that has two distinct channels: a first channel 24*a* that connects to a plurality of micro lines 2011 and/or macro lines 2021, and a second channel 24*b* that connects to a plurality of macro lines 2021. Of course, in other embodiments the first and second channels could each be connected solely to micro, macro, flex, or other types of lines, respectively, or could be connected to combinations of micro, macro, or other types of lines. The first channel 24*a* and the second channel 24*b* are located in the manifold 20 and can be completely separate from each other (i.e., in fluid isolation from each other), such that no fluid from the first channel 24*a* mixes with fluid from the second channel 24*b*. The channel is considered that portion or area in the manifold through which fluid can flow. In this embodiment, a micro outlet 25*a* and a macro outlet 25*b* can be located on a downstream side of manifold 20 and connected to micro line 2011 and macro line 2021, respectively. It is noted that the lines downstream of the manifold (e.g., outlet lines, or micro line 2011 and macro line 2021) can incorporate different tubing as compared to the inlet lines 2011, 2021 that supply fluid to the manifold 20. For example, the inlet lines can include tubing made of more or less rigid material as compared to the outlet lines, and can also include tubing made with larger or smaller diameter openings, or made of larger or smaller side wall thicknesses. In addition, the color of the inlet lines can be different from the color of the outlet lines, and the lines can also have different surface textures either inside or outside of the tubing. For example, the texture on the inside could be configured to promote or prevent turbulence, depending on the application and location of the line.

A sensor structure 29 can be located in the manifold (See FIGS. 7A and 7B) and is configured to trip a sensor 2901 (See FIG. 15) located in the housing 10 that tells the system that the manifold 20 is in a correct/operational position. Alternatively, the sensor 2901 can be configured to confirm the presence and gross positional information for the manifold 20, but not necessarily configured to confirm that the position is fully operational. The sensor structure 29 can include a magnet 29*m* that goes into a housing 29*h* and provides a signal to (or actuates) the sensor 2901 in the housing 10 which indicates that manifold 20 and transfer set 2 are properly (i.e., securely) in place (See FIG. 7A). Software used with the system can be configured such that the compounder 1 will not operate/function when sensor 2901 does not sense or is not actuated by the magnet 29*m* (i.e., when the manifold 20 is not in proper position with respect to the housing 10). After the manifold 20 is secured to the housing by clips 27*a*, 27*b* located on opposing ends of the manifold 20 (See FIG. 2B), a strain relief clip 33 can be seated on to the housing. The strain relief clip can be pre-assembled and attached to both the micro line 2011 and macro line 2021. When installed, the strain relief can be placed to the right and immediately adjacent a sensor bridge 10*e* that forms a right wall of the shallow manifold tray indent 10*c* in which the manifold 20 is seated. The strain relief clip 33 can be pre-assembled to the transfer set 2 to ensure ease of use by the end user.

Figure 3C:
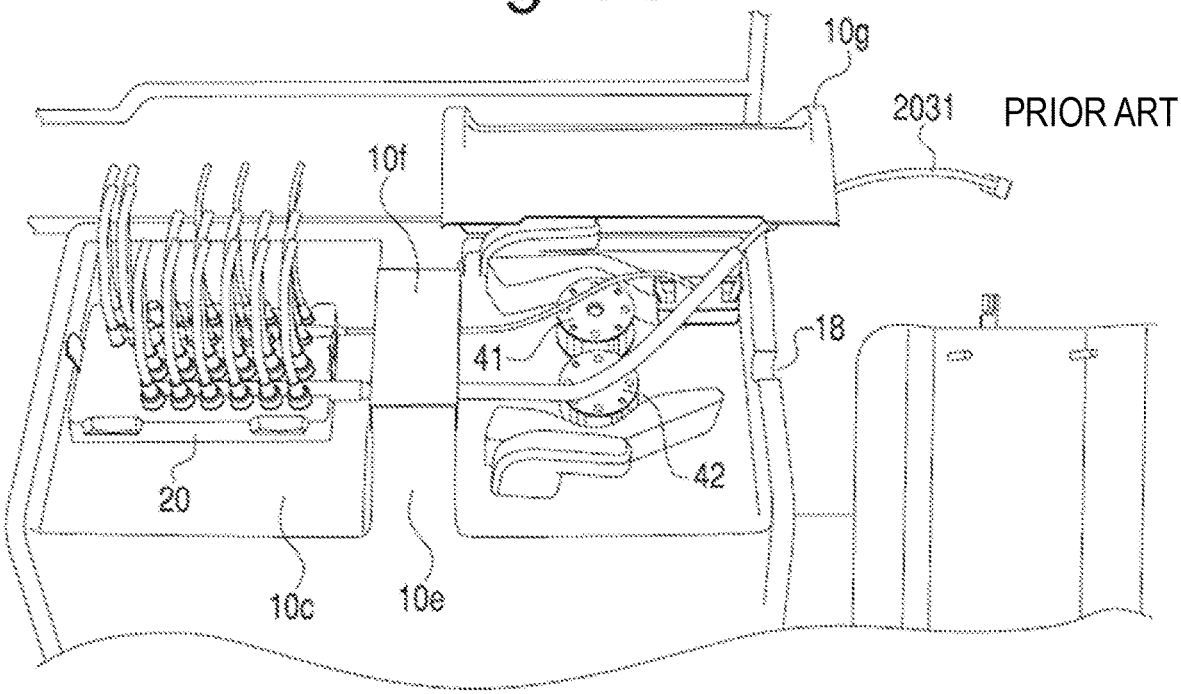

As shown in FIG. 3C, once the manifold 20 is attached to the housing 10 and the strain relief clip 33 is in place, the sensor bridge cover 10*f* can be closed over the sensor bridge 10*e* in order to protect the sensors and strain relief clip 33 from inadvertent contact and/or contamination from dust, liquids or other contaminants. The sensor bridge 10*e* can include a sensor or sensors (for example, an ultrasonic sensor, photo sensor, or other sensor) acting as a bubble detector and/or occlusion detector.

Figure 3D:
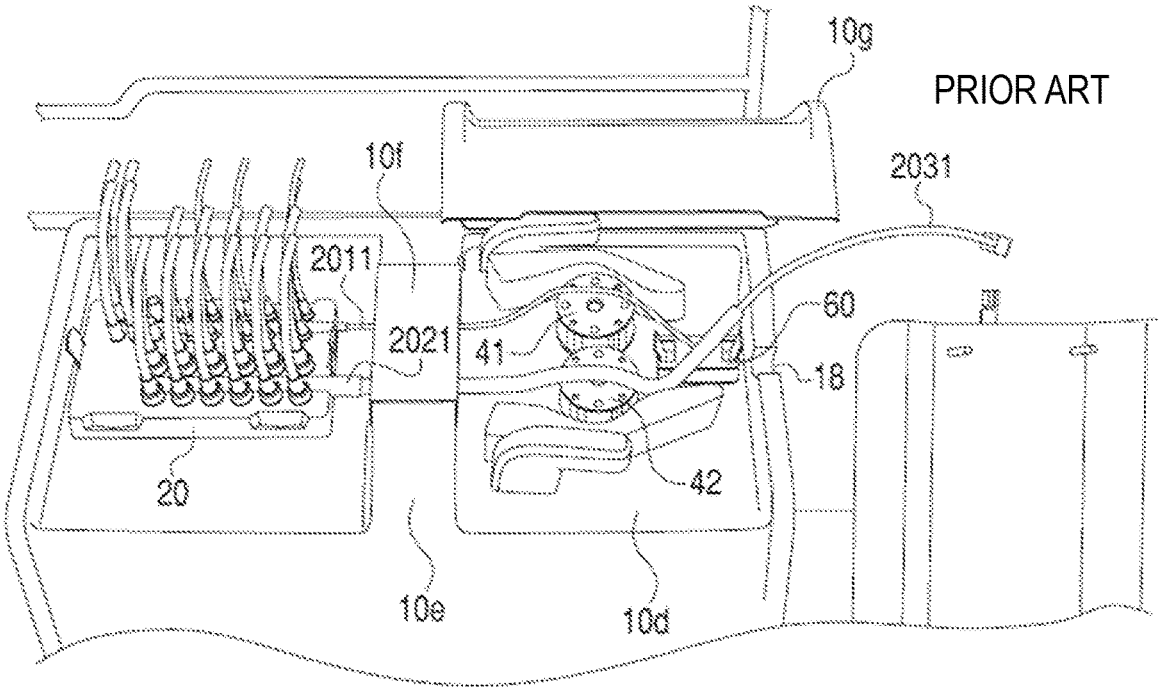

FIG. 3D shows an exemplary next step of installing the transfer set 2, which includes connecting the union junction 60 to the housing by snapping clip locks 60*f* (see FIGS. 10 and 11) located on the junction 60 to mating locks formed on an upper surface of the housing 10 and to the right of the pump 40. The output line 2031 can be set within an output guide 18 (See FIG. 3A) formed in an outer wall that defines a second shallow pump tray indent 10*d* in the upper surface of the housing in which the pump 40 is located.

Figure 3E:
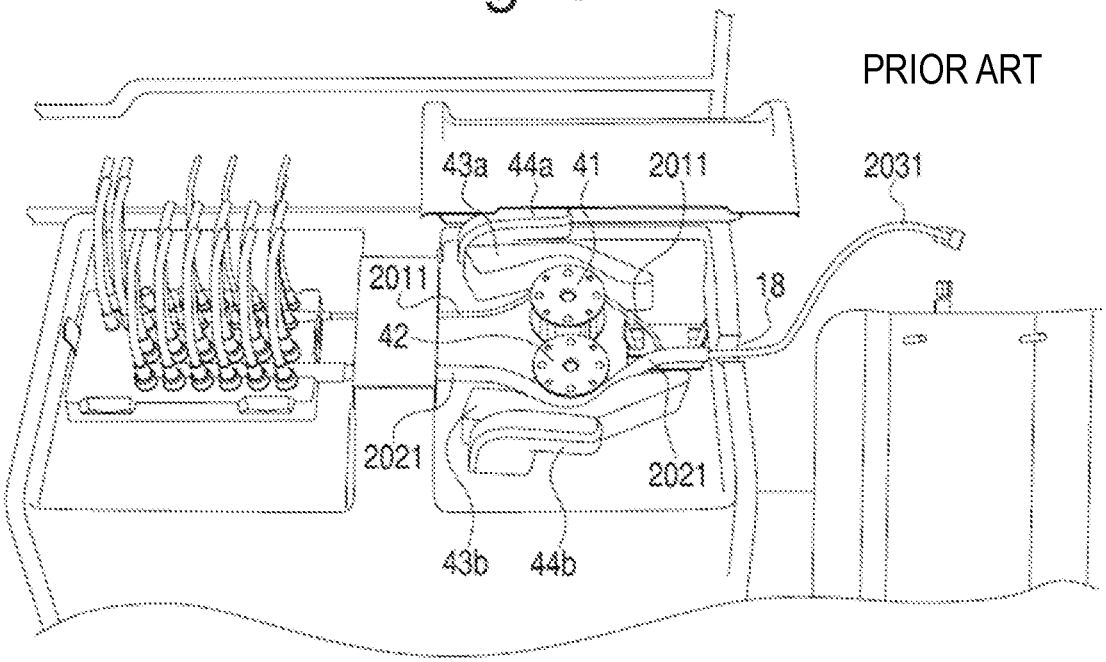

As shown in FIG. 3E, once the junction 60 and output line 2031 are in place, the micro line 2011 and macro line 2021 can be seated within the peristaltic pump 40. Alternatively, the union junction 60 can also be snapped into place after installing the pump tubing around a rotor for each pump 41, 42. In particular, micro line 2011 can be placed about the outer periphery of first rotor 41 and macro line 2021 can be placed about the outer periphery of second rotor 42. In this position, the micro line 2011 will be located between the first/micro rotor 41 and the first/micro platen 43*a*, and the macro line 2021 will be located between the second/macro rotor 42 and the second/macro platen 43*b*.

Figure 3F:
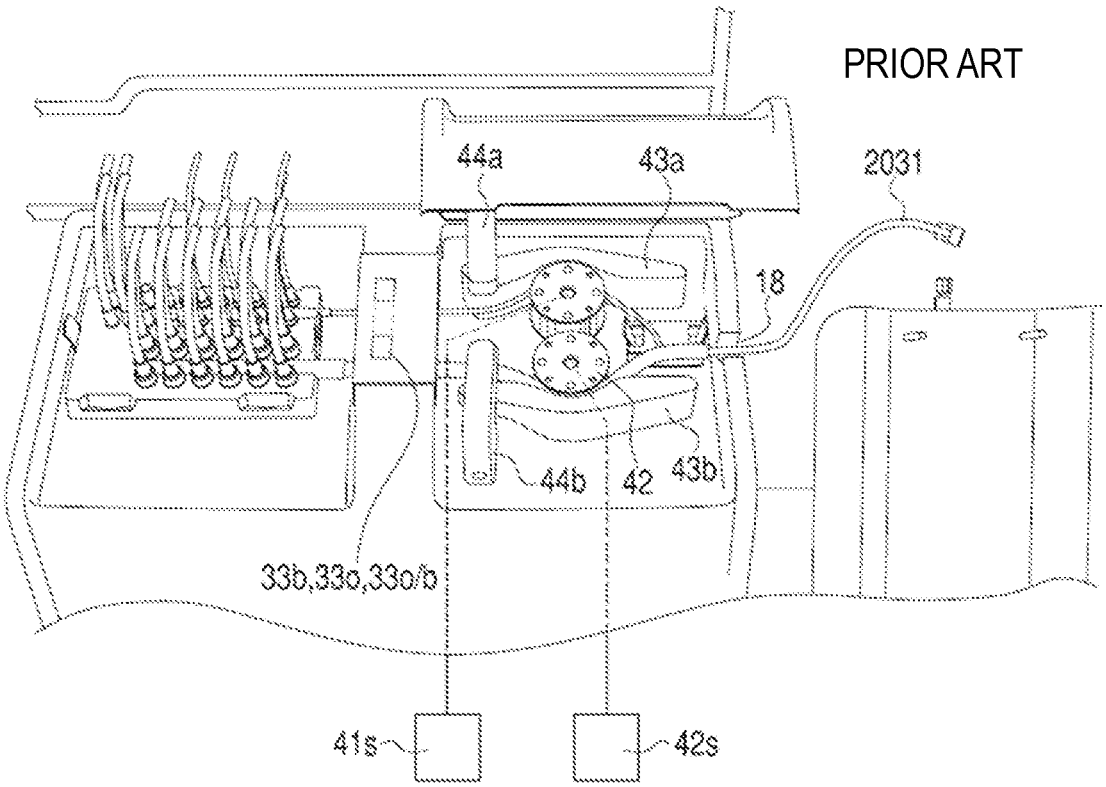

FIG. 3F shows an exemplary next step for connecting the transfer set 2 to the housing 10, which includes rotating the first/micro platen lock 44*a* clockwise to lock the platen 43*a* at its closed position relative to the first rotor 41, and rotating the second/macro platen lock 44*b* counter-clockwise to lock the second platen 43*b* at its closed position relative to the second rotor 42. In this position, when the rotors 41 and 42 are actuated and when any one of the valves 21*a*, 21*b* are rotated to the open position, each of the rotors will draw fluid(s) through respective lines 2011, 2021 through peristaltic forces/actions. If one of the valves 21*a* or 21*b* is not opened and the pump rotor operates, the peristaltic forces will create a vacuum between the manifold channels 24*a*, 24*b* inside the micro lines 2011 or macro lines 2021 between the manifold 20 and the pump rotors 41, 42 possibly resulting in an occlusion of the affected line. The occlusion will be detected as the wall of the micro lines 2011 and macro lines 2021 will partially collapse and this will be measured by the occlusion sensor within the sensor bridge 10*e*. The occlusion sensor 33*o* can be an optical sensor, a force based sensor, pressure sensor, an ultrasonic sensor or other known sensor for determining whether an occlusion has occurred in the line. In another embodiment, an occlusion sensor 33*o* and a bubble sensor 33*b* can be incorporated into the sensor bridge 10*e*. Alternatively, a combined sensor 33*o/b* or sensors 33*o*, 33*b* can be incorporated into the strain relief 33, or at other locations along the system 1, and can be integrated into the strain relief 33 or bridge 10*e* or can be separate and independent structures that are attached to the system 1.

Figure 3G:
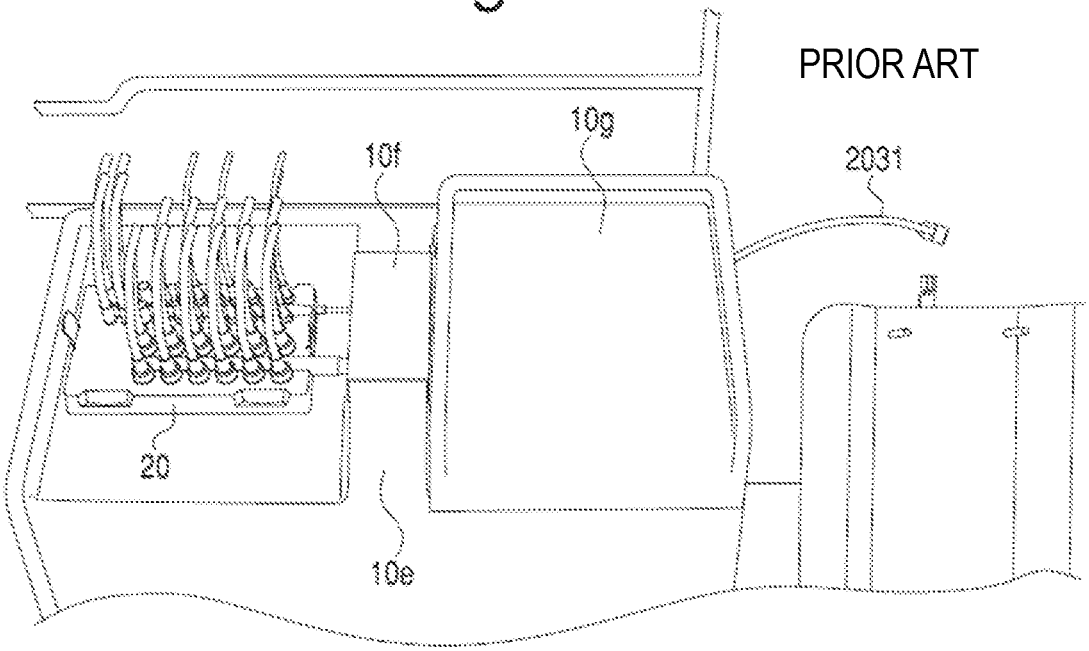

FIG. 3G shows an exemplary final step in the setup of the system 1, in which the pump cover 10*g* is closed over the pump 40 to protect the pump 40 from contact with other devices/structures/persons and to protect the pump 40 and associated lines 2011, 2021 from contamination from dust, liquids, or other contaminants. Each of the sensor cover 10*f* and pump cover 10*g* can include a magnet or other type of sensor or locking mechanism to ensure the covers are in place during operation of the system 1.

Once the transfer set 2 is correctly connected to the housing 10, input/storage containers 4*a*, 4*b*, and receiving bag 80, and the covers 10*f* and 10*g* are closed, calibration of the system 1 and then processing and compounding of various fluids can take place.

Figure 3H:
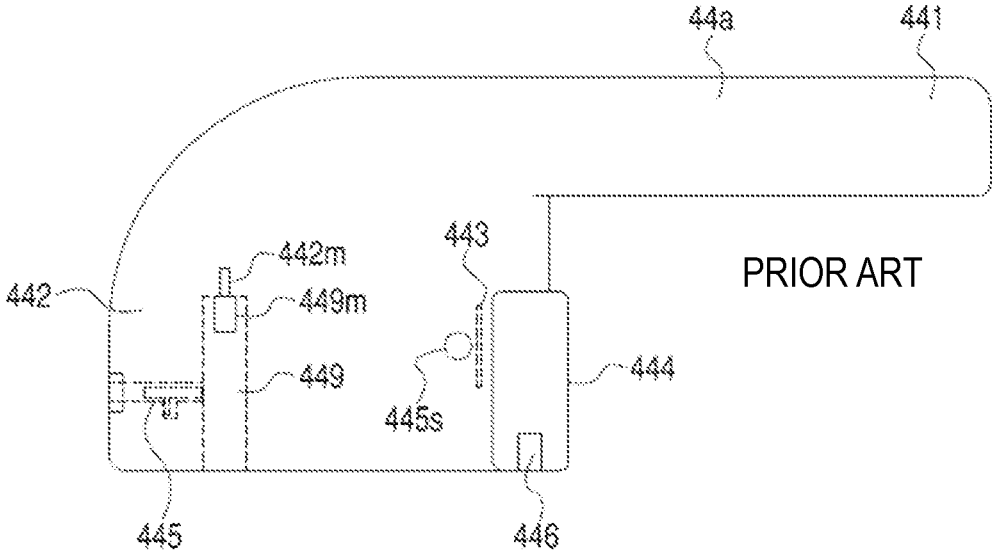
FIG. 3H is a side view of the platen lock shown in FIGS. 3A-3F.

FIG. 3H depicts an exemplary embodiment of a platen lock 44*a*. The platen lock 44*a* can be configured to rotate about a rotational axis and cause a cam 444 to come into resilient contact with the platen 43*a*. The cam 444 can include a biasing member, such as, for example, a spring 443, including, but not limited to, a plate spring, coil spring, or other type of spring to cause the cam 444 to keep in constant contact with and apply a preset and constant force to the platen 43*a*, which in turn keeps a constant or preset force on the micro line 2011 located between the platen and the rotor 41 to ensure accurate and predictable volumetric output by the pump 40 over the life of the transfer set. The spring 443 can be an important factor in the wear of the tubing lines during compounding, which can also impact the output of the pump 40.

Accuracy can also be a function of pump tubing inner diameter, tubing wall thickness, and the spacing between rollers and platen. Accuracy is also affected by the speed of rotation, but both motors can have the same accuracy.

The platen lock 44*a* can have a streamlined appearance, being configured substantially as a simple, L-shaped structure with an overhang upper extension 441 and a rotational lower extension 442. The lower extension can have a longitudinal axis about which the platen lock 44*a* rotates. The platen lock 44*a* can be made from aluminum or other rigid material such as plastics, ceramics and/or other metals or alloys. The simple structure provides a user a sense of efficiency in the nature of operation of the platen lock structure 44*a*. The lower extension 442 can be configured with an opening to slide on to and attach to rotational post 449 extending from/within the housing 10. The platen lock 44*a* can lock on to the post 449 via a simple friction fit, a spline type relationship between the post 449 and the opening in the lower extension 442, or other structural configuration. In an alternate embodiment, a set screw structure 445 can be provided in the lower extension 442 for quick connection to the rotational post 449 that extends from the housing 10 of the compounding system 1. In the embodiment depicted in FIG. 3H, a set screw 445*s* can be used to set the preload on the spring 443 that is contained inside the platen lock 44*a*, 44*b*. This spring 443 applies force on the platen 43*a*, 43*b* and ultimately squeezes the platen 43*a*, 43*b* against the respective rotor 41, 42. A magnetic lock structure 449*m* and 442*m* can also (or alternative to the screw structure 445) be provided and can have multiple functions, including: locking the platen lock 44*a* to the housing 10 to prevent removal of the platen lock 44*a* from the housing 10 until the magnetic locks 449*m* and 442*m* are released. The location of platen lock 44*a* with respect to platen 43*a* can be achieved by a detent position on the backside of the platen 43*a*. As the platen lock 44*a* is rotated against the platen 43*a* towards the lock position, the cam 444 follows a profile on the back of the platen which includes a raised feature to compress the cam 444, which the user has to rotate past to reach the final lock position. The action of the cam over this feature provides feedback to the user that the lock point has been reached, and mechanically maintains this lock position due to the cam sitting in a cavity feature. Continued rotation past the desired lock point can be prevented by providing hard stop geometry in the platen profile such that the cam cannot get past the hard stop geometry. The location of the cam 444 when the platen lock 44*a* is in this lock position, is where sensor 2904*a* is tripped via a magnet 446 embedded in the bottom of cam 444. The coupling of lock arm 44*a* to the post 449 is achieved via a pair of magnets, the first 449*m* embedded in the top of post 449, the second 442*m* at the end of the receiving bore in the lower extension 442 of the lock arm 44*a*.

Another benefit of this exemplary embodiment of the system 1 is that the configuration allows the operator to easily remove the platens 43*a*, 43*b* and platen lock components 44*a*, 44*b* from the pump housing for cleaning without the use of tools. Both platens 43*a*, 43*b* can be removed by simply pulling them upward and away from the pump housing surface 10*d*.

In addition, both rotors 41, 42 can be removed without tools by simply unscrewing thumb screws that can be provided at a center/rotational axis of the rotors 41, 42. Because the rotors 41, 42 can be interchangeable, their life can be extended by swapping their positions after cleaning, e.g., macro to micro and micro to macro.

The pump 40 as a peristaltic pump can include first and second pump rotors 41, 42 that are each mounted upon and separately rotated by a respective stepper motor 41*s*, 42*s* (See FIG. 3F). Each of the stepper motors 41*s*, 42*s* can have a preset microsteps per revolution value that is relatively high (for example, on the order of $10^3$ greater than the microsteps per revolution value for the stepper motors 102*a*, 102*b* used to rotate valves 21*a*, 21*b* located in manifold 20, as described in more detail below). The high value of microsteps per revolution for the stepper motors 41*s*, 42*s* allows for greater accuracy or precision in fluid delivery for the system 1. Each of the stepper motors 41*s*, 42*s* can be connected to controller 2900 and can be separately, sequentially, serially, concurrently or otherwise controlled to cause each of the rotors 41, 42 to rotate a known and predetermined amount and possibly at a predetermined speed such that a highly accurate amount and timing of material flow through the compounding device can be achieved. In addition, steppers 41*s*, 42*s* can be provided with absolute encoders that are in communication with controller 2900 to provide explicit positioning control of the steppers 41*s*, 42*s*.

The first, or micro, and second, or macro, pump rotors 41, 42 can be substantially identical to each other such that they can be interchanged. For example, in one embodiment, the macro rotor 42 can be configured to rotate more than the micro rotor 41 and will thus be subject to higher wear. Thus, at some point during a break in operation of the compounding system 1, the macro rotor 42 can be interchanged with the micro rotor 41 such that the rotor 41 will act as the macro rotor and be subject to the heightened wear for a time period. In this manner, the life of both rotors 41, 42 can be extended.

The cam 444 and the spring 443 can also be configured to provide a known force to the platen 43*a* when the platen lock 44*a* is in a certain rotational position such that the platen lock 44*a* is effectively locked in place due to both resilient forces and frictional forces that occur when at the certain position relative to the platen 43*a*. In other words, once the platen lock 44*a* passes a predetermined rotational position, resilient force acting on the platen lock 44*a* by the platen 43*a* tends to cause the platen lock to continue its clockwise rotation. A sensor, such as a magnet 446, can be provided in the platen lock 44*a* and configured to trip a corresponding sensor 2904*a* in the housing 10 that tells the system the platen lock 44*a* is in the correct position. However, if there is a rotational stop located in either the post in the housing or the lower extension 442, the platen lock 44*a* will be unable to rotate further in the clockwise rotational direction and will simply maintain the above-referenced known resilient force (due to cam 444 and cam spring 443) with the resilient force also acting to prevent release of (counterclockwise rotation of) the platen lock 44*a*. Unlocking the platen lock 44*a* from the platen 43*a* in this case would simply require the operator to overcome the resilient and frictional forces of the cam in the detent position tending to hold the structures in place. It should also be noted that the platen lock 44*b* and platen 43*b* can be configured in a similar manner as described above with respect to the platen lock 44*a* and platen 43*a*, except that locking would occur in a counterclockwise rotational motion.

Figure 4A:
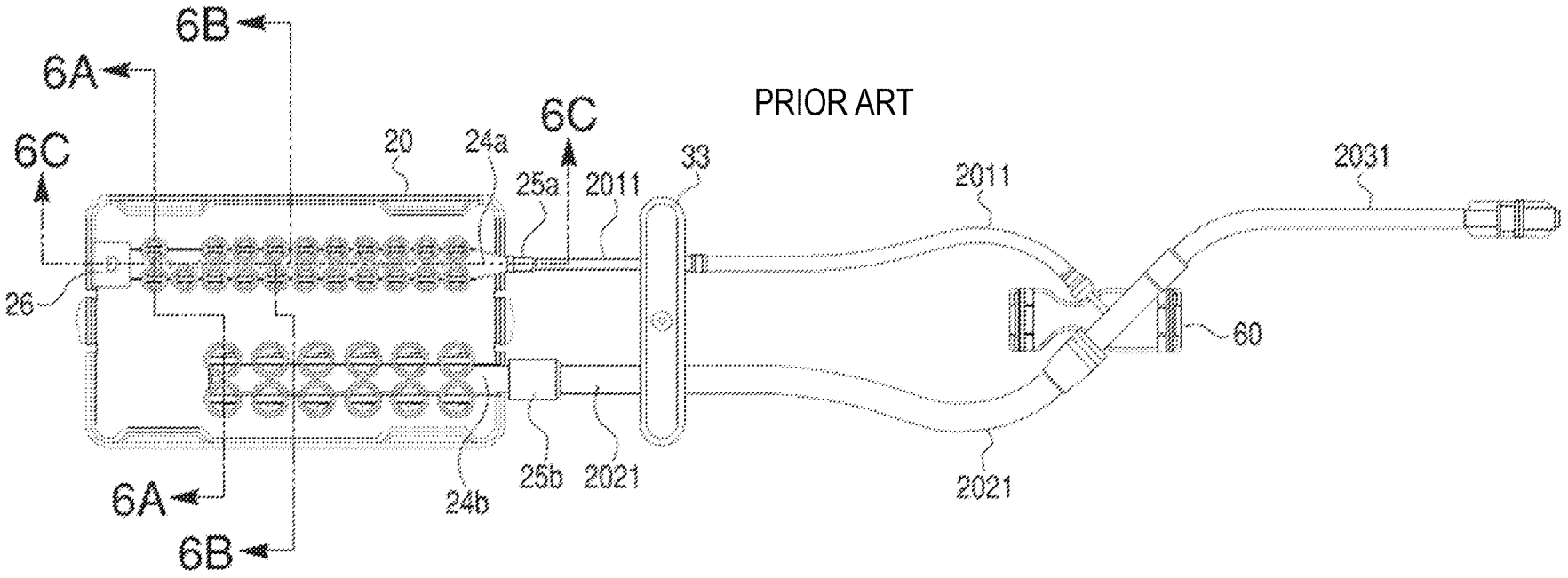
Fig. 4A PRIOR ART
FIG. 4A is a top view of an exemplary manifold, strain relief, union junction, and output line made in accordance with principles of the disclosed subject matter.
Figure 4B:
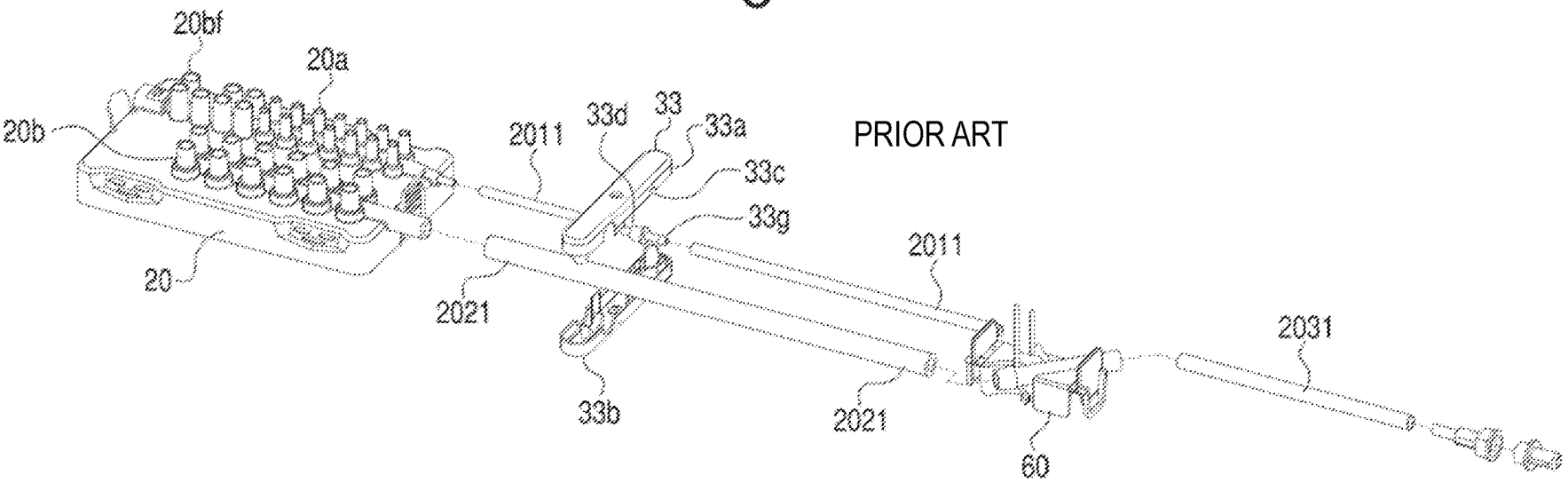
Fig. 4B PRIOR ART
FIG. 4B is a perspective exploded view of the structures shown in FIG. 4A.

FIGS. 4A and 4B show a portion of an exemplary transfer set 2 that includes a manifold 20 connected via micro line 2011 and macro line 2021 to a strain relief clip 33. Micro line 2011 and macro line 2021 extend past the strain relief clip 33 and eventually combine or merge at the union junction 60, resulting in a single outlet line 2031 for the transfer set 2. The macro lines 2021 can be portions of the same continuous tubing structure. By contrast, in this example, micro lines 2011 are separate structures joined together by shunt 33*g*. The shunt 33*g* can be made from a material that is harder than the micro lines 2011. For example, the micro lines 2011 can be made from silicone tubing while the shunt 33*g* can be made from a relatively more rigid PVC material. The shunt 33*g* provides extra rigidity such that the strain relief clip 33 can connect securely thereto without causing the inner diameter of the shunt 33*g* to be squeezed or otherwise reduced. One or more collars 33*d* can be provided on the shunt 33*g* to lock to the clip 33 and prevent the shunt 33*g* from moving along a longitudinal axis of the micro lines 2011. Additional collars are contemplated so that manufacturing can be easier with respect to consistently locating/assembling of the manifold set structures. By contrast, the macro line 2021 can be sufficiently large enough in diameter and thickness such that its inner diameter is not squeezed or reduced when the clip 33 is attached thereto. Thus, when the strain relief clip 33 is attached to the micro lines 2011 and macro line 2021, the clip 33 does not significantly change the inner diameter characteristics for the lines while preventing forces acting along the longitudinal axes of the lines from being transmitted past the clip 33. Thus, when the micro line 2011 and macro line 2021 are connected about a respective rotor 41, 42 of the peristaltic pump 40, the rotary forces acting on the lines do not translate along the micro and macro input lines back towards the manifold 20 and the bubble and occlusion sensors. The strain relief clip 33 acts as a damper to minimize transmission of linear forces and vibrations from the pump 40 to the manifold 20. Minimizing these forces and vibrations optimizes the functionality of the bubble and occlusion sensors that would otherwise be impacted by changes in tubing tension as the tubing is pulled by the peristaltic action of the pump. Similarly, the strain relief provides a fixed position on the set 2 relative to the manifold 20 to facilitate installation of the tubing or line segments through the occlusion and bubble sensors 33*o*, 33*b*, 33*o/b* and maintains a repeatable tension on these line segments.

Figure 5:
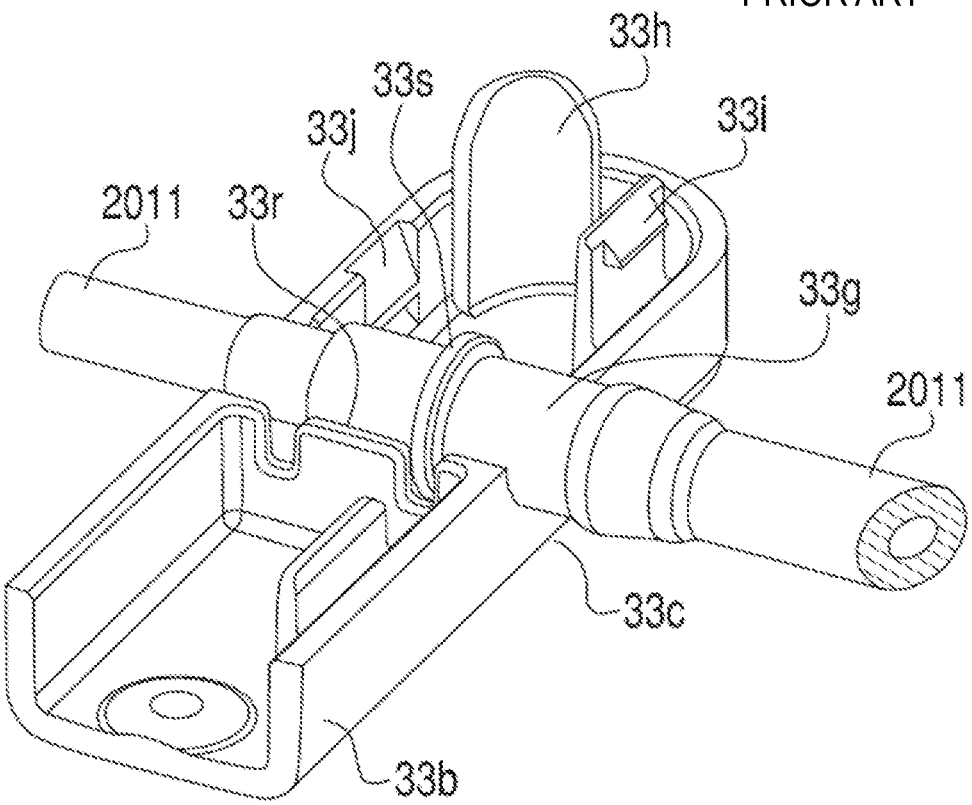
Fig. 5 PRIOR ART
FIG. 5 is a partial perspective view of the strain relief shown in FIG. 4A.

The strain relief clip 33 can be of various shapes, and in the embodiment shown in FIG. 5 the clip 33 is configured as a two piece clam shell type design in which an upper portion 33*a* can be attached to a lower portion 33*b* by clips 33*i* that are integrally formed at locations about a perimeter of each portion 33*a* and 33*b*, and mate with snap latch receptacles 33*j* in an opposing portion 33*a*, 33*b*. Throughways 33*c* can be formed as half cylindrical cutouts in the upper portion 33*a* and lower portion 33*b*. A guide sleeve 33*h* can be provided at a corner of one of the clam shell portions 33*a*, 33*b* to guide the opposing claim shell portion 33*a*, 33*b* into engagement when coupling the clam shell portions 33*a*, 33*b*. The micro line 2011 and macro line 2021 can pass through these throughways 33*c* and be locked to the strain relief clip 33 by a series of ridges 33*r* that connect to mating ridge 33*s* in the shunt 33*g* and/or to the macro line 2021 itself. It is possible that the strain relief parts 33*a* and 33*b* are in fact identical so that the above described process and configuration is possible with the use of two instances of the same component.

Figure 6A:
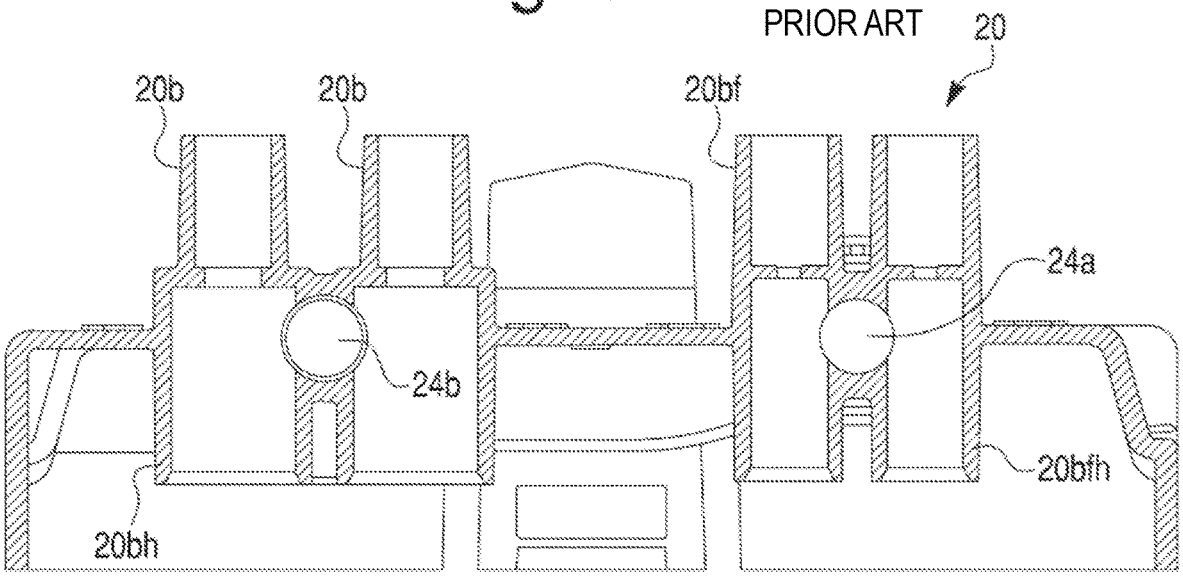
FIGS. 6A-C are cross section views taken along lines 6A, 6B, and 6C of FIG. 4A, respectively.
Figure 6B:
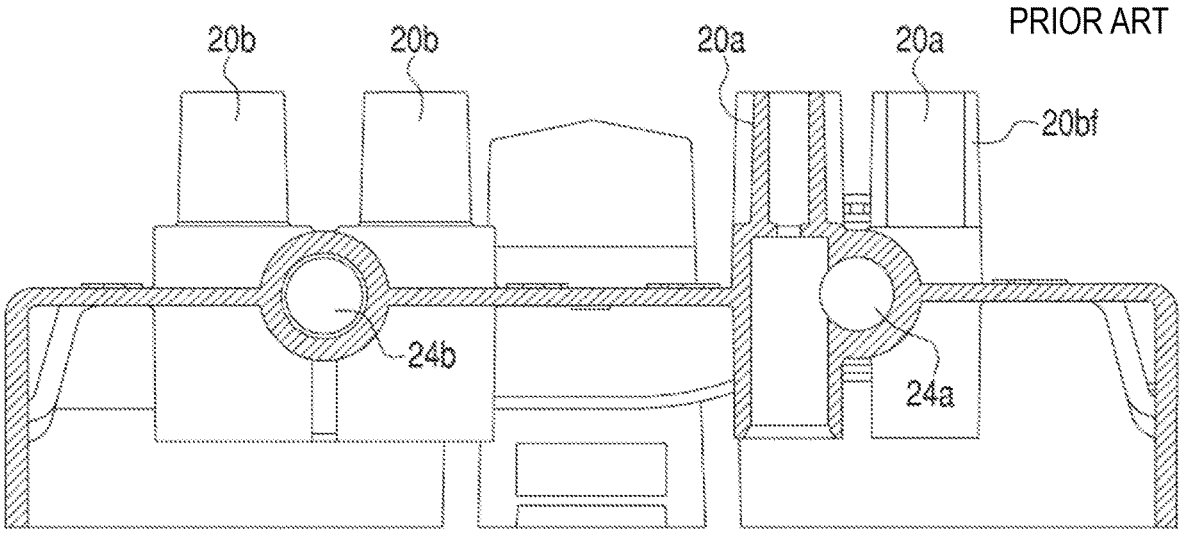
Figure 6C:
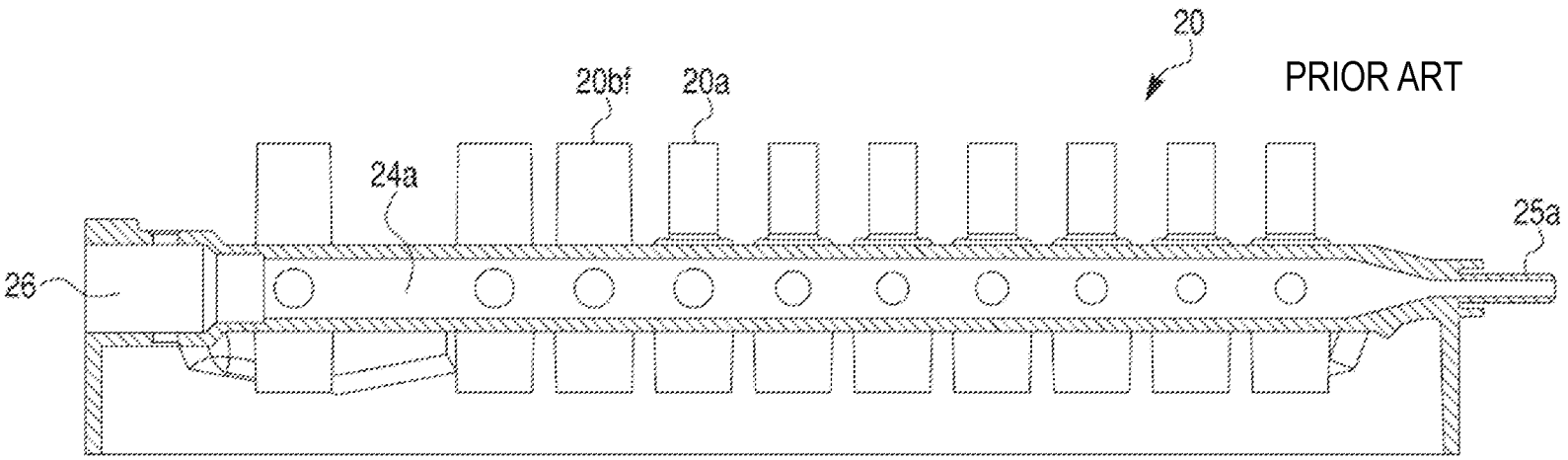

FIGS. 6A-6C show various cross-sections of the exemplary manifold 20 of FIG. 4A without valve structures located therein for clarity. The cross section shown in FIG.

6A depicts two sets of ports: two macro ports 20*b* and two flex ports 20*bf* that are each cylindrical in shape and are in fluid communication with a valve housing 20*bh* and 20*bfh*, respectively, located immediately underneath the ports 20*b* and 20*bf*. The ports 20*b* and 20*bf* are configured such that a macro line 2021 can be slid into the inner periphery of the upward and outward facing cylindrical opening in the ports 20*b* and 20*bf* for attachment thereto. Thus, the ports 20*b* and 20*bf* can be connected to various macro source containers 4*b* via the lines 2021 attached to the ports 20*b* and 20*bf*. A valve 21*b*, 21*a* (to be described in more detail below) can be located within the valve housing 20*bh*, 20*bfh*, respectively, located beneath the ports 20*b*, 20*bf*. When the valve 21*b*, 21*a* is located in the housing 20*bh*, 20*bfh*, the valve 21*b*, 21*a* selectively connects the fluid located in line 2021 with the fluid located in channel 24*b*, 24*a* of the manifold depending on the valve's rotational position within the housing 20*bh*, 20*bfh*.

The manifold described above can, in the exemplary embodiment, be formed (e.g., molded) as one unitary structure 20 including all of the features 20*a*, 20*b*, 20*bf*, 20*ah*, 20*bh*, 20*bfh*, 24*a*, 24*b*, 25*b*, 26, 27*a*, 27*b*, and 29. Also, it is possible to join any or all separate structures (components) 20*a*, 20*b*, 20*bf*, 20*ah*, 20*bh*, 20*bfh*, 24*a*, 24*b*, 25*b*, 26, 27*a*, 27*b*, and 29 in any combination into a manifold assembly 20 to achieve the same purpose.

Figure 7A:
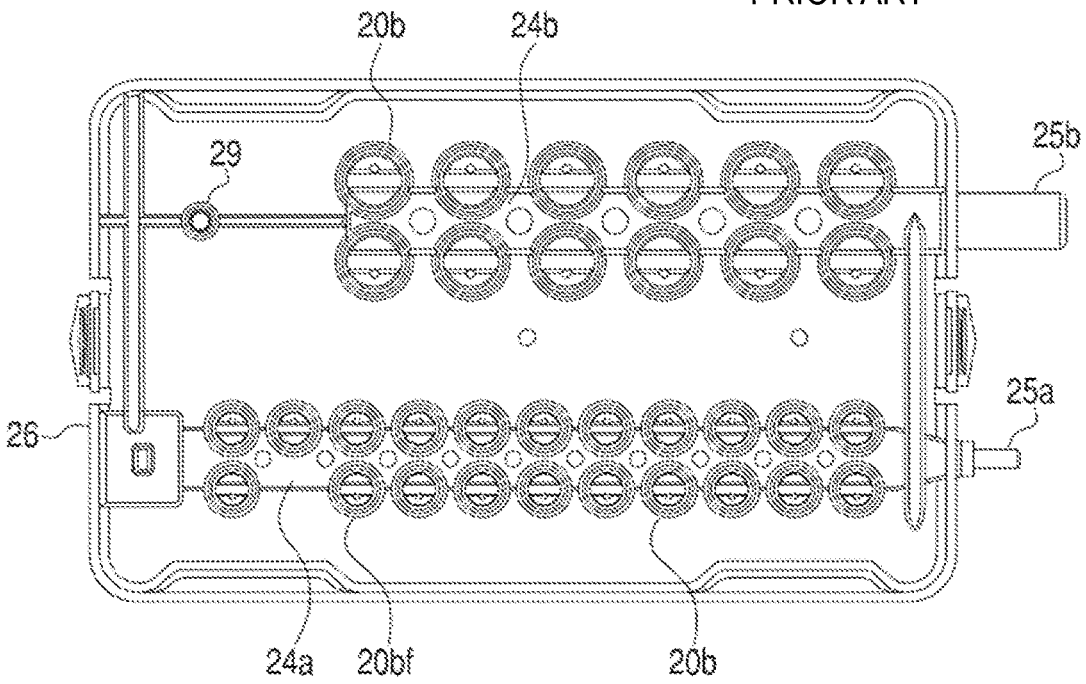
Fig. 7A PRIOR ART
FIGS. 7A-C are a bottom, perspective exploded, and perspective assembled view, respectively, of the manifold of FIG. 1.
Figure 7B:
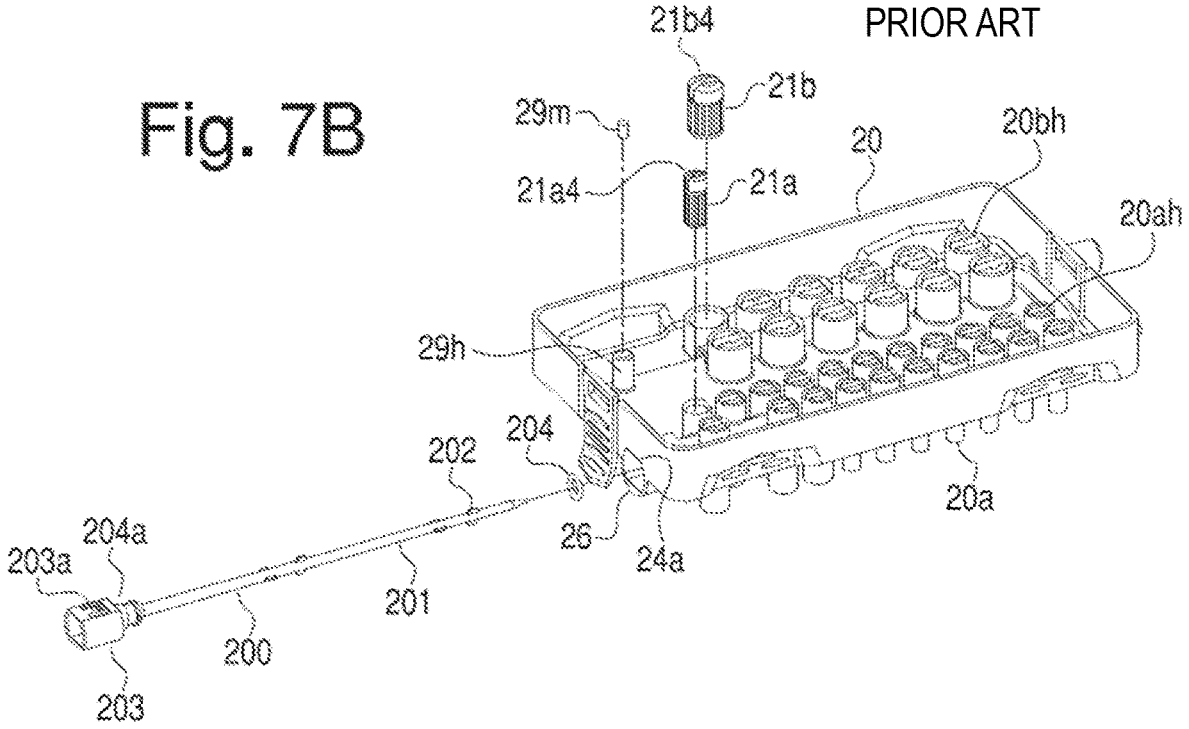
Fig. 7B PRIOR ART
Figure 7C:
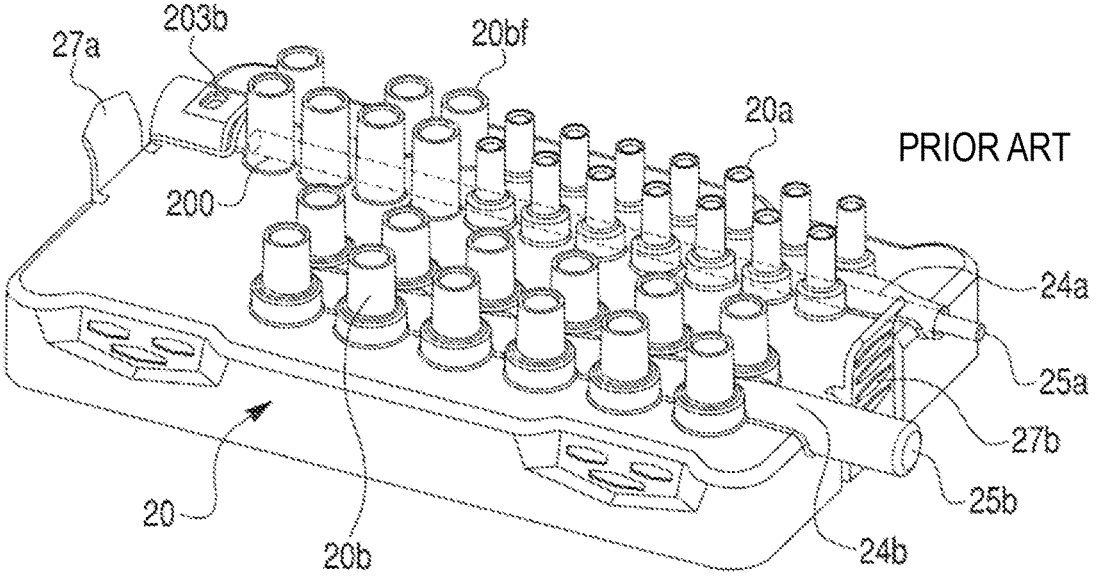

FIGS. 7A-C show a bottom view of the manifold 20, an exploded view, and an assembled view, respectively. The manifold 20 includes an array of macro ports 20*b* located in a linear fashion along either side of second channel 24*b*. The first channel 24*a* includes both flex ports 20*bf* and micro ports 20*a* located along the length thereof and provides fluid communication therebetween. Thus, the first channel 24*a* can be connected to both a macro flex line 2021 and a micro line 2011. In this embodiment, the flex line is configured as shown in FIG. 1 as a first macro line 2021 that is joined at a junction 2071 to two outgoing macro lines 2021 to allow fluid from macro container 4*b* to be supplied to both the first channel 24*a* and second channel 24*b*. In other words, a jumper branch connection in a macro line 2021 can be provided such that the macro line 2021 branches in two directions after leaving the macro storage container 4*b*, and can be connected to both the second channel 24*b* and the first channel 24*a*. The flex line conducts the same fluid/solution (e.g., nutritional ingredient) from container 4*b* to both channels 24*a* and 24*b* of the manifold 20 after passing through the valves 21*bf* and 21*b*, respectively. This facilitates the option of a singular or larger source container 4*b* being used for purposes of flushing/clearing the channels 24*a* and 24*b* as opposed to two separate containers 4*b*, wherein one container is connected to channel 24*a* and a separate other container is connected to channel 24*b*. A plurality of flex lines can be used since multiple types of flushing ingredients may be required during a compounding campaign depending on the varying clinical needs of the intended final contents of sequentially filled receiving containers (e.g. final bags 80). It should be noted that in this embodiment flex lines are terminated at flex ports 20*bf* (See FIG. 6B) farthest along the channels 24*a* and 24*b* from the outlets 25*a* and 25*b*, thereby allowing the entire channels 24*a* and 24*b* to be flushed with the flushing ingredient. In this embodiment, the micro line 2011 is not branched after leaving the micro storage container 4*a*, and therefore, there are no micro ports 20*a* that communicate with the second channel 24*b*. It is contemplated that an embodiment of the disclosed subject matter could include a manifold configured with valves adapted to allow micro lines to be attached to both the first and second channels 24*a* and 24*b*. Flex lines are designed to be used for any ingredient that may be requested across a wide range of volumes among different patient prescriptions. Hence, for some prescriptions where they are requested in small volumes, they can be delivered by the micro pump. Similarly, for prescriptions where they are requested in large volumes, they can be delivered by the macro pump. The y-connection fluid path of the flex line gives the ingredient access to both fluid paths (micro and macro) therefore the system can decide which pump to use to deliver that ingredient appropriately based on the requested volume.

In FIG. 7B, the valves 21*a*, 21*b* and filler 200 are disassembled to better show their relationship with the macro valve housing 20*bh*, micro valve housing 20*ah*, and first channel 24*a* in which each of these structures resides when assembled and ready for use. As can be seen, each of the valves 21*a* and 21*b* include a keyway 21*a*4 and 21*b*4, respectively, that allows for positive attachment to an actuator member 102*a*' and 102*b*' that extends from a manifold indent/surface 10*c* in the housing 10 of the compounding device.

The operational valve structures are in fact combinations of the rotating members (valves 21*a* and 21*b*) and the inner diameter (ID) of the socket in the manifold (20*ah* and 20*bh*) in which the valves 21*a*, 21*b* are located. The configuration of the operational valve structures was intended to create a more moldable elastomeric valve in which, under static fluid conditions, gravity based movement of fluids (like the motion caused by fluids of differing densities or different specific gravities settling or rising when the valve is left open) can be prevented or limited.

The actuator member is controlled by at least one stepper motor 102*a*, 102*b* such that rotation of the valves 21*a* and 21*b* can be precise. In one embodiment, the stepper motor 102*a* for the micro valves 21*a* can be of higher precision than the stepper motor 102*b* for the macro valves 21*b* (See FIG. 9). Higher precision stepper motors can be used to provide the positional accuracy of the micro valves 24*a* due to the inherent flexibility of the micro valves 24*a*. For example, a stepper that has a preset value of about 48 microsteps per revolution can be used (which preset value can be on the order of $10^3$ less than the microsteps per revolution value for the pump). Accuracy of the valves 21*a*, 21*b* (i.e., precise movement of the valves 21*a*, 21*b*) can be further controlled through the use of a tall gear box, which would result in large input rotations for the stepper motors 102*a*, 102*b* providing for small movement of each of the valves 21*a*, 21*b*, respectively. The flexibility of material that makes up each of the valves 21*a*, 21*b* can be configured or selected to enhance or provide improved sealing surfaces which withstand pressure differentials without leaking. Given this torsional flexibility and considering the friction opposing rotation of the micro valve 24*a*, it follows that during rotation, the upper features of the valve, i.e., those opposite the drive slots 24*a*4, angularly lag behind the lower features of the valve. Thus, in order to properly place the fluid opening between the valve 24*a* and the channel 21*a*, the higher precision stepper motors first rotate the valve 24*a* so that the top of the valve is properly positioned, and then reverse direction to bring the lower features also into proper position and therefore straightening the valve. The same action returns the valve to the closed position. The rotation of the steppers 102*a* and therefore the actuators 102*a*' and the valve 24*a*, can be clockwise, counter-clockwise, or any combination of these directions. Because, the micro valves 21*a* typically control the smaller volume ingredients, the volume should be measured and distributed with relatively higher accuracy as compared to that of the macro valves 21*b*, which typically distribute large volume ingredients in which high accuracy is easier to achieve. However, it should be understood that accuracy of delivery is not necessarily a direct function of valve operation. As long as the valves are properly opened and closed, the pumps 41, 42 can be used to provide accuracy of amount and control of fluid delivery.

In operation, the micro valves 21*a* and macro valves 21*b* can be described as being overdriven by the stepper motors past the 'open' position since the valves are flexible and the top of the valve lags behind the bottom of the valve when rotated. Thus, to properly open the valve, the bottom of the valve is overdriven from the target angular position. Once the top has achieved a proper location, the stepper reverses and brings the bottom of the valve into proper position. This operation effectively twists and then straightens the valve, and occurs in both the opening and closing process for the valves 21*a*, 21*b*.

Figure 9:
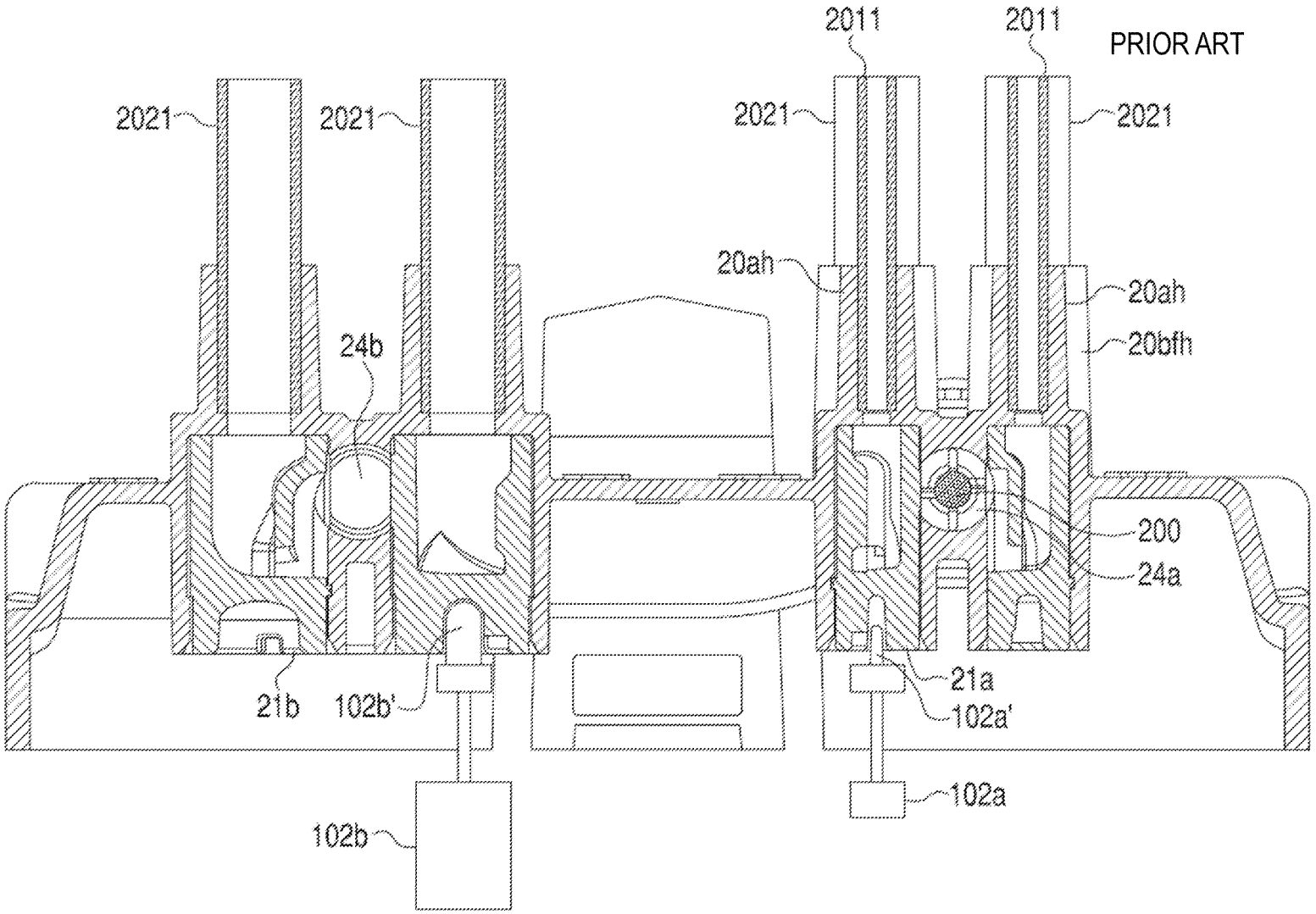
FIG. 9 is a cross-sectional view of two exemplary micro valves and two macro valves in open and closed positions and located in a valve housing in the manifold of FIG. 1.

FIGS. 7C and 9 show the valves 21*a*, 21*b* and filler 200 in place in the manifold 20. The filler 200 takes up volume within the first channel 24*a* such that the cross sectional area of the first channel 24*a* taken normal to a longitudinal axis of the channel 24*a* is smaller than the cross sectional area of the second channel 24*b* taken normal to a longitudinal axis of the channel 24*b*. Thus, the inner periphery of the first channel 24*a* and second channel 24*b* can be similarly shaped, allowing for certain architectural benefits in placement of the valves 21*a*, 21*b* and in fluid flow geometry of the channels 24*a*, 24*b*. The filler 200 can include a filler rod 201 that includes a plurality of spacers 202 located along the rod 201 so as to keep the rod 201 centered within the channel 24*a*. A clip lock 203 can be provided at a proximal location of the rod 201 and configured to lock with a mating clip lock indent in the manifold 20. In particular, a flexible tab 203*a* can be located on the lock 203 and configured to mate and lock with opening 203*b* in manifold 20 (See FIG. 7C). A sealing member 204, such as an O-ring 204, as shown in FIG. 7B, can seal the filler 200 in the socket 26 to prevent fluid such as air or liquids from leaking into or out of the channel 24*a* via the socket 26 when the filler 200 is located therein. The sealing member 204 can be located in an indent or receiving groove 204*a* on the rod 201 to lock the sealing member 204 in place with respect to the filler 200. One function of the filler 200 is to reduce common volume in channel 24*a*, which reduces priming volume and flushing volume. Because the micro pump only achieves limited flowrates, the large cross section of channel 24*a* without the filler would be difficult to be flushed of residuals.

Placement of the filler 200 in the channel 24*a* has the added benefit of increasing (or otherwise controlling and directing) turbulence within the channel 24*a*, and thus increases maximum fluid velocity within the channel 24*a*, permitting faster and more thorough flushing of residual fluids in the channel 24*a* to output 25*a*. The filler 200 can be conveniently loaded into the manifold via socket 26 during the time the manifold assembly 20 is being manufactured. The filler 200 geometry, particularly at the downstream end, is designed to promote flushing and to avoid areas where residual fluid can hide out and not flush properly.

Figure 8A:
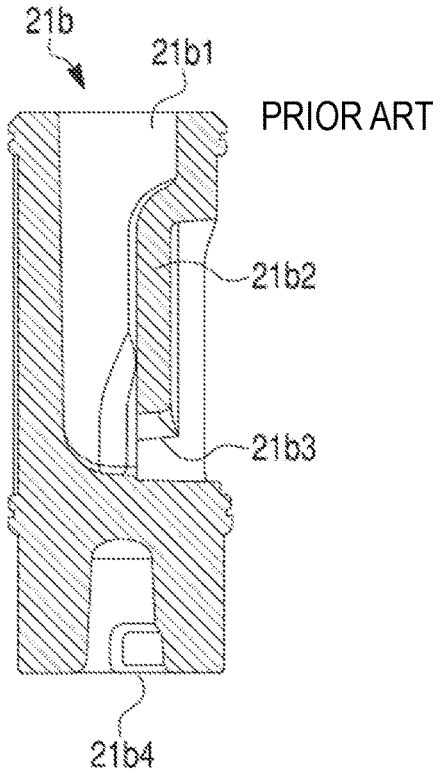
FIG. 8A is a cross-section taken along line 8A-8A of FIG. 8B.
Figure 8B:
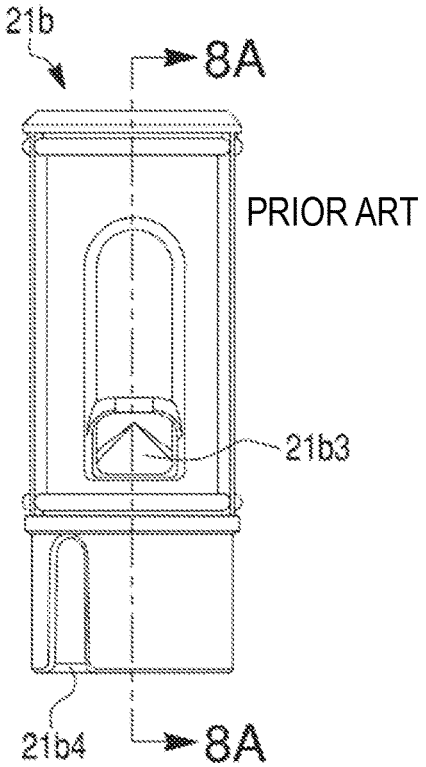
FIG. 8B is a side view of the valve shown in FIG. 7B.

Each of the micro and macro valves 21*a* and 21*b* can be configured as a rotational type valve that, when rotated a set amount, permits a corresponding or known amount of fluid to bypass the valve. In one embodiment, the valves 21*a*, 21*b* can be configured such that rotation of each of the valves does not move fluid, and only opens/closes a fluid path. The amount of fluid that bypasses the valve can, however, be ultimately determined by the pump speed, size and in conjunction with the tubing size when using a peristaltic pump. The valves can be configured to simply open or close the fluid lines. FIG. 8A shows a macro valve 21*b* that includes an inlet 21*b*1 at a top of the structure and an outlet 21*b*3 at a side wall of the structure. Thus, fluid enters the top of the valve 21*b* along a rotational axis of the valve 21*b*, and exits a side of the valve 21*b* in a direction substantially normal to the rotational axis of the valve 21*b*. Rotation of the valve 21*b* is accomplished by connection to a stepper motor 102*b* via actuator connection slot 21*b*4 located in a bottom surface of the valve 21*b*. The slot 21*b*4 acts as a keyway for a corresponding projection 102*b*' extending from the top of the stepper motor 102*b*. When the stepper motor 102*b* turns the projection 102*b*' a preset amount, the valve 21*b* is also caused to turn the same amount due to the connection between the projection 102*b*' and the keyway or slot 21*b*4. When the valve 21*b* is located in an open position or a semi open position, fluid can travel from the inlet 21*b*1 down through a center of the valve 21*b* until it passes wall 21*b*2, which can be configured as a gravity wall, or P-Trap, or similar structure. After passing the wall 21*b*2, the fluid then changes directions by approximately 180 degrees and moves up and over the outlet wall in the manifold 20 to be distributed into the second channel 24*b*. The wall 21*b*2 and geometry and configuration of surrounding manifold walls prevents fluid from inadvertent and uncontrolled mixing between lines 2011/2021 and the common volume of channel 24*a* on the micro side and between lines 2011 and the common volume of channel 24*b* on the macro side when 1) the valve is open, 2) the fluid is static (i.e., pump rotors 41 and 42 are not moving), and 3) there exists a differential in specific gravity between the respective fluids in the input lines and in the channels. The motivator for this backflow is specific gravity differences between the ingredient fluid and the fluid in the channel. This wall 21*b*2 is a technical feature of the valve that mechanically prevents this backflow from occurring without additional control mitigations, and requires no additional software/valve controls to limit the effect of this backflow tendency because the wall structure physically stops or prevents backflow from happening. Thus, the walls 21*b*2 and surrounding geometry of the valve housing 21*bh* prevents contamination of the ingredients in the supply lines and storage containers 4*b* and prevents uncontrollable flow/mixing into the channels 24*a* and 24*b* of the manifold 20 due to, for example, differences in specific gravity of the solutions or fluids running through the valves. The output of the micro and macro valves 21*a*, 21*b* (with respect to each respective opening into the common channels 24*a*, 24*b* located in manifold 20, shown in FIG. 9) is above the above-described "P-trap" thus not allowing flow that might otherwise enter into the manifold 20 due to specific gravity differences. Thus, the valves 21*a*, 21*b* work with the structure of the manifold 20 in this embodiment to form the specific gravity "P-trap" structures.

Although FIGS. 8A and B show a macro valve 21*b*, the micro valve 21*a* can be configured and will operate in the same manner, albeit using smaller dimensions.

The two motors that drive each of the rotors 41, 42 can be the same, and similarly the rotors 41, 42 can be identical. The tubing in each channel can be different, and the platen positions can be different because of the difference in the diameter and wall thickness of the tube sections.

Figure 10:
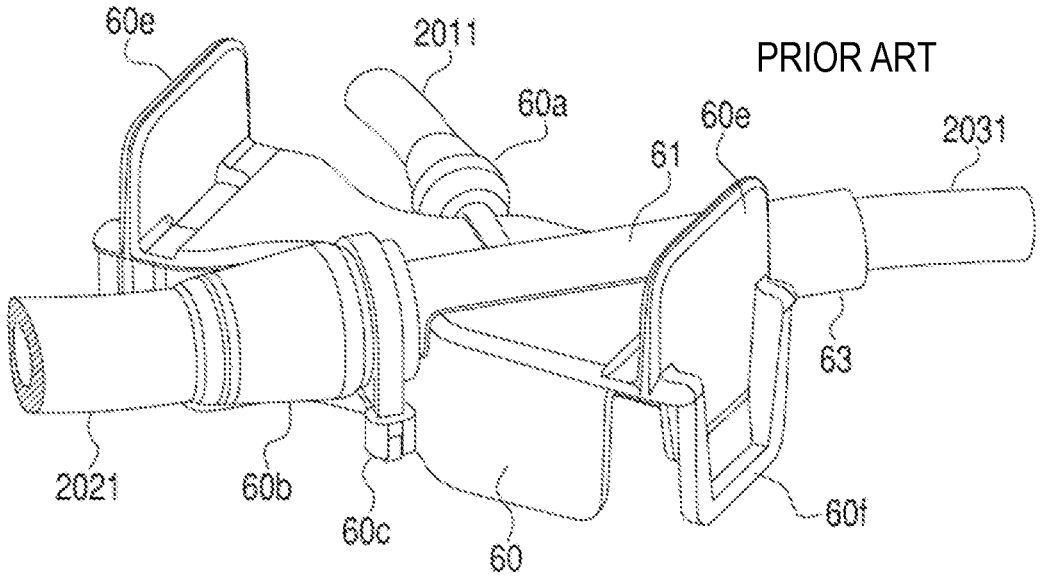
FIG. 10 is a top perspective view of an exemplary union junction.

FIG. 10 shows a perspective view of the union junction 60. The union junction 60 is configured to retain and/or receive a tubing structure that includes a micro input line inlet port 60*a*, a macro input line inlet port 60*b*, a union junction line 61 and an outlet port 63. The micro input line inlet port 60*a* is configured to receive the micro line 2011 which carries fluid from the micro channel, which can include fluid from one or both the micro fluid containers and macro fluid containers that were described earlier. The macro input line inlet port 60*b* is configured to receive the macro line 2021 that carries fluid from the macro fluid containers that were described earlier. The micro input line inlet port 60*a* and the macro input line inlet port 60*b* are both coupled to a junction line 61. Thus, fluid flowing from the micro line 2011 enters the micro input line inlet port 60*a* and flows through the junction line 61 and is combined with fluid received by the junction line 61 from the macro line 2021 via the macro line inlet port 60*b*. In this manner, fluid from micro line 2011 is combined with fluid from the macro line 2021 for delivery to the receiving/final container (e.g., IV bag 80). FIG. 10 also shows macro input line tie down 60*c* that maintains the macro input line inlet port 60*b* in place. A similar tie down 60*c* can be used to secure or maintain the micro input line inlet port 60*a* in place. The junction line 61 includes an outlet port 63 coupled to an output line 2031. As fluids from the micro line 2011 and the macro line 2021 combine in the junction line 61, they flow through the outlet port 63 to the output line 2031. The fluid flows from the output line 2031 to the final container or receiving bag filling station, which is described in greater detail below. FIG. 10 also shows that the union junction 60 includes handles 60*e* that can be used for the placement and removal of the union junction 60 on to mating receptacles on the housing 10. Locks, such as flexible spring locks 60*f*, can mate with receptacles on the housing 10 to further secure the junction 60 thereto.

Figure 11:
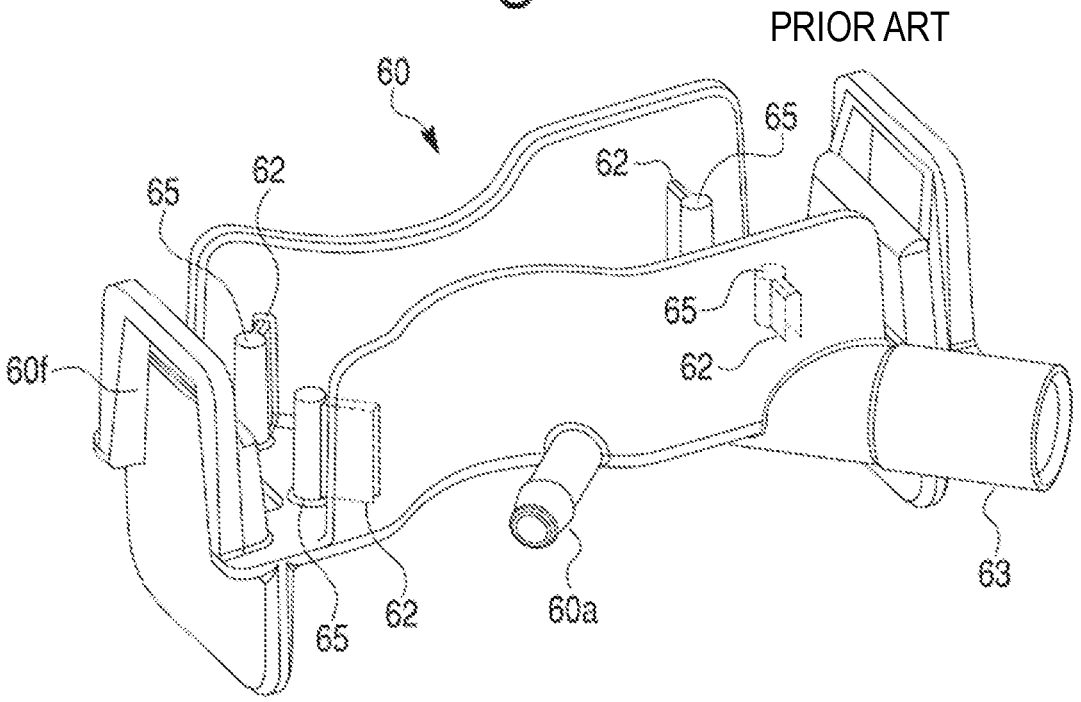
FIG. 11 is a bottom perspective view of the exemplary union junction of FIG. 10.

FIG. 11 shows a bottom side perspective view of the union junction 60. FIG. 11 shows that the union junction 60 includes a plurality of standoff ribs 62 and pin bosses 65 which are spaced apart from each other along an interior surface of the union junction 60. The standoff ribs 62 and pin bosses 65 are configured to provide an insertion spacing stop to retain the junction 60 at a predetermined distance/height relative to the housing surface. The standoff ribs 62 and pin bosses 65 can also provide structural integrity for the tubing structures described above, including the micro input line inlet port 60*a*, the macro input line inlet port 60*b*, the junction line 61 and the outlet port 63 so that those structures are maintained in place even as fluids are passed therethrough.

Figure 12:
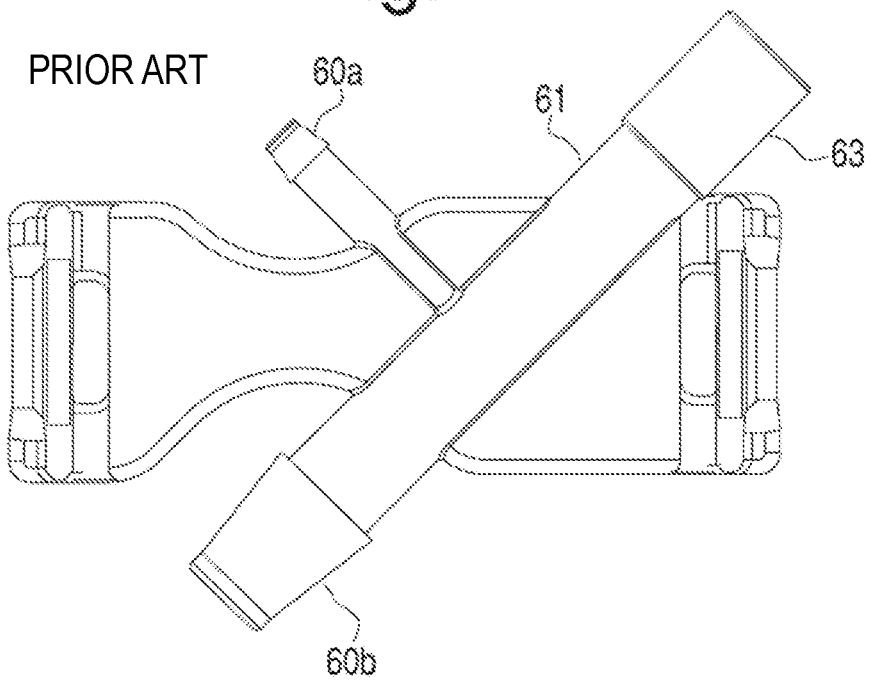
FIG. 12 is a top view of the exemplary union junction of FIG. 10.

FIG. 12 shows a top view of the union junction 60 with the tubing structures described above in place. As can be seen in FIG. 12, the union junction line 61 receives fluid via the micro input line inlet port 60*a* and the macro input line inlet port 60*b*. The fluids mix in the union junction line 61 and are carried to the outlet port 63 for eventual delivery to the receiving bag 80. As shown in the FIG. 12 and in this exemplary embodiment, the micro input line inlet port 60*a* joins the union junction line 61 in a direction perpendicular to a longitudinal direction of the union junction line 61, while the macro input line inlet port 60*b* causes fluid to flow into the union junction line 61 in the same direction as the longitudinal axis of the union junction line 61. In alternative embodiments, the micro input line inlet port 60*a* can join the union junction line 61 at any angle relative to the longitudinal direction of the union junction line 61 so as to optimize usability of loading on to the platform 10*d* and notch 18 and simultaneously ensure proper contact with pump rotors 41, 42 and optimize flushability of the union junction 61.

The tubing structure described above, including the micro line inlet port 60*a*, the macro line inlet port 60*b*, the union junction line 61 and the outlet port 63 can be formed, e.g., molded, into the union junction 60 so as to form a unitary structure. Alternately, the tubing structure can be formed as a separate unit that can be placed or snapped into the union junction 60 and retained in place using a mechanism such as the standoff ribs 62 and pin bosses 65 described above. In addition, it should be understood that the compounding system 1 can be configured without the presence of a union junction 60 as shown. Instead, the union structure can be the final container, such as the receiving bag 80 itself. For example, lines 2011 and 2021 can extend about rotors 41, 42 and continue all the way to two separate ports in the receiving bag 80 such that mixing of materials from lines 2011 and 2021 occurs only at the receiving bag 80. In this case, it may be beneficial, depending on the particular operating parameters, to secure lines 2011 and 2021 at locations downstream of the rotors 41, 42 to ensure proper and efficient operation of the pump 40.

Figure 13:
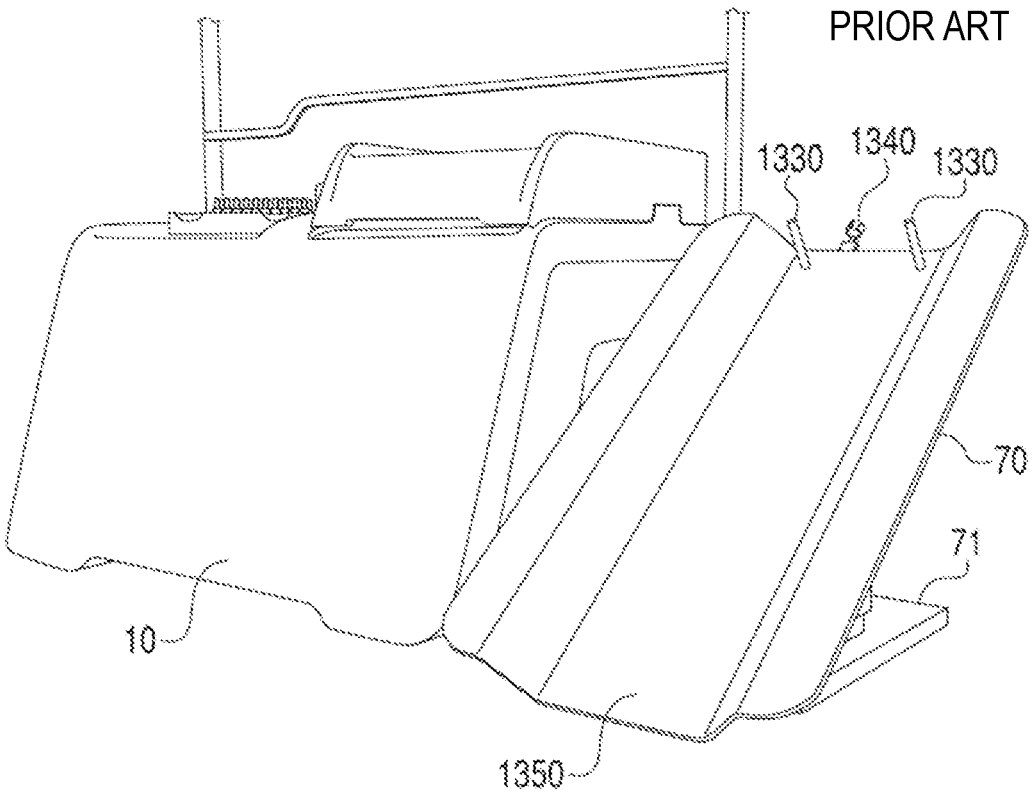
FIG. 13 is a partial perspective view of a compounding system made in accordance with principles of the presently disclosed subject matter.

FIG. 13 shows perspective view of the compounding system 1 in accordance with an exemplary embodiment. FIG. 13 shows housing 10 located adjacent a bag tray 70 for holding a receiving bag 80 during the filling process. A load cell 71 or other device, such as an analytical balance, can be integrated into the bag tray 70 to provide information relative to the weight and contents and to facilitate calibration as well as confirmation of operational functions for the compounding system 1. Protective devices and/or software can be incorporated into the device to protect the load cell 71 or other measuring device from damage due to accidental overload or other mishaps. As shown in FIG. 13, the bag tray 70 includes a bag tray receiving section 1350 that accommodates the shape of the receiving bag 80. The bag receiving section 1350 can be formed as a generally indented surface within the surface of the bag tray 70. The bag tray 70 also includes bag tray pins 1330 which are formed on an upper section of the bag tray 70. As shown in FIG. 13, the bag tray pins 1330 are formed perpendicular to the surface of the bag tray 70 so as to project in a direction away from the top surface of the bag tray 70. The bag tray pins 1330 are positioned to receive and hold a receiving bag 80 for filling. FIG. 13 also shows a bag tray clip 1340 that is formed along an upper section of the bag tray 70. The bag tray clip 1340 can be configured to keep a known tubing artifact constant with respect to the output fluid line(s) 2031 connected to the receiving bag 80 (i.e., can be configured to dampen vibration or other force transmission to the bag 80 and/or load cell 71). Depending on how the bag 80 is connected to the outlet of the transfer set, and how the tube is positioned, variances can occur. The clip 1340 prevents these variances.

Figure 14A:
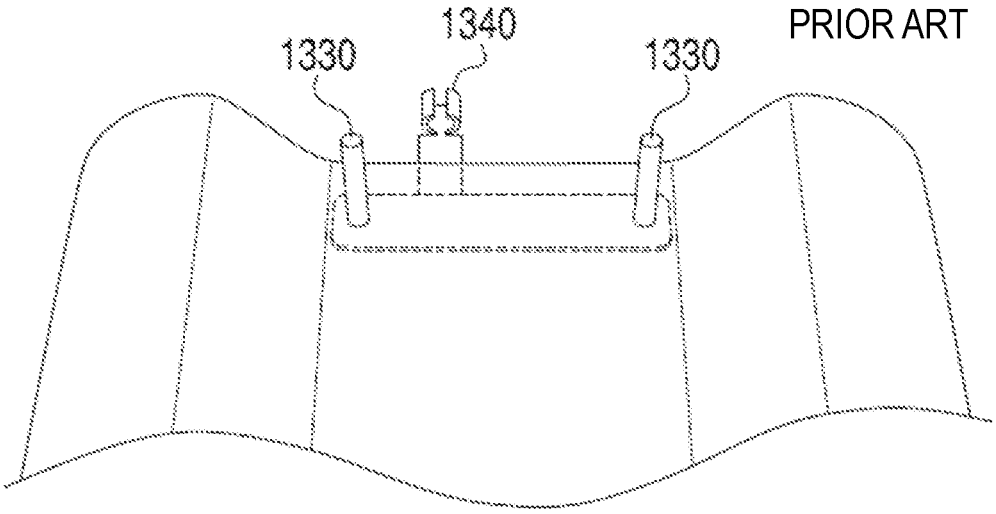
FIGS. 14A and 14B are partial perspective views of the bag tray and receiving bag.
Figure 14B:
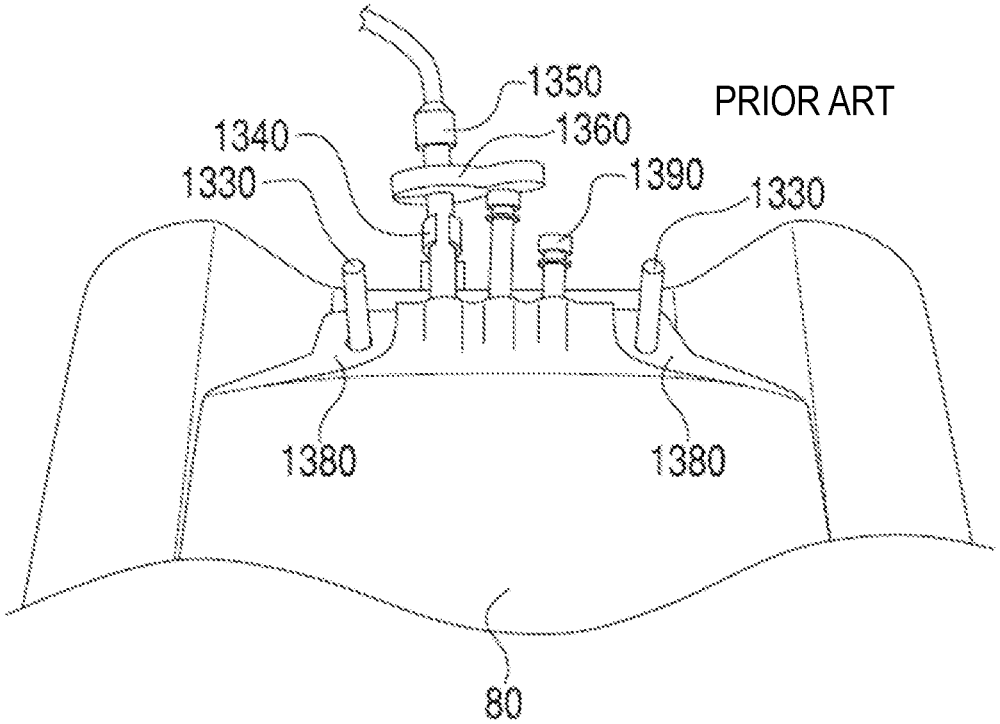

FIG. 14*a* shows a close up view the upper section of the bag tray 70 illustrating the placement of the bag tray pins 1330 that are positioned to receive and retain a receiving bag 80 for filling. FIG. 14*a* also shows the bag tray clip 1340 that is provided to secure the container input tubing, which includes the output line 2031. FIG. 14*b* shows a close up view of the upper section of the bag tray 70 including a receiving bag 80 placed in the bag tray 70. The exemplary receiving bag 80 includes two openings 1380 for receiving the bag tray pins 1330. Thus, when the bag tray pins 1330 are placed through respective openings 1380 of the receiving bag 80, the receiving bag 80 is maintained in place for filling. FIG. 14*b* also shows a twist lock 1350 formed on the end of the output line 2031. The twist lock 1350 is configured to connect to and lock with a port 1360 formed on a top surface of the receiving bag 80. The twist lock 1350 allows the output line 2031 to be securely coupled to the receiving bag 80 so that the receiving bag 80 can be filled. The bag tray clip 1340 can be configured to securely retain the port 1360 and twist lock 1350 that allows for quick placement, filling and removal of the receiving bag 80. The clip 1340 also secures the tubing to the bag tray to prevent unwanted artifacts in the load cell 71 measurement that could occur from excessive motion of the tubing segment that spans the gap between the bag tray and the pump module. This tubing motion could be caused by user interaction or pump vibration during compounding. Manual port 1390 can be provided at the top of the receiving bag 80 such that a user can inject an ingredient that is either not included in the compounding system 1 or has run out and is required to complete the receiving bag 80.

In similar fashion to the description above, a dual chamber bag may be filled using a slightly modified workflow, wherein the dual chamber bag keeps incompatible ingredients separate by two physical separated chambers that are kept separate from each other during compounding, but are combined just before infusion of the patient is started. All of the steps described above are followed for the 'primary' side of the receiving bag. Once complete on the primary side, the primary side port 1360*a* is disconnected from the twist lock 1350. The secondary bag port 1360*b* can then be connected to the twist lock 1350 and the secondary chamber thus filled.

Figure 15:
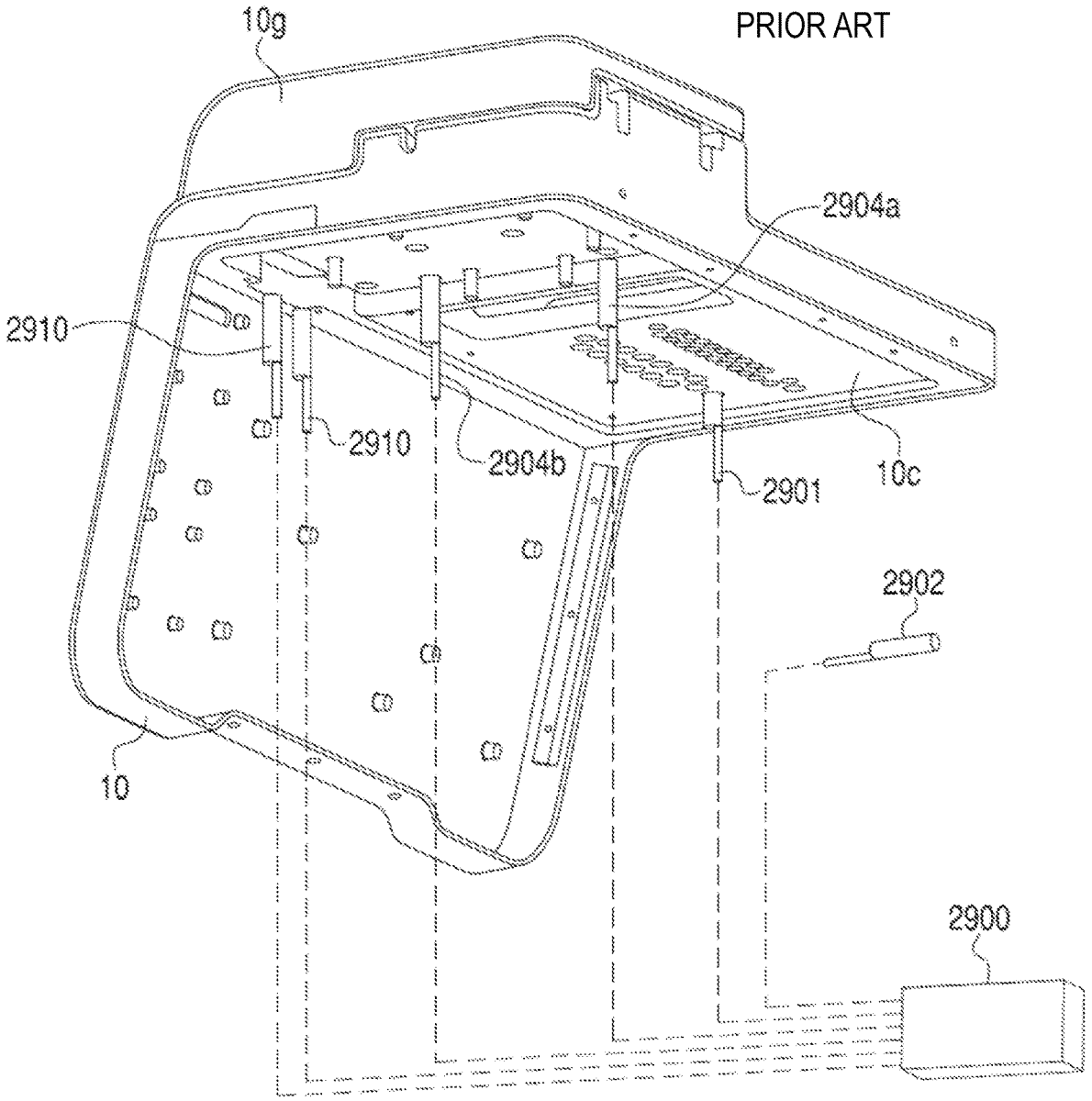
FIG. 15 is a right rear corner perspective view of a front/top panel and sensor array for the compounding system of FIG. 1.

FIG. 15 is a rear partial perspective view of the compounding system 1 that shows an exemplary sensor array used in conjunction with the system. Sensors 2910 can be configured to sense when the covers 10*f* and/or 10*g* are in place (See FIG. 3A). Alternatively, a reed switch sensor can be built into the combination sensor assembly to provide confirmation that 10*f* is closed. Sensors 2910 can be magnetic, such that they serve two purposes: 1) communication to a controller 2900 information indicating that the covers 10*f* and/or 10*g* are in a closed/operational position; and 2) securing, via magnetic force, the covers 10*f* and/or 10*g* in place in the closed/operational position. It should be understood that the sensors themselves may not provide enough force to provide a hold down function. Instead, a ferrous catch plate and lid magnet can be used in conjunction with the magnetic sensor. Sensors 2904*a* and 2904*b* can be configured to communicate to the controller 2900 that the platen locks 44*a* and 44*b*, respectively, are in a closed/operational position. Sensor 2901 can be provided in housing 10 and configured to communicate with the controller 2900 information that indicates that the manifold 20 has been properly affixed to the housing 10 and is ready for operation.

Sensor 2902 can be located adjacent a rear surface of the housing 10 and configured to communicate with the controller 2900 information that places the compounding system 1 in a service or firmware/programming mode when a maintenance operator or technician activates this sensor (for example, by placing a magnet adjacent the sensor 2902). The location of the sensor 2902 may be known only to service and technical maintenance personnel.

Figure 37:
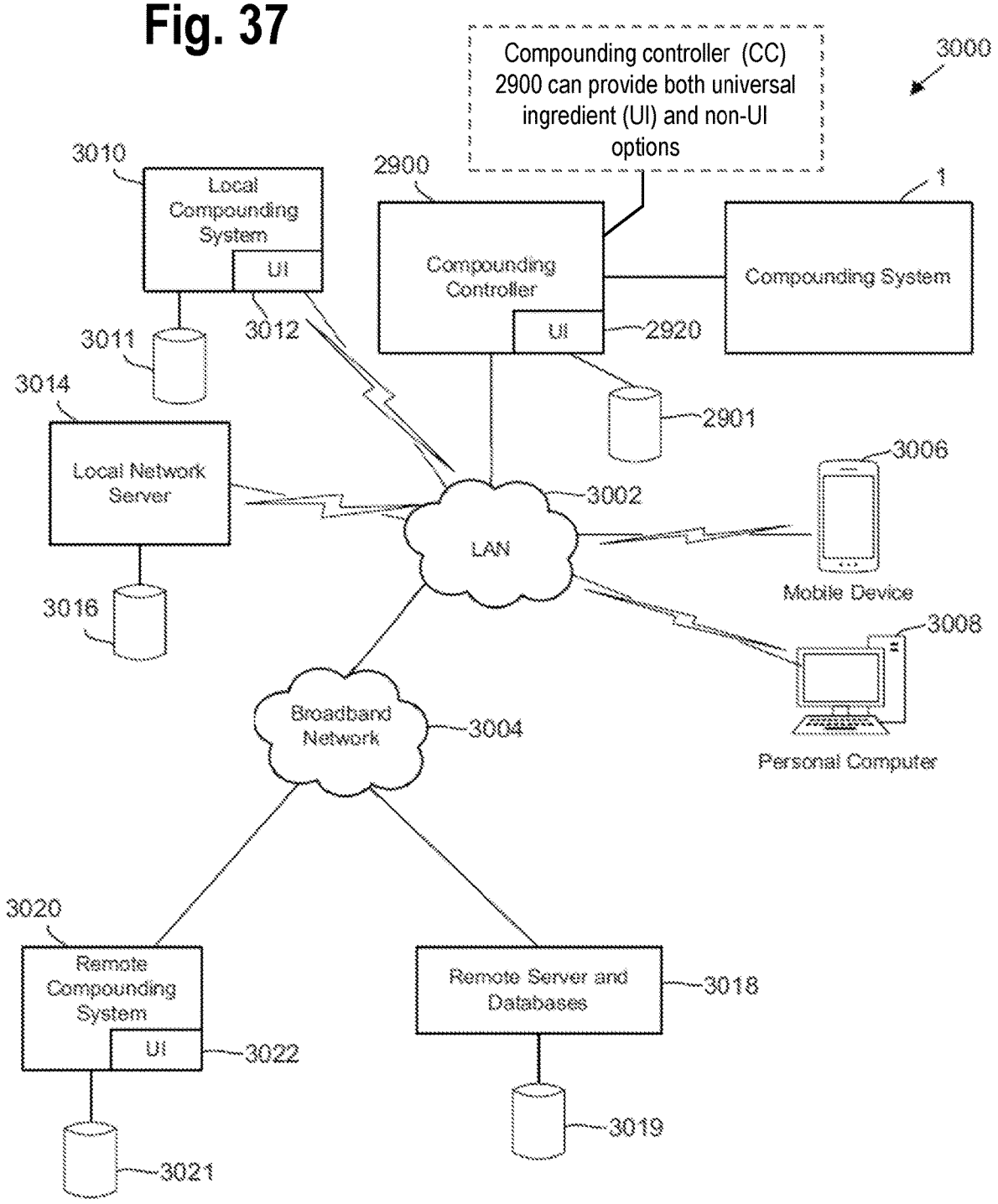
FIG. 37 is a diagram of an exemplary network environment of an exemplary compounding device controller in accordance with the principles of the disclosed subject matter.

As shown in FIG. 37, the exemplary compounding system 1 can also include or be associated with a compounding control manager that resides in a central processing unit (e.g., controller 2900). The compounding control manager allows a clinician or other healthcare or compounding professional to enter, view, adjust and offload information pertaining to a given compounding protocol. In general, the compounding control manager can include program language that provides the operator with real time feedback and interaction with the compounding device through graphical user interface (GUI) elements. The GUI elements, created in a graphical format, display the various inputs and outputs generated by the compounding control manager and allow the user to input and adjust the information used by the compounding control manager to operate the compounding device. To develop the GUI elements, the compounding control manager can utilize certain third party, off-the-shelf components and tools for certain aspects of the system. Once developed, the compounding control manager can reside as a specialized software program on a memory device. The software program can provide the various functionality as described herein.

The controller 2900 can include firmware that provides adjustment algorithms or hardware solutions to control the accuracy of the pump 40. For example, the pump output can be corrected for degradation of the pump tubing lines 2011, 2021 over the life of the transfer set or manifold 20. This adjustment is applied as a function of the number of pump rotations experienced by each tubing line. The controller 2900 can also include software or hardware such that pump output or "flow factor" can also be adjusted for the specific fluid being pumped. This "flow factor" can account for fluid viscosity, pump speed, line type, and source container/spike type. The controller 2900 can also be configured to correct pump output for the rotational location of the pump rotor 41, 42 rollers relative to the platens 43*a*, 43*b*. This adjustment can be significant for small volumes that are dispensed and which represent only a few rotations of the pump head or less. Absolute encoders can be included on both pump motors 41*s*, 42*s* (and valve steppers) to provide the firmware (e.g., controller 2900) with the information necessary to make the above-noted adjustment(s). The controller 2900 can include a bubble detection algorithm that attempts to minimize nuisance alarms. The system may include two bubble detectors for each channel so that the two measurements can be compared to determine whether there is a sensor failure.

Figure 17:
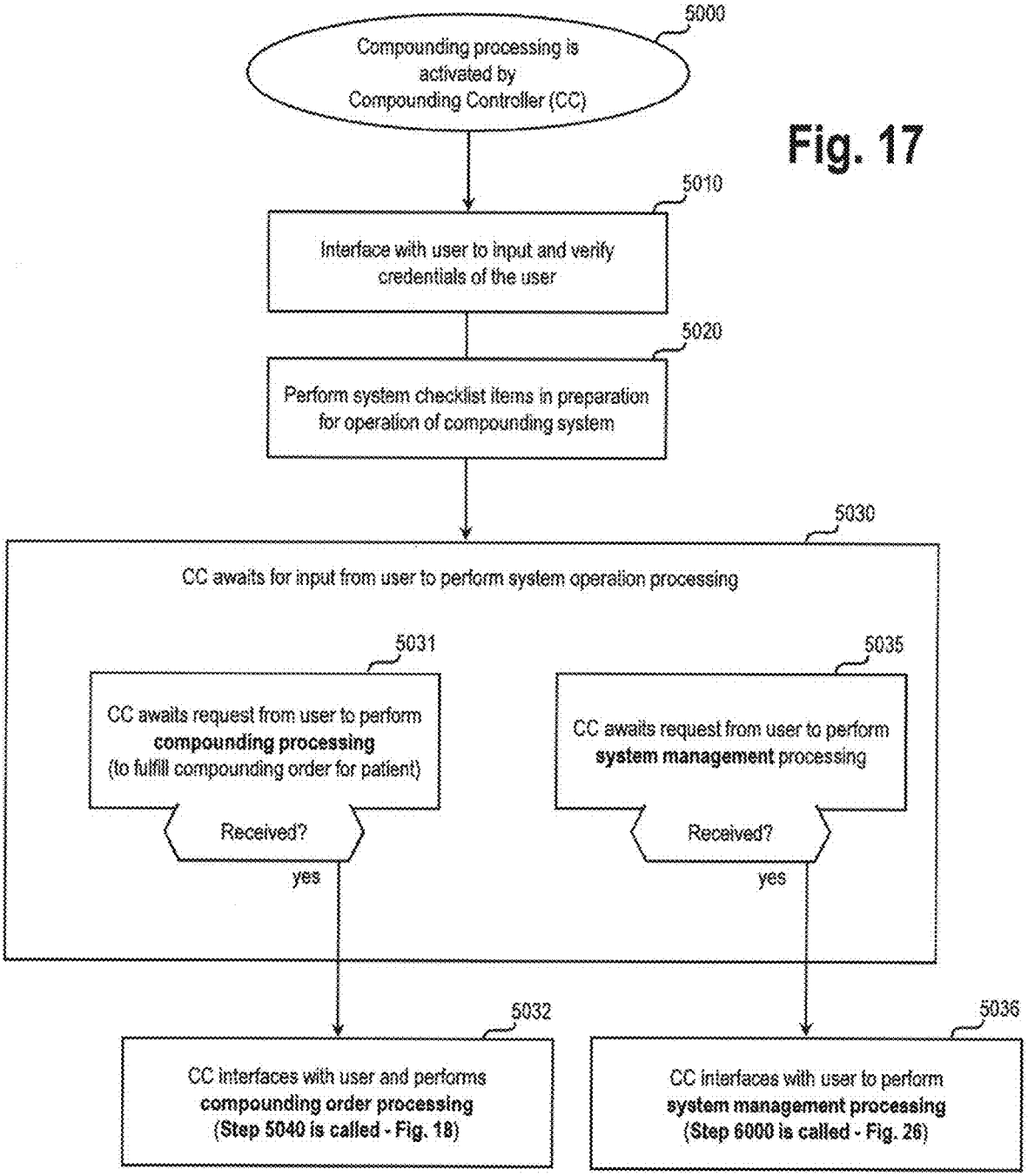
FIG. 17 is a flow chart illustrating logic of a process that may be used in operation of the system of FIG. 1, in accordance with the principles of the disclosed subject matter.

Display screens can be generated by the compounding control manager, which demonstrate various features of the compounding control manager. FIG. 17 is a flow chart of a process that may be used in operation of the system of FIG. 1 in accordance with the principles of the disclosed subject matter. The process can initiate with the operator or user activating the compounding controller (CC), which can also be referred to as a compounding manager, (step 5000 in FIG. 17). After an initial start-up mode of software initialization, a main work area can be created on a display device, which can initially open a log-in screen. The operator can first identify him or herself, either by using a bar code scanner to scan an operator badge number and/or barcode, or by entry of a badge number or other selected form of identification on the graphical touch screen entry pad (step 5010 in FIG. 17). Thus, in step 5010, the operator has input or scanned his or her user credentials into the compounding manager. This identification procedure is required for logging-in and/or assessing the operator's level of security clearance. Desirably, a system administrator would have previously established a list of authorized users, against which the sign-in data is compared. At this point, the operator can be presented with a checklist of items to be performed before proceeding (step 5020 of FIG. 17). These checklist items can be user programmable and may include, for example, a prompt to confirm that the compounding device has been cleaned. The checklist items can include a process so that the load cell is calibrated. The controller 2900 can be configured to require a username/password or bar coded badges to sign in/out. In addition, access can be further controlled to require username/password or bar coded badges for confirmation of required steps (e.g., addition of an ingredient that requires a prescription or that is in another way regulated).

The controller 2900 can also be configured to display a real time status of a compounding event. For example, the controller 2900 can display which solution(s) are currently being pumped from which station as well as how much solution is left in each source container 4*a, b*.

Templates can also be stored in the controller 2900 to quickly and efficiently determine the set-up and sequence of ingredients for a particular application or a particular patient or user. A database located in or accessible by the controller 2900 can include data related to storage, additions, removals of all drugs allowed for compounding and their associated data. The controller 2900 can be configured to include multiple interfaces for the user and can be networked such that a plurality of compounding devices can be controlled and/or monitored by a separate entity or controller. In addition, a print wizard can be incorporated into the controller 2900 software and/or hardware that automatically prints certain items when certain actions take place using the compounding device.

While certain embodiments of the invention are described above, it should be understood that the invention can be embodied and configured in many different ways, with many different features, without departing from the spirit and scope of the invention.

In an embodiment, an occlusion sensor and bubble sensor can be positioned under the manifold common volume. Although locating the sensor area in the common volume in the manifold may make the flushing act slightly more difficult, the location of the bubble sensor in the common volume can allow a user to better discriminate which source line generated the bubble. For example, an array of bubble sensors could be located along the length of a common volume in the manifold to accomplish this feature.

In yet another embodiment, a cross connect channel can be located between the downstream end of the micro and macro common volumes (e.g., the first channel 24*a* and second channel 24*b*). A valve could be provided to close this channel, allowing dispensing to occur as usual, and then the valve could be opened to allow the micro common volume to be flushed by the macro pump, which operates at higher flowrates and provide more efficient flushing.

As described above, the platen/lock arm design can have springs in the lock arms that press the platens against the rotors 41, 42 when the lock arms 44*a, b* are closed. An alternate approach would locate torsional springs at the platen hinge points (potentially inside the instrument) such that the platens are always spring loaded against the rotors. The platen lock arms 44*a, b* could be replaced by "platen disengagement arms" configured to pull the platens 43*a, b* away from the rotors 41, 42 during transfer set installation and removal.

The pump output can be a function of upstream suction pressure. To provide better volumetric accuracy, the occlusion sensor could be used to compensate for variations in upstream suction pressure and prevent alarms due to partial occlusions. In this approach, the number of commanded pump rotations and rotor speed could be adjusted based on the measured suction pressure during pumping.

In yet another embodiment, LEDs or other types of lights or light sources can be located in the top surface of the pump under each ingredient source line. The molded manifold would guide light into the source tubing line, possibly all the way up to the spike where a visual indication could be provided if a source container or line needs attention. The light or light source would be connected to the electronic control unit for the compounding device, which would dictate when and how to provide light to a particular location, depending on error codes, programming desires, reminder notices, etc.

While it has been disclosed that a plurality of different sizes and shapes of tubing/lines and containers can be connected to the compounding device, in yet another alternative configuration of the disclosed subject matter, the compounding device can be configured for use with only a single type of container and tubing, such as only macro lines and macro containers, or only micro lines and micro containers. In this manner, the compounding device can be an effective replacement for current compounding systems and applications that include only single types of containers and lines.

The number of channels can also vary and remain within the scope of the presently disclosed subject matter. For example, three, four or more different sized channels could be incorporated into the manifold. Similarly, more than one same shaped and sized channel could be included in the manifold 20.

The disclosed embodiments can provide system and methods for controlling various operational characteristics of the compounding device. For example, the disclosed embodiments provide a system and methods for determining when the transfer tubes should be replaced due to excessive wear. The term "transfer tubes" refers to any of the lines used to transfer fluid, such as the input lines 2011, 2021 and the output line 2031. The transfer tubes are also referred to as "transfer lines," "fluid transfer lines" or "fluid lines." In one embodiment, an alert is issued so that an operator is notified that one or more transfer sets should be replaced. The determination of tube wear can be made based upon a variety of factors, including changes in the volume of fluid being transferred over time and/or changes in the weight of the filled IV bag as compared to a baseline IV bag weight. Furthermore, the pumping segments are characterized via testing and the data is utilized to determine tube wear profiles, which are used in the formula to determine a number of rotor turns per fluid volume during the life of the tube set.

In another embodiment, a system and methods are provided for controlling the transfer of fluid so that incompatible fluids are not transferred simultaneously. Thus, incompatible fluids are prevented from being combined at the union junction. The term "incompatible fluids" refers to two or more fluids that react in an adverse or otherwise undesirable manner when they are combined with one another.

The disclosed embodiments also include a system and methods for determining whether a fluid should be transferred through a macro or micro transfer tube. This determination results in control instructions for activating macro line and micro line pump motors that cause fluid to flow through the appropriate fluid transfer lines.

FIG. 37 is a diagram of an exemplary network environment of the exemplary compounding controller (CC) 2900 for the compounding system 1 in accordance with embodiments of the disclosed subject matter. The environment 3000 could be any network that can access a broadband network 3004 (i.e., the Internet), and a local area network (LAN) 3002 (i.e., a hospital network), which is a managed network, such as an Internet Protocol, Asynchronous Transfer Mode (ATM), Ethernet, etc. The controller 2900 can operatively connect to a communication interface that can connect to the LAN 3002. The LAN 3002 can include an Internet gateway device that connects to the broadband network 3004 using any appropriate network access protocols. The controller 2900 may interconnect through the broadband network 3004 with a remote server 3018, having one or more databases 3019 of information relevant to the operation and methods of the controller 2900, or a remote compounding system 3020 having a user interface 3022 and one or more databases 3021 of information relevant to the operation and methods of the controller 2900. The controller 2900 may interconnect through the LAN 3002 on wired or wireless network links to one or more compounding system 3010 with user interface 3012 and one or more databases 3011 of information relevant to the operation and methods of the controller 2900. One or more mobile devices 3006 and one or more personal computers 3008 may connect to the controller 2900. The personal computer 3008 may have a keyboard, display, processor, and memory and can be a desktop or portable laptop computer. The mobile device 3006 can be any appropriate mobile computing device such as a tablet, smart pad, smart phone, or other hand-held device, etc. with a display, processor, memory, and user interface. The personal computer 3008 or mobile device 3006 may be configured to enter information, such as a script and input instructions to the controller 2900.

As shown in FIG. 37, the controller 2900 may also connect via the LAN 3002 with a local network server 3014 having a processor, memory, and a database 3016 with information relevant to the operation and methods of the controller 2900. In one embodiment, the compounding device 3010 and/or local network server 3014 may be located in different areas of a healthcare facility such as a hospital, or on different floors of a hospital or even different hospitals that are networked together over the LAN 3002. In some embodiments, compounding processes described herein may be performed simultaneously by multiple local or remote compounding systems with the compounding system 1. In other words, the controller 2900 can be configured to control other compounding systems 3010, 3020 over the network LAN 3002 or broadband network 3004. The controller 2900 can be interconnected with the personal computer 3008 through the LAN 3002 or through a direct wired connection. The personal computer 3008 can be a general hospital computer that can be used to access patient records and handle requests from medical facility staff or hospital software for compounding admixtures. In other embodiments, the compounding device 3010, local server 3014 and personal computer 3008 may all be located in the same area or room so that the local server 3014 and personal computer 3008 directly communicate with a single compounding device 3010.

The controller 2900 can have sufficient memory for storing pharmaceutical data in the form of a database, a processor for running operating software, and transmitting information to the user interface (UI) 2920 for use in displaying information to a user and receiving input from the user. In other embodiments, the controller 2900 may include a main controller and one or more additional controllers in a distributed network architecture. In such a configuration, the main controller may provide supervisory oversight and management of the compounding operations, and coordinate the performance of sub-operations by the other distributed controllers. The controller 2900 may include one or more processors that performs operations according to software that may be developed and compiled using one or more languages. The controller 2900, and in some embodiments one or more additional sub-controllers, may be in the form of embedded systems, having dedicated controllers, PLCs (programmable logic controllers), PC-based controllers with appropriate networking and I/O hardware and software, ASICs, or other implementation. For example, one controller can be dedicated to controlling stepper motors 102*a*, 102*b* for the micro valves 21*a* and macro valves 21*b* and stepper motors 41*s*, 42*s*, for the micro pump 41 and the macro pump 42. Motor actuation planning can involve the actuation of the micro valves 21*a* and macro valves 21*b* to optimize conveyance of fluids through the micro pump 41 and the macro pump 42. Data can be provided in firmware for the controller 2900 for purposes of handling various types and sizes of IV bags as final containers, as well as the expected locations and orientations for various inventory items throughout the stations on the system 1 including the ingredient frame 1, the transfer set 2, the sensor bridge 10, the pump 40, and the discharge tray 70. The controller 2900 can have access to the databases 2901, 3011, 3019, 3021 directly or through a network connection.

As described above, FIG. 17 is a flow chart of logical steps for an exemplary process for operating a compounding system 1 in accordance with the principles of the disclosed subject matter. As described above, the process can be activated at step 5000. The process then moves to step 5010 where the controller 2900 can receive input from the user input and associate a user's level of security clearance so as to verify credentials of the user. For example, in a medical center scenario, templates of various scripts may be available for admixture compounding.

After receiving login credentials of the user, the controller 2900 can perform system checklist items in preparation for operation of compounding system and receive setup information for the compounding process in step 5020.

Figure 16:
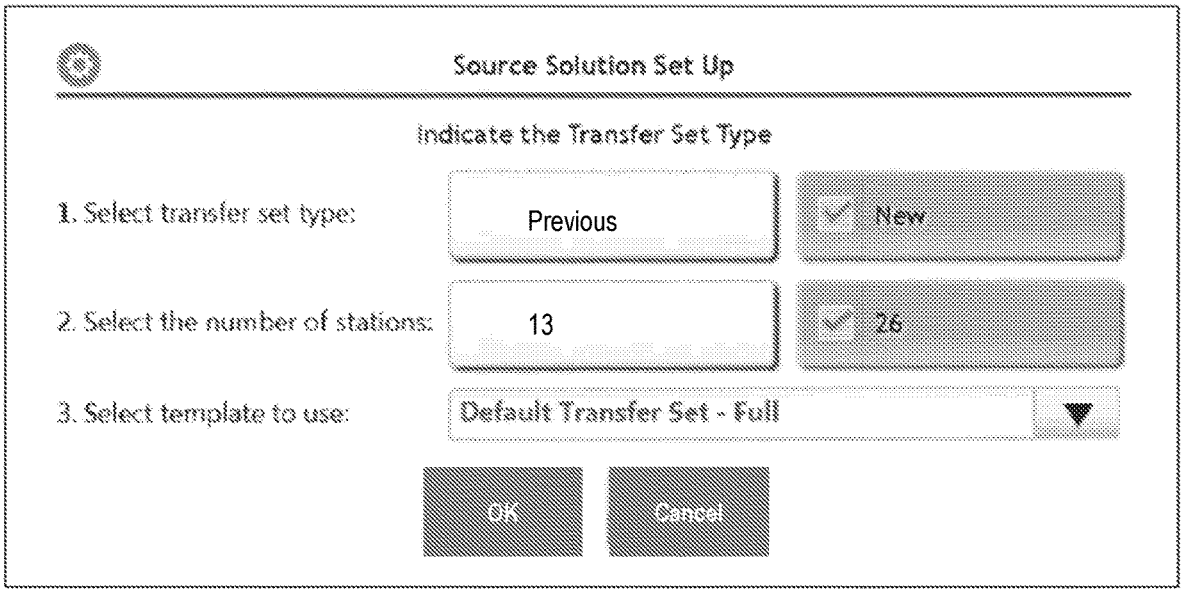
Fig. 16 PRIOR ART
FIG. 16 is a screen shot of an exemplary controller interface for use with a compounding device or system made in accordance with principles of the disclosed subject matter.

FIG. 16 shows an interface that may be presented to a user at some point after the user has logged in and been authenticated as an authorized user, but not necessarily the first thing the user sees after logging into the system. FIG. 16 is a screen shot of a control panel user interface that allows the user to indicate the type of transfer set to be used, the number of stations that will be used in the setup, and the particular template to use.

With further reference to FIG. 17, after step 5020, the process passes to step 5030. In step 5030, the controller 2900 awaits for input from the user to perform system operation processing. System operation processing can include a variety of operations. As reflected in FIG. 17, the system operation processing can include compounding processing and system management.

Figure 18:
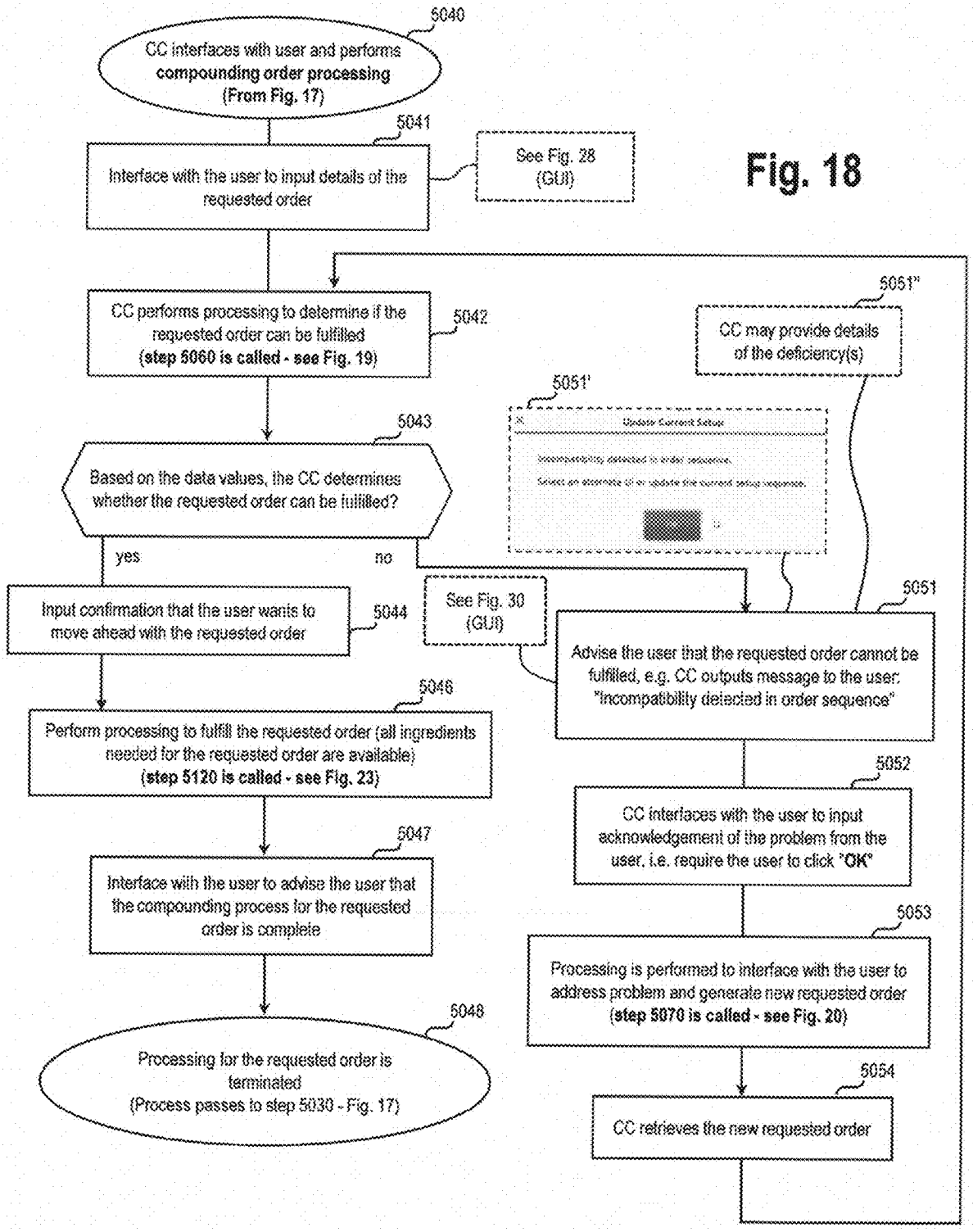
FIG. 18 is a flowchart showing details of the "controller 2900 interfaces with the user and performs compounding order processing" step 5040, as called upon in FIG. 17, in accordance with the principles of the disclosed subject matter.

More specifically, in step 5031, the controller 2900 awaits for a request from the user to perform compounding processing. The compounding processing can include the fulfillment of a compounding order for a patient. Upon receiving a request for compounding processing, the process passes from step 5031 on to step 5032. In step 5032, the controller interfaces with the user to perform compounding order processing. In particular, step 5040 is called or invoked and processing is performed as shown in FIG. 18.

Figure 26:
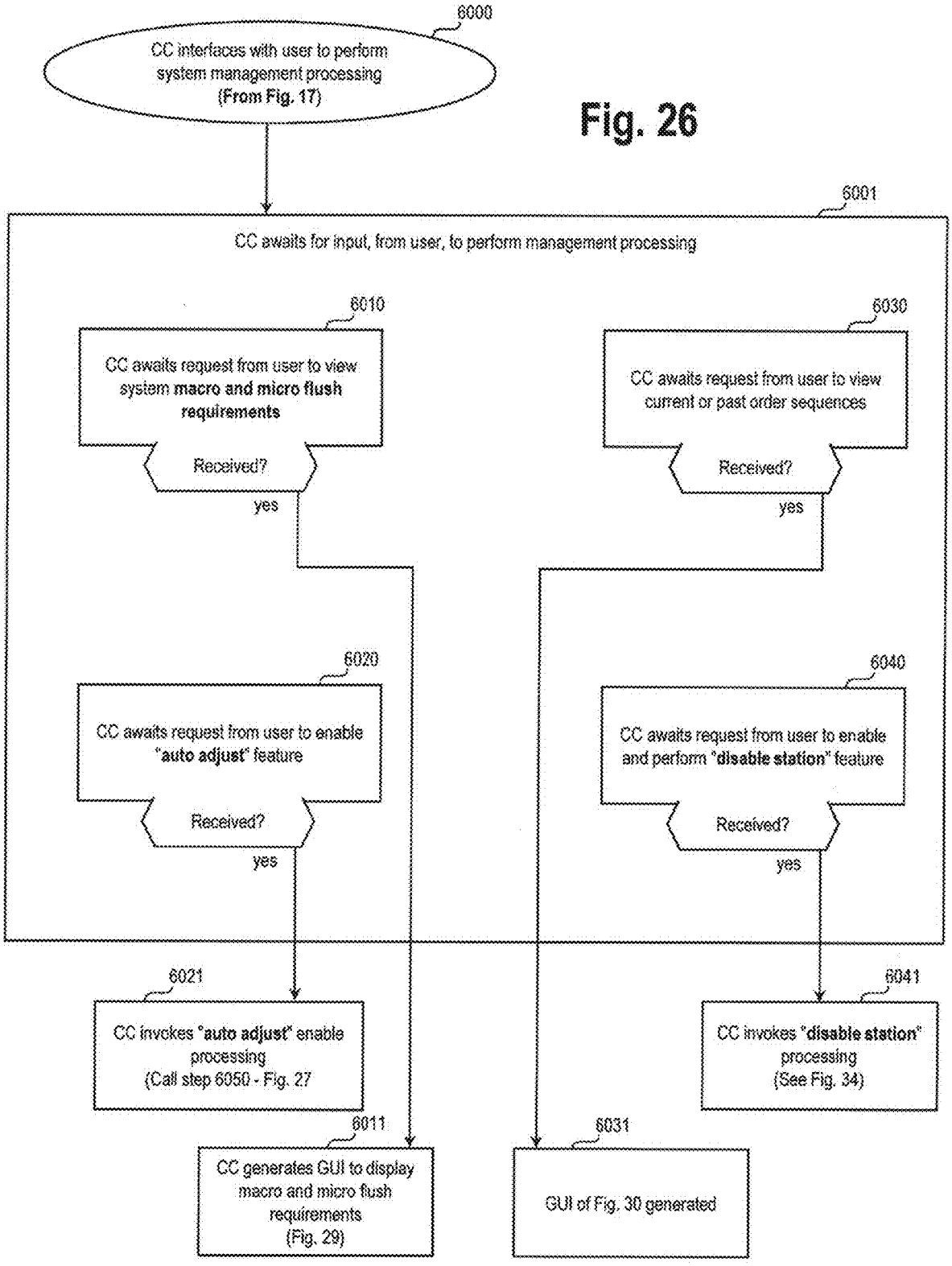
FIG. 26 is a flowchart showing further details of the "controller interfaces with user to perform system management processing" step 6000 as called upon from FIG. 17, in accordance with the principles of the disclosed subject matter.

Additionally, in the processing of step 5030, the controller can perform other system related processing. That is, in step 5035, the controller awaits a request from the user to perform system management processing. Such system management processing can include a variety of tasks related to operation and maintenance of the system. Such tasks can include adjustment of settings, viewing parameters of the system, and/or viewing operational history of the system, for example. Upon the controller 2900 receiving a request from the user to perform system management processing, the process passes from step 5035 on to step 5036. In step 5036, the controller interfaces with the user to perform system management processing. In particular, step 6000 is called or invoked and processing is performed as shown in FIG. 26.

The systems and methods of the disclosure can provide a variety of procedures. In particular, as described in detail below, the procedures can include (1) non-universal ingredient (non-UI) buffer processing, (2) auto adjust feature processing, and (3) disable station processing.

As described below, the controller 2900 can include a process for pumping of various liquids so as to prevent simultaneous drawing of incompatible liquids into a common flow path. Relatedly, a "universal ingredient" (UI) can be utilized by the controller 2900 and/or utilized by an operator in the processing performed by the system. A UI can be used for two primary functions. The two primary functions can include a "flush" function and a "buffer" function. A flush can be used at the end of a compounding process so as to clean the passageways of tubing and channels. Such UI, which can be characterized as a flush universal ingredient, sits in the passageways and when the next compounding order comes through, the sitting UI is pushed. The sitting UI can be pushed into the container of the next order. On the other hand, the sitting UI can be pushed into a waste bag for disposal. When used as a buffer, the UI passes through the passageways sequentially between two incompatible ingredients.

A further illustrative example is a situation where the pharmacist has both dextrose and lipids in an order. Some experts in the field believe that these two ingredients are incompatible. As a result, it may be advantageous to keep the two separate such that, for example, dextrose is not pumped to immediately follow lipids, or vice versa. Accordingly, such two ingredients could be separated in order to successfully run the order to the satisfaction of a particular user. Separation of such illustrative incompatible ingredients, as well as a wide variety of other incompatible ingredients, can be challenging when there is not a lot of ordered volume of the UI. In addition to being challenging for orders that have minimal ordered volume of the UI, separation of incompatible ingredients can be challenging where the UI must act as the end of order flush as well as the buffer between incompatibles. Also, separation of incompatible ingredients can be challenging when the compounding system uses a single pump, and is particularly challenging when the compounding system uses multiple pumps as is the case with the disclosed compounding system.

Additionally, a problem can arise when there is simply not enough universal ingredient available so as to separate the various incompatible ingredients. In such a situation, when the operator simply does not have enough universal ingredient to use as a flush and a buffer, the operator is put in the position of simply not being able to fulfill the order.

As described in detail below, the systems and methods of the disclosure address this problem, with known systems, by providing a non-universal ingredient as a buffer option, or what may also be characterized as a non-universal ingredient (non-UI) buffer option. Such might also be characterized as an "Alternate UI buffer" option (i.e. an AUI buffer option) in that an alternative is provided to the currently designated universal ingredient. More specifically, a principal of the disclosure allows an operator to select, in some situations, a non-universal ingredient as a buffer. Such capability can substantially enhance the utility of a compounding system—in particular where a number of incompatible ingredients are present in a particular order.

A further procedure that is provided by the systems and methods of the disclosure include "auto adjust feature" processing. The auto adjust feature provides a tool for improving accuracy of a delivered order into a container. The auto adjust feature, as described in detail below, accounts for variability of a compounding system. In particular, the auto adjust feature can account for variability in tubing of a transfer set used in a compounding system.

Compounding systems can be susceptible to under delivered bags, where not enough ingredient is delivered to the container. Compounding systems can also be susceptible to over delivered bags, where too much ingredient is delivered to a container. In such respective situations, the final bags can be outside of acceptable accuracy range, for example 3% under or 3% over. Such inaccuracies can relate to the pumps utilized in the compounding system and/or to the tubing utilized in the compounding system. A final bag that is outside of acceptable accuracy range may simply need to be "scrapped" or thrown out, which can be costly and time-consuming.

The "auto adjust feature" of the disclosure attempts to resolve the problem. The auto adjust feature can greatly reduce the number of bags that are scrapped due to either over delivery or under delivery. In accordance with an embodiment, the auto adjust feature addresses the problem by applying a correction factor to account for differences in the characteristics of the transfer set tubing used in the particular system, as well as to account for other idiosyncrasies present in a particular system. The use of this correction factor helps prevent pumping ingredients outside of the acceptable error threshold. The auto adjust feature can utilize a feedback loop that adjusts a pump calibration/scaling factor that is used in pumping the ingredients. In particular, the auto adjust feature can be used for fast dispensing macro side ingredients. However, it is appreciated that the auto adjust feature is not limited to such particular application.

A further procedure that is provided by the systems and methods of the disclosure include "disable station" processing. For example, this aspect of the disclosure relates to the situation where a user of a compounding system identifies or is alerted that a source line of a certain station has been compromised. For example, a source line of a particular station can be compromised if particulate matter is formed in the line and causes an obstruction. Additionally, a source line of a station can be compromised if there is an extensive kink in the line which results in repeated occlusions or other anomalies, for example.

The disable station processing is beneficial in allowing the user to completely (and possibly permanently) disable the affected station or port. The particular station can be disabled only for the life of the particular transfer set, in an embodiment of the disclosure. That is, once the transfer set is switched out for a new transfer set, the station can once again be enabled by the operator. The disable station processing is also beneficial in providing an option to hang, i.e. relocate, the source container that was connected to the affected line, on another line. The source container can then be continued to be used in further orders. In other words, the compromised station can in effect be delegated to another station that is working properly. In such situation, even if the user does assign an ordered volume to the disabled station, the ordered volume will be routed to the new station by the controller 2900.

The disable station processing essentially can create the ability to switch stations "on-the-fly" while still utilizing the particular container, vial, etc. by physically relocating the source container on the hanger so as to be connected to an unaffected line. Accordingly, in such a situation, that same container, vial, etc. could be physically moved to the particular source line associated with the new station number that the user has decided to replace the disabled station with.

Alternatively, if no new station is assigned, that container can be taken down and used for manual addition type fills. The disable station processing can be particularly advantageous when working with expensive ingredients, when the operator does not want to open a new container, and/or when a new container is simply not available.

Hereinafter, various details of such advantageous processing will be described with reference to the flowcharts and logical steps of FIGS. 17-27, as well as with reference to the related graphical user interfaces.

Figure 28:
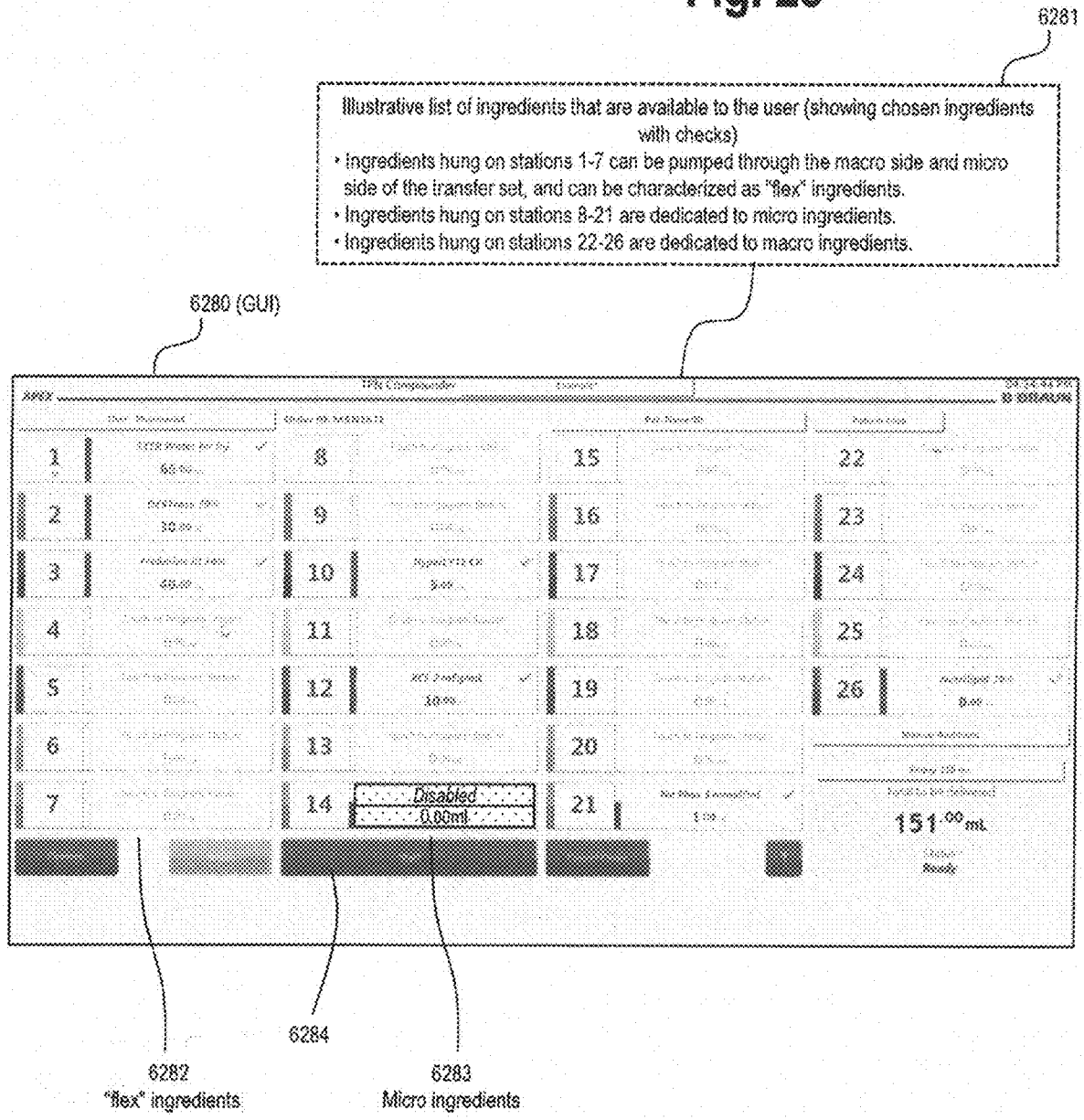
FIGS. 28-33 are various graphical user interfaces (GUIs) generated by the controller, in accordance with the principles of the disclosed subject matter.

As described above, FIG. 18 is a flowchart showing details of the "controller 2900 interfaces with the user and performs compounding order processing" step 5040, as called upon in FIG. 17. The process starts in step 5040 and passes to step 5041. In step 5041, the controller interfaces with the user to input details of the requested order. FIG. 28 is a GUI 6280 illustrative of such processing. The GUI 6280, as reflected at 6281, includes a list of ingredients that are available to the user. In the list, chosen ingredients can be reflected by a check. Additionally, the particular volume of a selected ingredient, to be delivered upon running the order, can be reflected in the GUI 6280. In the exemplary illustrative list of ingredients shown in the GUI of FIG. 28, the ingredients hung on stations 1-7 can be pumped through the macro side and micro side of the transfer set. Accordingly, these ingredients can be characterized as "flex" ingredients. The ingredients hung on stations 8-21 are dedicated to micro ingredients. The ingredients hung on stations 22-26 are dedicated to macro ingredients. This arrangement/allocation can be varied as may be desired. Additionally, the GUI can reflect the total amount of ingredients to be delivered upon completion of the order.

Figure 19:
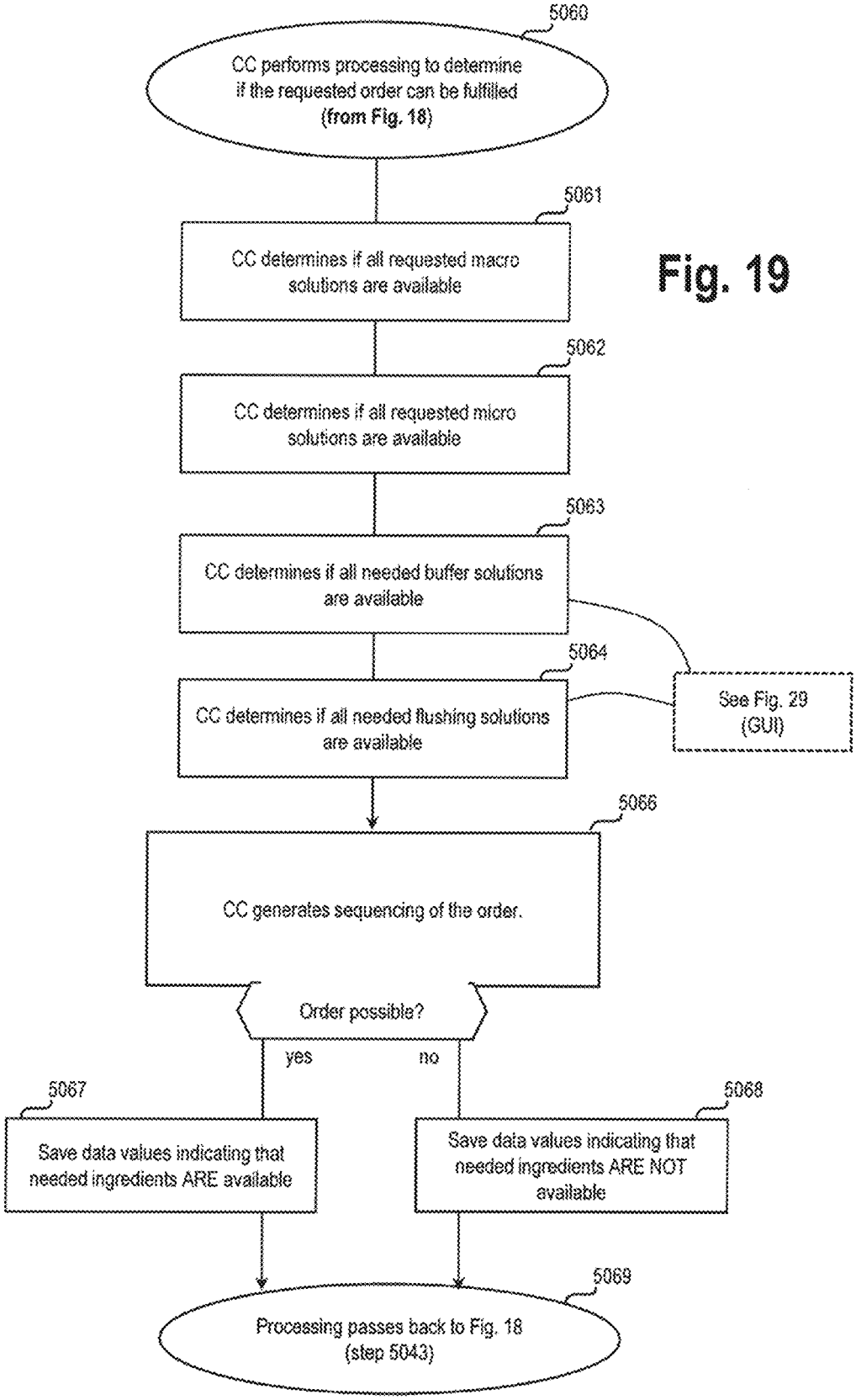
FIG. 19 is a flowchart showing details of the "controller 2900 performs processing to determine if the requested order can be fulfilled" step 5060, as called upon in FIG. 18, in accordance with the principles of the disclosed subject matter.

Upon the user entering the ingredients for the particular order, the user can then tap the "start" button 6284 shown in the GUI of FIG. 28. As result, processing can pass from step 5041 on to step 5042. In step 5042, the controller performs processing to determine if the requested order can be fulfilled. In particular, step 5060 is called or invoked and processing is performed as shown in FIG. 19, which is described below.

With further reference to FIG. 18, after step 5042, the process passes to step 5043. In step 5043, based on the data values returned from step 5060, the controller determines whether the requested order can be fulfilled. If yes, then the process passes to step 5044. In step 5044, the controller can display a suitable message to the user indicating that the requested order can be fulfilled. The controller can then request that the user input confirmation that the user wants to move ahead with the requested order.

After step 5044, the process passes to step 5046. In step 5046, the controller performs processing to fulfill the requested order. In particular, the controller calls or invokes step 5120 of FIG. 23. Further details are described below with reference to FIG. 23.

Then, in step 5047 of FIG. 18, the controller interfaces with the user to advise the user that the compounding process for the requested order is complete. Then, in step 5048, processing for the requested order is terminated because the order is complete.

On the other hand, the controller may determine in the processing of step 5043 that a requested order cannot be fulfilled. As a result, the process passes from step 5043 on to step 5051. In step 5051, the controller 2900 advises the user that the requested order cannot be fulfilled. For example, the controller can output a message to the user "incompatibility detected in order sequence". The message can be in the form of a pop-up box as shown at 5051'. In conjunction with such processing, the controller can generate and display to the user a GUI 6300 as illustratively shown in FIG. 30. The GUI 6300 can provide a sequence screen as reflected at 6301. The sequence screen can include a listing of micro ingredients. The sequence screen can also include a listing of macro ingredients.

With further reference to FIG. 18, as shown at 5051", step 5051 can also include the controller generating and providing information to the user regarding details of the deficiency. Such details can be in addition to the GUI 6300 of FIG. 30.

After step 5051 of FIG. 18, the process passes on to step 5052. In step 5052, the controller interfaces with the user to input acknowledgement of the problem from the user. For example, the controller may simply prompt the user to enter "okay". Then, the process passes on to step 5053.

Figure 20:
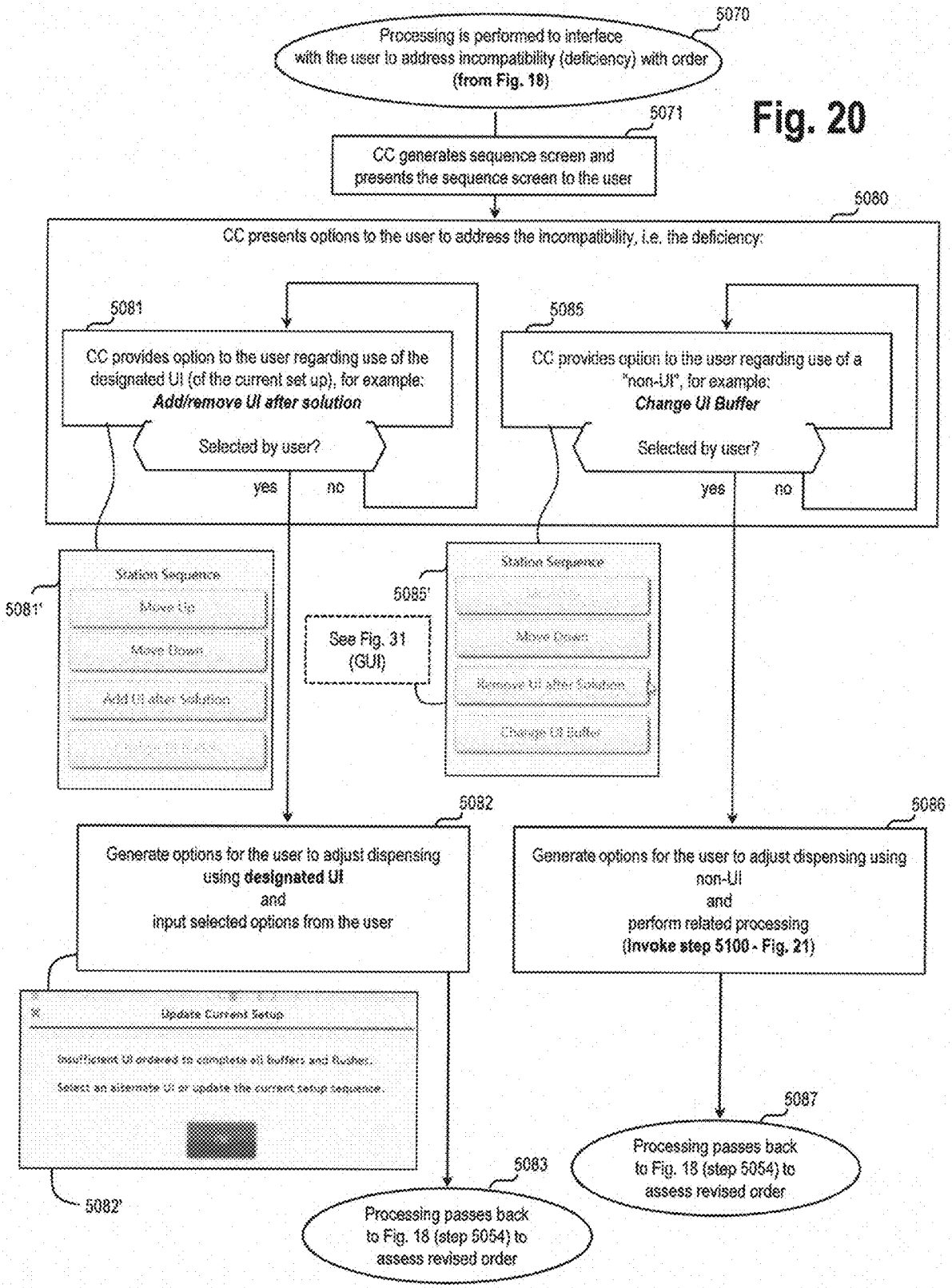
FIG. 20 is a flowchart showing details of the "processing is performed to interface with the user to address incompatibility with the order" step 5070, as called upon in FIG. 18, in accordance with the principles of the disclosed subject matter.

In step 5053, processing is performed in which the controller interfaces with the user to address the problem including the generation of a new/revised requested order. In particular, step 5070 is called or invoked and processing is performed as shown in FIG. 20.

After step 5053, in which the new order is generated, the process passes on to step 5054. In step 5054, the controller retrieves the new requested order, from the processing of step 5070. Then, the process passes back to step 5042 of FIG. 18. As described above, in step 5042, the controller performs processing to determine if the particular order, i.e. a new requested order, can be fulfilled. Processing then continues as described above.

As described above, FIG. 19 is a flowchart showing details of the "controller 2900 performs processing to determine if the requested order can be fulfilled" step 5040, as called upon in FIG. 18. The process starts in step 5060 and passes to step 5061. In step 5061, the controller determines if all requested macro solutions are available. Then, in step 5062, the controller determines if all requested micro solutions are available. Then, in step 5063, the controller determines if all needed buffer solutions are available. Then, in step 5064, the controller determines if all needed flushing solutions are available. Then, the process passes to step 5066.

In step 5066, the controller generates the sequencing of the requested order. It is appreciated that any of the processing and/or functionality as otherwise described herein can be used in a determination of whether a requested order can indeed be fulfilled in the sequencing of such order. Accordingly, in step 5066, the controller determines if the order is possible. In other words, the controller determines if there are or are not compatibility issues that prevent running of a requested order. If the order is possible, then the processing passes to step 5067. In step 5067, the controller saves data values indicating that the needed ingredients are available. On the other hand, if no in step 5066, the process passes to step 5068. In step 5068, the controller saves data values indicating that the needed ingredients are not available. After both step 5067 and step 5068, the processing passes on to step 5069. In step 5069, the processing passes back to FIG. 18 (step 5043).

As described above, FIG. 20 is a flowchart showing details of the "processing is performed to interface with the user to address incompatibility with the order" step 5070, as called upon in FIG. 18. Accordingly, in the processing of FIG. 20, the user can interface with the controller so as to work with the requested order and address incompatibility issues with the order. The process starts in step 5070 and passes on to step 5071. In step 5071, the controller generates a sequence screen and presents the sequence screen to the user. For example, the sequence screen can be as shown in the GUI 6300 of FIG. 30. Then, the process passes to step 5080.

In step 5080, the controller presents options to the user to address the incompatibility or deficiency in the requested order. These options are presented by the controller in the form of the processing of step 5081 and step 5085.

Figure 30:
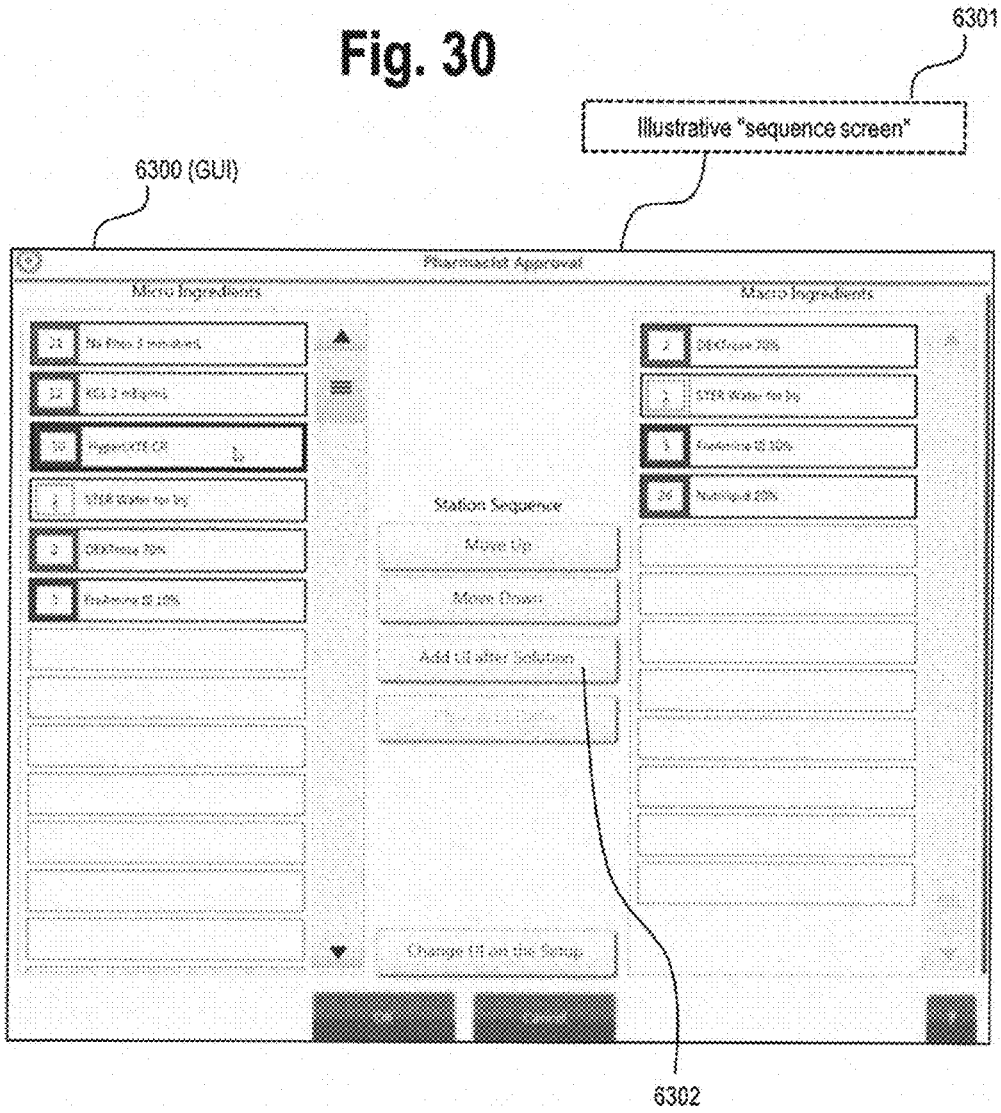

In step 5081, the controller provides an option to the user regarding use of the designated UI of the current set up. That is, a particular ingredient/solution can constitute the designated UI. For example, as shown with button 6302, in the GUI of FIG. 30, the user can select an option of "add UI after solution". The user could also be provided an option to remove UI after solution. Such an option might be beneficial in the situation where there is simply not enough UI to support the needed buffers and flushes. Such option can be provided in the GUI panel 5081', as shown in FIG. 20 and as also shown in FIG. 30.

If yes in step 5081, then the processing passes on to step 5082 of FIG. 20. In step 5082, the controller generates options for the user to adjust dispensing using the designated UI. Relatedly, the controller inputs selected options from the user. For example, the user may interface with the system so as to add more buffer, in the form of the UI, after a particular solution. Then, the process passes on to step 5083.

In step 5083, the processing passes back to FIG. 18 (step 5054) to assess the revised order. In assessment of the revised order, the controller may determine that there are still one or more compatibility or UI volume issues, i.e. deficiencies, with the requested order. As result, as reflected by the GUI panel 5082', shown in FIG. 20, the controller may again require the user to update or revise the current set up. For example, the controller may output a message of "Insufficient UI ordered to complete all buffers and flushes." Additionally, the controller may output a message of "Select a non-UI or update the current set up sequence."

Such message reflects an innovative aspect of the disclosure that the user can select a "non-universal ingredient" as described above. In other words, in accord with this aspect of the disclosure, a user is not constrained by the typical single UI provided by a compounding system. Rather, the compounding system of the disclosure provides for "non-UIs" that the user may choose from.

Figure 21:
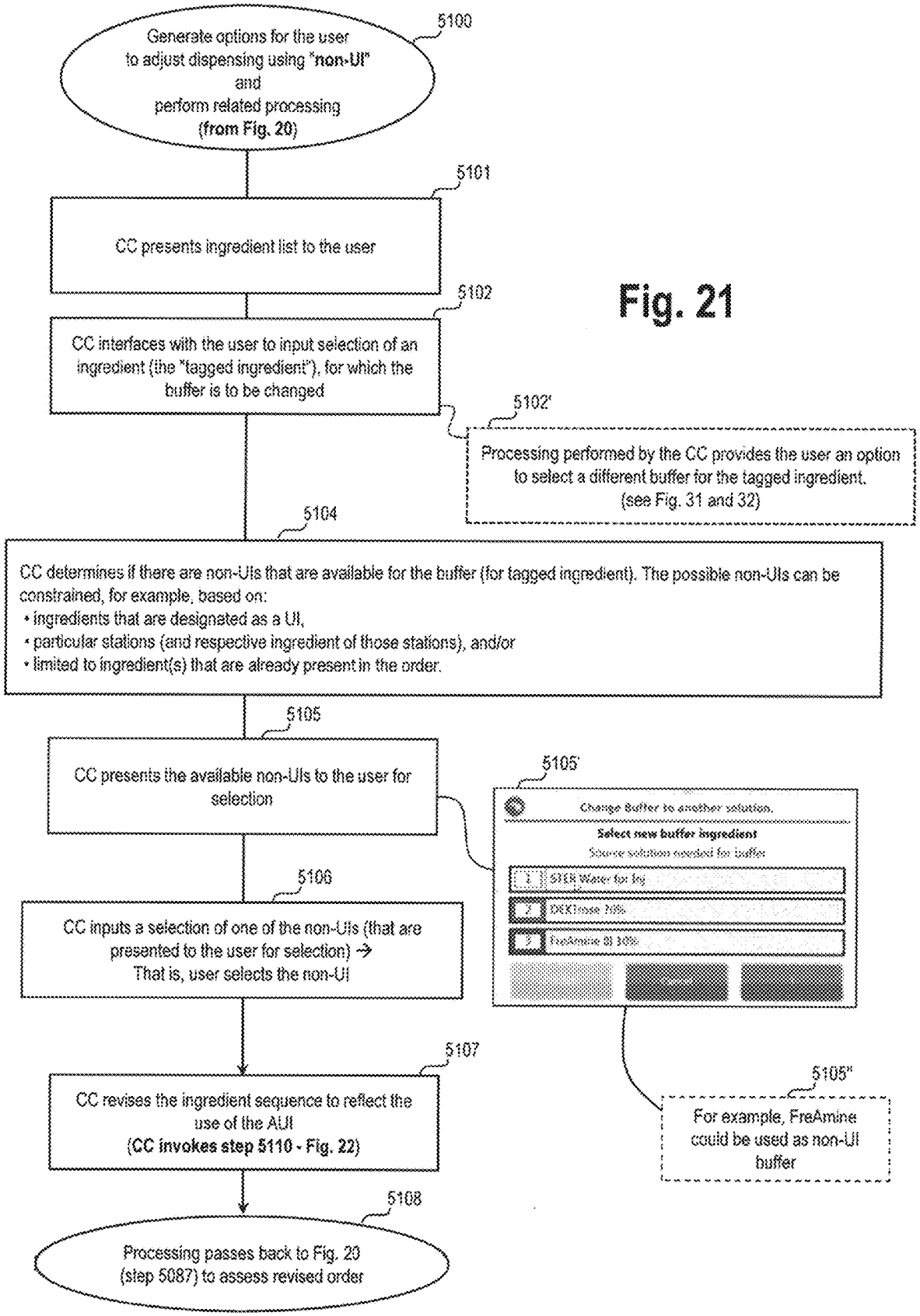
FIG. 21 is a flowchart showing further details of the "generate options for the user to adjust dispensing using a non-UI and perform related processing" step 5100, as called upon in FIG. 20, in accordance with the principles of the disclosed subject matter.

Relatedly, step 5080 of FIG. 20, provides further details of the processing of step 5085. In step 5085, the controller provides an option to the user regarding use of a non-universal ingredient (non-UI) as a buffer. Use of the non-UI buffer can be provided in a suitable option that is presented to the user, such as "Change UI buffer". Such option can be presented to the user via a GUI panel 5085', as shown in FIG. 20, or via some other suitable interface. It should be appreciated that the option for an operator, i.e. user, to utilize a non-UI as a buffer can be the difference between successfully completing an order or simply not being able to complete an order with the particular ingredients on hand. Accordingly, if the user selects the option to change the UI as the buffer, i.e. "yes" as presented in step 5085 of FIG. 20, the process passes from step 5085 on to step 5086. In step 5086, the controller generates options for the user to adjust dispensing, i.e. to adjust the order sequence, using a non-UI as a buffer. The controller also performs related processing. That is, in step 5086 of FIG. 20, step 5100 is called or invoked and processing is performed as shown in FIG. 21.

To explain further, in accordance with at least some embodiments of the disclosure, there can be provided one and only 1 (active) UI ingredient per order. Provided there is enough UI ordered volume in the given order, the system can be configured to allow a user to utilize the UI as a buffer ingredient (1 or more times in the order). However, it may be required by the system to always provide enough UI left to perform the final flush.

In accordance with at least some embodiments of the disclosure, the system can be configured to allow the user, given the proper permissions, to change which ingredient serves as the UI for a given order. The system can also be configured to leave the one and only one UI ingredient as-is but choose a different ingredient to act as a buffer one or more times in an order, i.e. such different ingredient can be characterized as a "non-UI" buffer ingredient.

In the processing of step 5086, and the called step 5100, a revised order can be generated. Accordingly, after step 5086, the process passes on to step 5087 as shown in FIG. 20. In step 5087, the processing (as performed by the controller 2900) passes back to FIG. 18 and step 5054. In such further processing, the revised requested order is assessed to determine if there are deficiencies, i.e. incompatibilities or insufficient UI, in the order. Processing then continues as described above.

Figure 31:
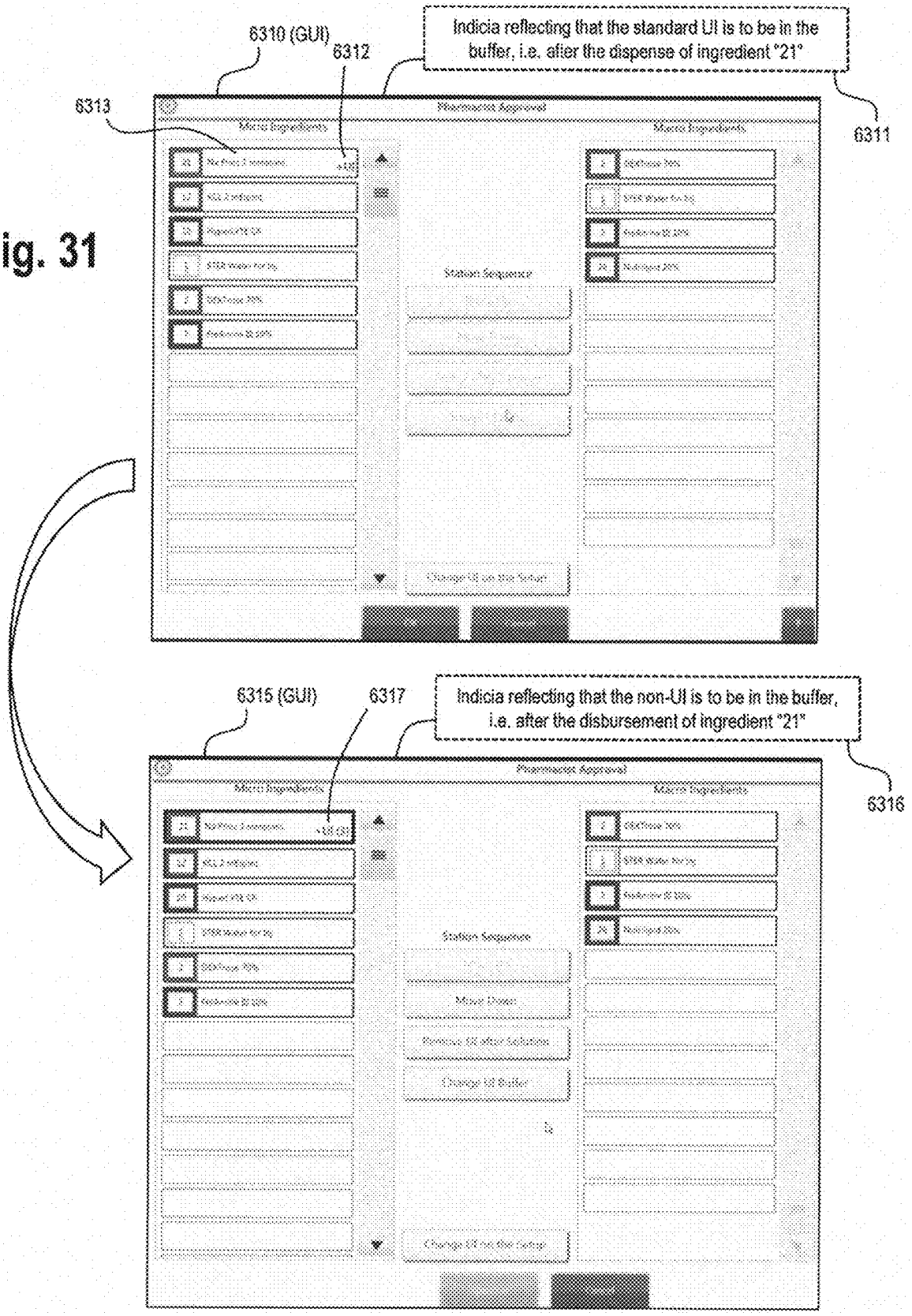

As described above, FIG. 21 is a flowchart showing further details of the "generate options for the user to adjust dispensing using non-UI and perform related processing" step 5100, as called upon in FIG. 20. The process starts in step 5100 and passes to step 5101. In step 5101, the controller can present an ingredient list to the user. Such an ingredient list can be in the form of a GUI 6310 as shown in FIG. 31. As reflected at 6311, in FIG. 31, the GUI 6310 can include indicia indicating that the standard UI is to be (or was attempted to be) the buffer, after the dispensing of micro ingredient 21. More specifically, the GUI 6310 can include indicia 6312 that reflects a UI buffer was entered (by the user) to follow ingredient 21 (NA Phos). However, in this example, it is presumed that there is not enough UI available so as to provide a sufficient UI buffer between the dispensing of item 21 and item 12 (shown in GUI 6310 of FIG. 31). In other words, the processing of step 5081 in FIG. 20 was not successful in this example. The processing of step 5081 may not have been successful due to the solutions available to the compounding system.

With further reference to FIG. 21, after step 5101, the process passes to step 5102. In step 5102, the controller interfaces with the user to input selection of an ingredient for which the buffer is to be changed. Illustratively, a problem with the order sequence as displayed in the GUI 6310 (FIG. 31) may be that there is insufficient UI ordered volume in the order to serve as a buffer after ingredient 21, i.e. NA Phos. Accordingly, the user can identify such problem, based on his or her review of the order sequence, and tap the GUI button 6313 that represents the ingredient 21. By performing such action, the user can designate the ingredient 21 as the "tagged ingredient". As reflected at 5102', processing performed by the controller provides the user an option to select a different buffer for the "tagged ingredient" of the sequence order. In other words, by "tagging" a particular ingredient, the controller then performs further processing knowing the solution for which a buffer is required, i.e. the solution that the buffer will follow. Put another way, if the UI ingredient cannot be used as the buffer e.g., for lack of required volume, the user could choose to select a different or "non UI" ingredient to serve as the buffer ingredient.

Figure 32:
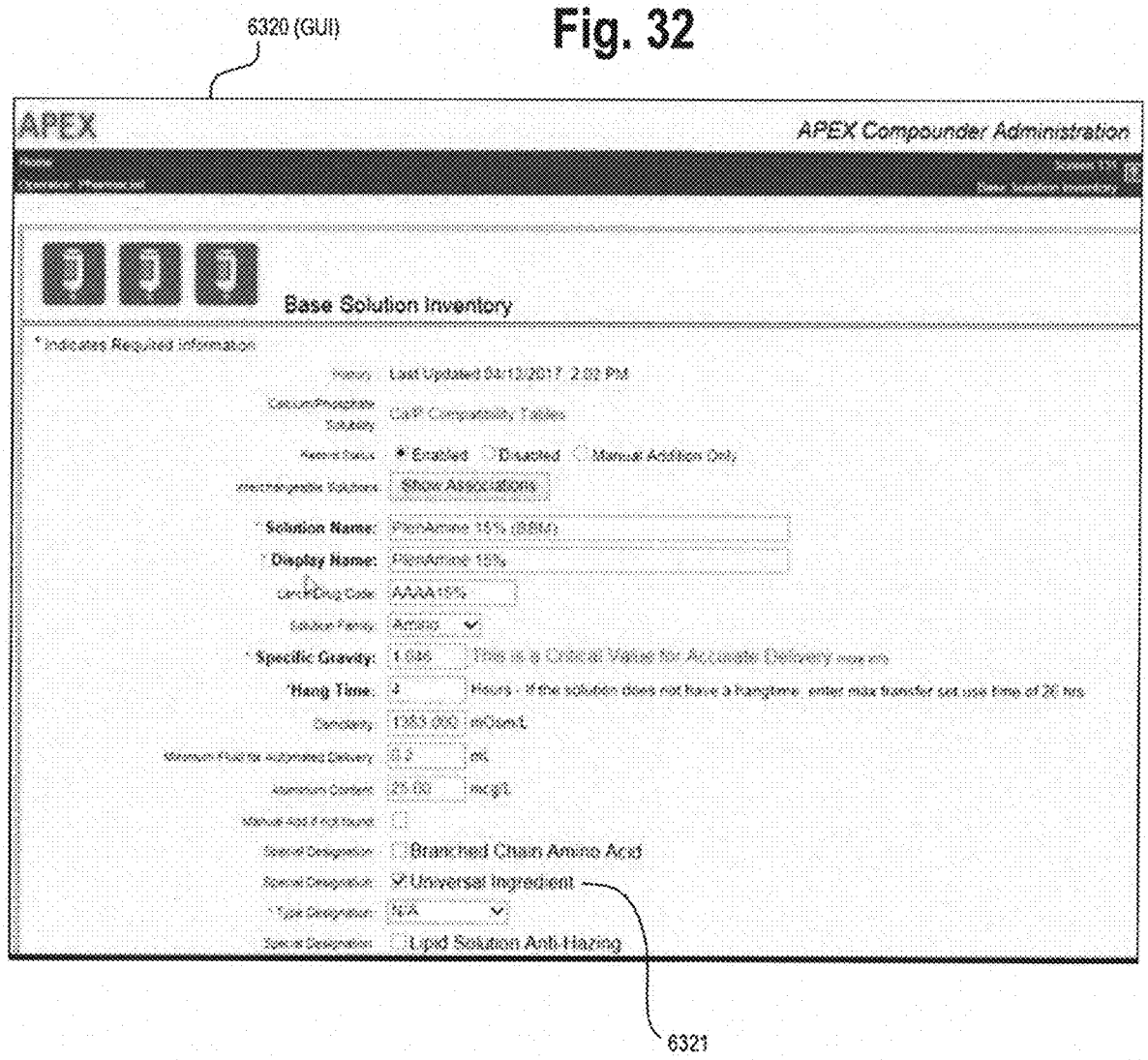

Accordingly, the processing passes from step 5102 on to step 5104. In step 5104, the controller determines if there are non-UIs that are available for the buffer, for the tagged ingredient. The possible non-UIs can be constrained based on various criteria. In particular, available UIs can be controlled by a setting 6321 as shown in the GUI 6320 of FIG. 32. Such GUI 6320 can be part of or a component of a base solution inventory. Data similar to that represented in the GUI 6320 can be provided for all ingredients that are available to the user. In particular, the GUI 6320 can include an option, i.e. a "special designation", by which the particular ingredient can be deemed a universal ingredient. As shown in FIG. 32, if the "universal ingredient" box is checked, then such designates that ingredient can be used both as a UI, as well as a non-UI.

In accordance with principles of the disclosure, in at least some embodiments, for a given ingredient to act as a buffer ingredient in a given order, it is either (1) the currently designated universal ingredient (UI); OR (2) a "UI-capable" ingredient (configurable as such via the mechanism shown in the GUI 6320 of FIG. 32. Accordingly, such "UI-capable" ingredient is not acting as the current UI ingredient (at that moment) and can be currently hanging on station 1, or 2, or 3 of the transfer set/setup.

Accordingly, whether a particular ingredient is checked or not checked (as UI-capable) can be a primary controller as to whether the particular ingredient is available as a non-UI buffer.

The controller can also utilize additional constraints or limitations regarding which ingredients can be utilized as a non-UI buffer. For example, the user may interface with the system such that only certain stations, i.e. the ingredients associated with such stations, are available as non-UI buffers. Additionally, the controller can limit non-UI buffers to ingredients that are already present in the particular order sequence. In at least some embodiments of the disclosure, the controller can reallocate a dispensing of a particular ingredient so as to provide a needed buffer. For example, a portion of FreAmine in an order can be reallocated to be a needed non-UI buffer.

Accordingly, with further reference to FIG. 21, in step 5104 the controller determines if there are non-UI buffers that are available, for the tagged ingredient. As described above, the possible non-UI buffers can be constrained in various ways.

After the determination is performed in step 5104, the process passes on to step 5105. In step 5105, the controller presents the available non-UI buffers to the user for selection. An illustrative GUI panel 5105' is shown in FIG. 21. As reflected at 5105", FreAmine could be used as a non-UI buffer. However, the user may also choose from the other non-UI buffers as shown in the GUI panel 5105'.

After step 5105, the process passes to step 5106. In step 5106, the controller inputs a selection of one of the non-UI buffers, which are presented to the user for selection. Then, the process passes to step 5107.

Figure 22:
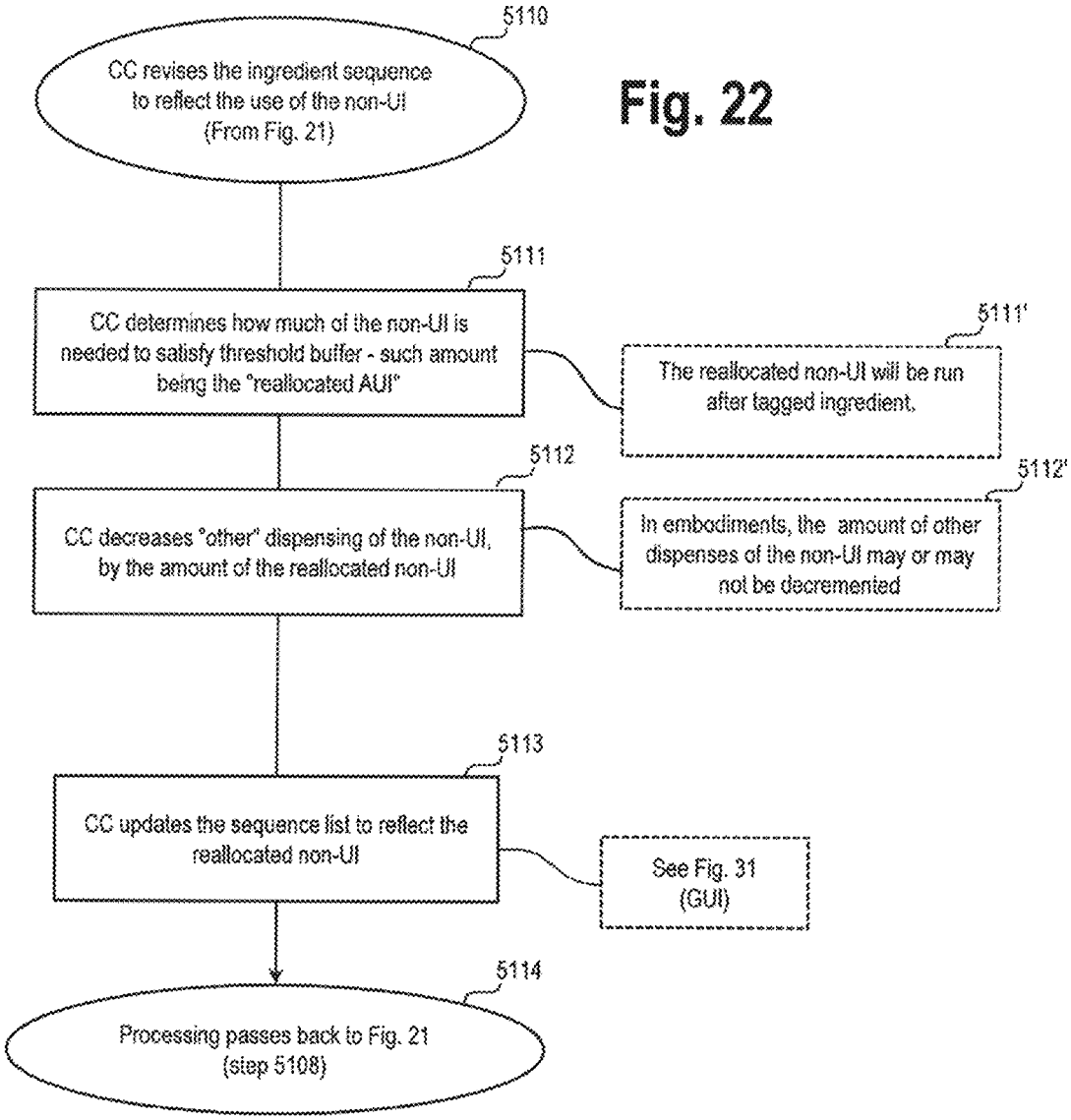
FIG. 22 is a flowchart showing details of the "controller revises the ingredient sequence to reflect the use of the non-UI" step 5110, as called upon in FIG. 21, in accordance with the principles of the disclosed subject matter.

In step 5107, the controller revises the ingredient sequence to reflect the use of the non-UI buffer. In particular, step 5110 is called or invoked and processing is performed as shown in FIG. 22. Further details of such processing are described below with reference to FIG. 22.

After step 5107, the process passes on to step 5108. In step 5108, the processing passes back to FIG. 20 and specifically passes to step 5087. In step 5087, further processing is performed to determine whether the sequence list, as revised by the user, possesses any deficiencies/incompatibilities. Processing then proceeds as described above. As described above, FIG. 22 is a flowchart showing details of the "controller revises the ingredient sequence to reflect the use of the non-UI buffer" step 5110, as called upon in FIG. 21.

The processing of FIG. 22 starts in step 5110 and passes to step 5111. In step 5111, the controller determines how much of the non-UI buffer is needed to satisfy a threshold amount. Such amount can be characterized as constituting a "reallocated non-UI buffer". As reflected at 5111', the reallocated non-UI buffer will be run after the tagged ingredient, in accordance with at least one embodiment of the disclosure. Then, the process passes to step 5112. In step 5112, the controller decreases "other" dispensing of the non-UI buffer. The other dispensing of the non-UI buffer can be decreased by the amount of the reallocated non-UI buffer. However, as reflected at 5112' in FIG. 22, the disclosure is not limited to such particulars. Such would of course increase the overall or total weight of the dispensed solution. To further explain, in at least some embodiments, if one borrows X amount of ingredient A to use as a buffer after some other ingredient, then the "ordered volume of ingredient A minus X" mL is dispensed later (or wherever ingredient A appears in the dispense sequence for that order).

With further reference to FIG. 22, after step 5112, the process passes to step 5113. In step 5113, the controller updates the sequence list to reflect the reallocated non-UI buffer. Such is shown in the GUI 6315 of FIG. 31. That is, as reflected in box 6316, indicia 6317 can be provided reflecting that the non-UI buffer is to be the buffer, i.e. after the disbursement of ingredient 21. Specifically, the indicia 6317 indicates that ingredient 3 (FreAmine) will be used as a buffer after dispense of the ingredient 21. The amount of the non-UI buffer (or other information related to the non-UI buffer) could also be shown, if desired.

After step 5113 of FIG. 22, the process passes to step 5114. In step 5114, the processing passes back to FIG. 21. Specifically, the processing passes to step 5108. Processing then continues as described above.

Figure 23:
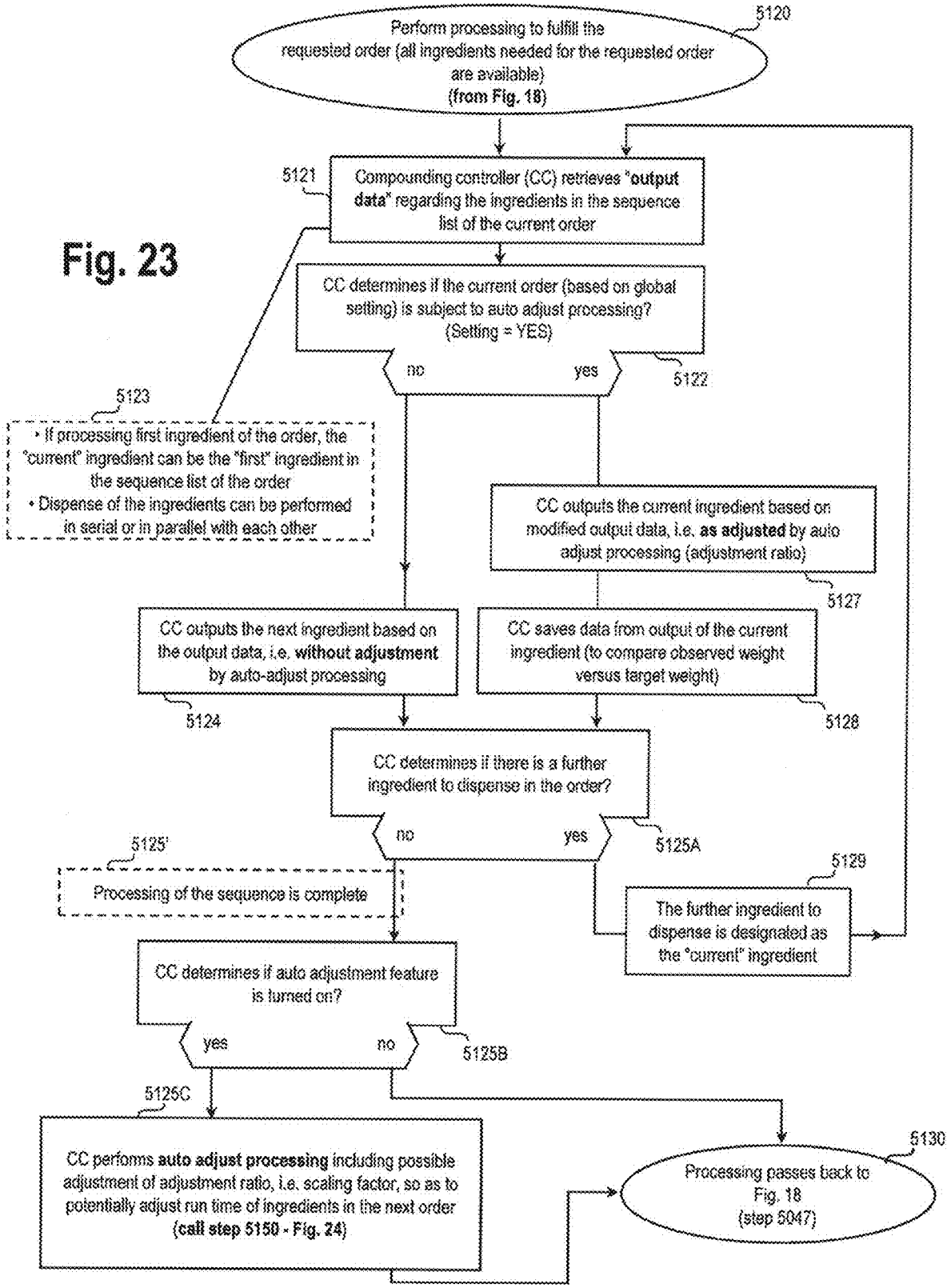
FIG. 23 is a flowchart showing details of the "perform processing to fulfill the requested order" step 5120, as called upon in FIG. 18, in accordance with the principles of the disclosed subject matter.

As described above, FIG. 23 is a flowchart showing details of the "perform processing to fulfill the requested order" step 5120, as called upon in FIG. 18. The processing of FIG. 23 can occur in the situation that no incompatibilities have been identified with the requested order sequence and the controller 2900 is proceeding with the order. In particular, the processing of FIG. 23 illustrates "auto adjust feature" processing as described above. The process starts in step 5120 and passes to step 5121.

In step 5121, the controller retrieves the "output data" regarding the ingredients in the sequence list of the current order, i.e., in the current run. As reflected at 5123, if the compounding controller (CC) is processing the first ingredient in the sequence list of the order, the CC designates the first ingredient as the "current ingredient." Additionally, it should be appreciated that the processing depicted in FIG. 23 reflects what might be characterized as serial or sequential dispensing of the ingredients. It is, however, appreciated that dispensing of ingredients, in an order, may occur in parallel to each other, as may be desired. Such parallel dispensing is otherwise described herein. The "output data" retrieved in step 5121 can include volume or weight of the various ingredients in the order sequence, which can be in the form of an order sequence.

After step 5121, the process passes on to step 5122. In step 5122, the controller determines if the current order is subject to auto adjust processing. As described below, whether or not to perform auto adjust processing can be a global setting that is set by the user. If no in step 5122, then the processing passes on to step 5124. In step 5124, the controller outputs the next ingredient based on the output data without adjustment. Then, the process passes to step 5125A. In step 5125A, the controller determines if there is a further ingredient to dispense in the order. A no determination in step 5125A is indicative that processing of the order is complete, as reflected at 5125', shown in FIG. 23. If no in step 5125A, the processing passes to step 5125B. In step 5125B, the CC again determines, or accesses data regarding, if the auto adjust feature is turned on. If no, then the process passes to step 5130. In step 5130, the process passes back to FIG. 18, i.e., passes to step 5047 in FIG. 18.

On the other hand, in step 5125A, the controller may determine that there is a further ingredient to dispense, i.e. yes. Accordingly, the process passes to step 5129. In step 5129, the further ingredient to dispense is designated, by the processor, as the "current" ingredient. Processing then passes back to step 5121. Processing then continues as described above.

With further reference to FIG. 23, the controller may determine in step 5122 that the current run is indeed subject to auto adjust processing. Accordingly, a yes determination is rendered in step 5122, and the process passes from step 5122 on to step 5127. In step 5127, the controller outputs the current ingredient based on the modified output data, i.e. the dispense amount for the particular ingredient, as adjusted by the auto adjust processing. It is appreciated that while such output data (for the ingredient) has been processed by the auto adjust processing, and is characterized as "modified" output data, it may be the situation that the value of such data has not been changed in the auto adjust processing. For example, the adjustment ratio could be 1.00 (no adjustment) or a value that variates from 1 (e.g. 1.05, indicating an upward adjustment, or 0.95, indicating a downward adjustment).

After the processing of step 5127 in FIG. 23, the process passes on to step 5128. In step 5128, the controller saves the data from output of the current ingredient. The controller saves the data so as to be able to compare observed weight versus target weight in the processing of step 5150, once the order is completed. Additionally, the saved data can be used by the controller so as to insure that the weight scale is increasing by certain threshold(s) over the various dispenses of ingredients of an order.

After step 5128, the process passes on to step 5125A. In step 5125A, the controller determines, as described above, whether there is a further ingredient to dispense. Processing then continues as described above.

With further reference to FIG. 23, a yes may be rendered in the determination processing of step 5125B. Accordingly, the process passes to step 5125C. In step 5125C, the controller performs auto adjust processing including possible adjustment of the adjustment ratio, i.e., the scaling factor or adjustment factor. Adjustment of the adjustment ratio can be used by the controller to control dispense time, i.e. run time, of the ingredient in the next order. The run time can be adjusted up or down, in manner described herein. In particular, in step 5125C, step 5150 can be called or invoked and processing performed as shown in FIG. 24 and described below.

After step 5125C, the process passes to step 5130. In step 5130, the process passes back to FIG. 18 (step 5047 in FIG. 18).

Figure 24:
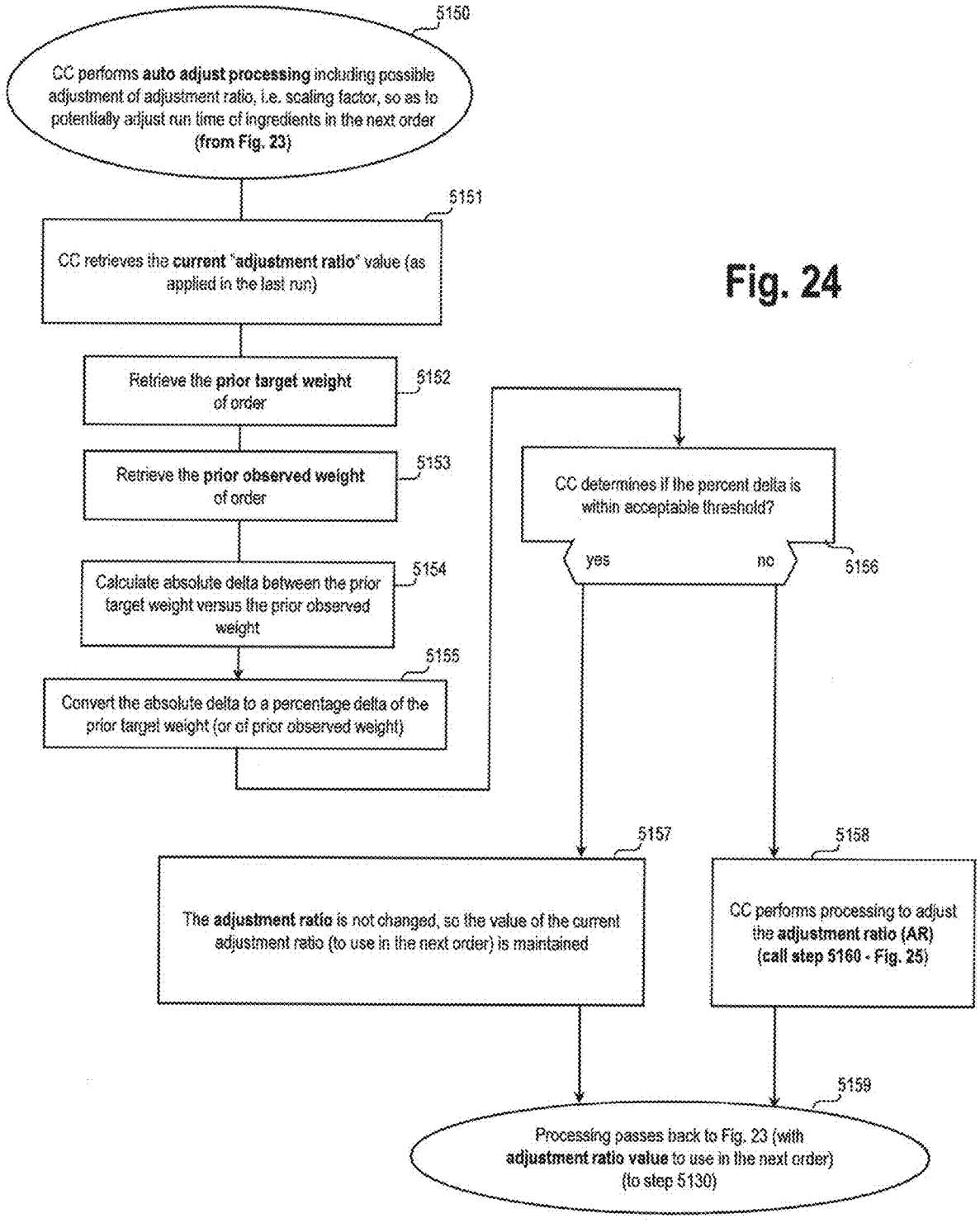
FIG. 24 is a flowchart showing further details of the "auto adjust processing" of step 5150, as called upon in FIG. 23, in accordance with the principles of the disclosed subject matter.

FIG. 24 is a flowchart showing further details of the "auto adjust processing" of step 5150, as called upon in FIG. 23. As shown, the process starts in step 5150 and passes on to step 5151. In step 5151, the controller retrieves the "adjustment ratio" value as applied to the last order. Then, in step 5152, the controller retrieves the prior target weight of the prior order. Then, in step 5153, the controller retrieves the prior observed weight of the prior order.

With regard to the processing of step 5151, the adjustment ratio, i.e., scaling factor, can be stored in a suitable data field in a data record. The data record can be accessed by the controller as needed. In some embodiments, adjustment ratios can be saved over time so as to provide historical data. Such historical data can be used for tracking purposes and to identify trends in particular dispensing arrangements, for example. In the processing shown in FIGS. 23-25, an adjustment ratio can be determined and applied to an order. That is, in certain embodiments, the same adjustment factor is applied over the course of an order—and then a weight check is performed (step 5162 of FIG. 25) for possible adjustment of the adjustment factor for the next order. However, it is appreciated that in some embodiments of the disclosure, an adjustment factor might be used that is adjusted during the course of an order. With such processing, the adjustment factor may be adjusted based on the weight of the bag after a dispense of an ingredient, i.e., so as to adjust the dispensing of a next ingredient. Such adjustment may be based on expected weight versus observed weight of the bag. Adjustment of the adjustment ratio during an order may be more viable with an order in which dispenses of ingredients are performed in serial manner, as opposed to an order in which dispenses are performed in parallel with each other.

With further reference to FIG. 24, the prior target weight of the order and the prior observed weight of the order are retrieved in steps 5152, 5153 respectively. After step 5153, the process passes on to step 5154 in FIG. 24.

In step 5154, the controller calculates the absolute delta between the prior target weight versus the prior observed weight. In other words, the controller determines how much the last run was up or down from the target weight. Then, in step 5155, the controller converts the absolute delta to a percentage delta of the prior target weight. It should be appreciated that the prior observed weight or the prior target weight, along with the absolute delta, may be used in such calculation. Then, the processing passes on to step 5156.

In step 5156, the controller determines if the percent delta is within acceptable threshold. If yes, then the process passes on to step 5157. In step 5157, the adjustment ratio is not changed. As a result, the adjustment ratio that was used in the order that was previously completed will be used in the next order. In other words, the adjustment ratio that was used in the prior run will be maintained for the next run. After step 5157, the process passes on to step 5159.

In step 5159, the processing passes back to FIG. 23—with the adjustment ratio value to use in the next order, i.e., in the next order to be performed, stored in memory. Specifically, the process passes back to step 5130 of FIG. 23.

Figure 25:
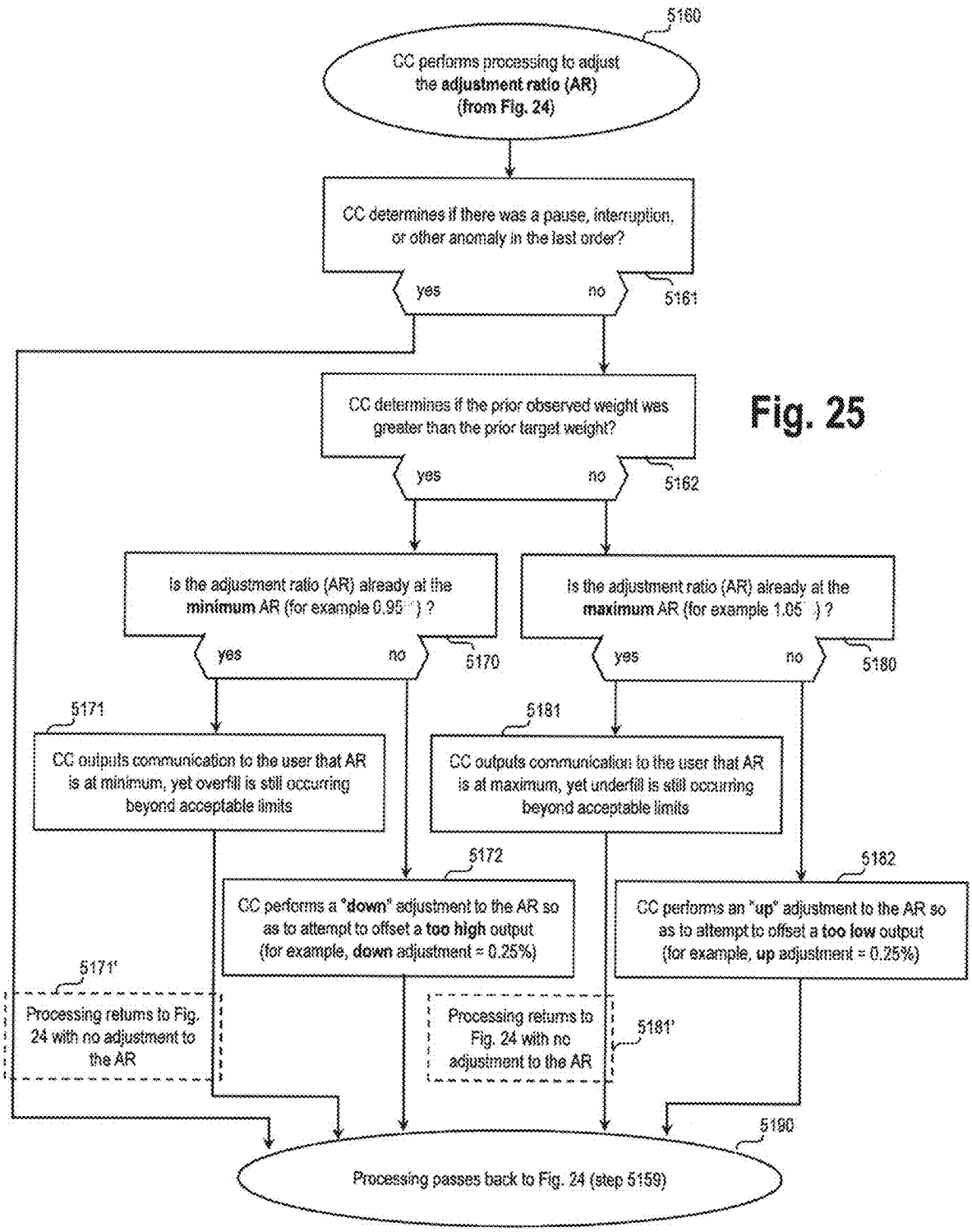
FIG. 25 is a flowchart showing details of the "controller performs processing to adjust the adjustment ratio (AR)" step 5160, as called upon in FIG. 24, in accordance with the principles of the disclosed subject matter.

On the other hand, it may be the situation that a no determination is found in the processing of step 5156 in FIG. 24. That is, the controller may determine that the percent delta is not within acceptable limits or thresholds. As a result, the processing passes from step 5156 on to step 5158. In step 5158, the controller performs processing to adjust the adjustment ratio. The adjustment ratio can also be characterized as "AR". In particular, step 5160 is called or invoked and processing is performed as shown in FIG. 25. Such processing is described below. After step 5158, the process passes to step 5159. In step 5159, the processing passes back to FIG. 23—with the adjustment ratio value to use in the next order, i.e. in the next run to perform, stored in memory. Specifically, the process passes back to step 5130 of FIG. 23. Processing then continues as described above.

As described above, FIG. 25 is a flowchart showing details of the "controller performs processing to adjust the adjustment ratio (AR)" step 5160, as called upon in FIG. 24. The process starts in step 5160 and passes on to step 5161. In step 5161, the controller determines if there was a pause, interruption, or other anomaly in the last order, i.e., run. In other words, the controller takes into consideration whether or not there are adverse circumstances in the last run. If there are adverse circumstances in the last run, then data from the last run should not be used to adjust the adjustment ratio. Accordingly, if yes in step 5161, the processing passes on to step 5190 as shown in FIG. 25. In step 5190, the processing passes back to FIG. 24, step 5159, with no adjustment to the adjustment ratio. Such disposition is reflected at box 5171' of FIG. 25.

With further reference to FIG. 25, it may be the situation that there was not an anomaly in step 5161 that would cause the controller to discount the last run, i.e. with regard to possible adjustment to the adjustment ratio. Accordingly, if a no determination is found in step 5161, then the processing passes on to step 5162. In step 5162, the controller determines if the prior observed weight was greater than the prior target weight. A yes finding in step 5162 reflects a situation of an over delivered container, i.e. too much ingredient was dispensed. A no finding in step 5162 reflects a situation of an under delivered container, i.e. too little ingredient was dispensed. If yes in step 5162, then the processing passes on to step 5170. In step 5170, the controller makes a determination of whether the adjustment ratio is already at the minimum adjustment ratio. For example, the minimum adjustment ratio might be set at 0.95. In other words, in embodiments of the disclosure, the controller can be limited in the amount or magnitude of adjustment imposed. For example, the controller may only be permitted to impose an adjustment up or down of 5%. If yes in step 5170, then no further adjustment can be made. The process passes from step 5170 on to step 5171. In step 5171, the controller outputs a communication to the user that the adjustment ratio is at a minimum, yet overfill is still occurring beyond acceptable limits. Accordingly, such information to the user provides the user the ability and/or information to take other measures to correct the deficiencies. The process passes from step 5171 on to step 5190. That is, as reflected at 5171', the processing returns to FIG. 24 with no adjustment to the adjustment ratio.

On the other hand, the controller, i.e., the compounding controller (CC) may determine in step 5170 that the adjustment ratio is not already at the minimum adjustment ratio. That is, the controller may determine no in step 5170. Accordingly, the process passes on to step 5172. In step 5172, the controller performs a "down" adjustment to the adjustment ratio so as to attempt to offset a too high output. For example, the down adjustment can be 0.25%. In this manner, the processing of the disclosure can "tune"—step by step—an arrangement that is delivering too much ingredient.

As otherwise described herein, it is appreciated that the auto adjust feature can be subject to various limitations. As described above, the controller can be limited by how much adjustment is made from order to order. For example, the controller may be limited to only varying the adjustment 0.25%. Additionally, the controller can be limited in the absolute value of the adjustment. For example, the controller may be limited to only varying the absolute value of the adjustment up or down 0.5%. Additionally, the auto adjustment feature may only be applied to macro ingredients. Such macro ingredients can be constituted, for example, by having ingredient volume of 150 ml or greater. Accordingly, ingredients having a dispense volume of less than 150 ml may not be subject to auto adjustment processing.

With further reference to FIG. 25, the controller may determine in step 5162 that the prior observed weight was not greater than the prior target weight. As a result, a no determination is found in step 5162. As a result, the process passes on to step 5180. In step 5180, the controller determines whether the adjustment ratio is already at the maximum adjustment ratio. For example, the maximum adjustment ratio might be 1.05, which defines the top end of adjustment provided by the controller. If yes in step 5180, then the process passes on to step 5181.

In step 5181, the controller outputs a communication to the user that the adjustment ratio is at a maximum, yet underfill is still occurring beyond acceptable limits. The process passes from step 5181 on to step 5190. That is, as reflected at 5181', processing returns to FIG. 24 with no adjustment to the adjustment ratio.

On the other hand, the controller may find a no determination in step 5180. Such no determination reflects that the adjustment ratio is not at a maximum. Accordingly, the controller can perform further adjustment so as to tune the system. Accordingly, the process passes from step 5180 on to step 5182. In step 5182, the controller performs an "up" adjustment to the adjustment ratio—so as to attempt to offset a too low output. For example, the up adjustment might be 0.25%. Processing then passes from step 5182 on to step 5190. Processing then continues as described above.

FIG. 26, as described above, is a flowchart showing further details of the "controller interfaces with user to perform system management processing" step 6000 as called upon from FIG. 17, in accordance with the disclosed subject matter. FIG. 26 shows various processing related to the management, administration, or general processing of the compounding system, i.e. collectively referred to herein as "management processing." As illustrated, the processing starts in step 6000 and passes on to step 6001. In step 6001, the controller awaits for input, from the user, to perform management processing.

Figure 29:
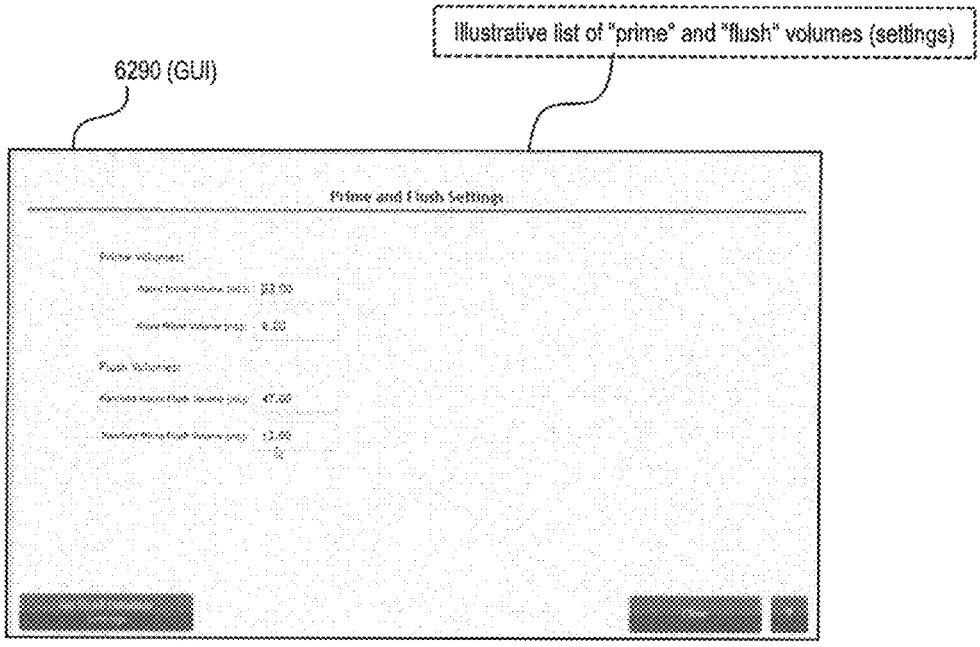

As shown in step 6010, the controller awaits a request from the user to view system macro and micro flush requirements. Aspects of macro and micro flush requirements are described herein. Such requirements can dictate an amount of liquid that must be spaced between incompatible liquids. Such requirements can dictate an amount of liquid that must be provided after an ordered sequence, i.e. before an ordered sequence of a new patient is processed. Upon the request of step 6010 being received, the processing passes from step 6010 on to step 6011. In step 6011, the controller generates a GUI to display macro and micro flush requirements. Illustratively, the controller may display the GUI 6290 as shown in FIG. 29. The user can be provided the ability to vary the flush volumes. It should be appreciated that the ability of a particular user to vary such parameters may depend on the credentials entered by the user upon signing in to the system.

As shown in step 6020, the controller awaits a request from the user to enable the "auto adjust" feature. If a request is received, i.e. yes in step 6020, then the processing passes from step 6020 on to step 6021. In step 6021, the controller invokes or calls upon step 6050 of FIG. 27. In other words, processing is performed to provide a user the ability to turn the auto adjustment feature on or off. Further details are described below with reference to FIG. 27.

As shown in step 6030, the controller can be programmed to await a request from the user to view the current order sequence. Such ability can be advantageous at various points in operation of the compounding system. If a request is received, i.e. yes in step 6030, the processing passes from step 6030 on to step 6031. It is appreciated that various particulars may be provided by the user, in response to a prompt by the system, so as to identify/select the particular order sequence that is desired by the user. Illustratively, it is within the scope of the present disclosure to display a screen to show orders that have already been completed wherein the processing of step 6031 can include the display of a GUI 6300, such as shown in FIG. 30.

As shown in step 6040, the controller can await a request from the user to enable and perform the "disable station" feature. As described herein, the disable station feature allows a user to disable a particular station of the compounding system. If a request is received, i.e. yes in step 6040, than the process passes on to step 6041. In step 6041, the controller invokes "disable station" processing. Details are described below with reference to FIG. 34.

As described above, FIG. 27 is a flowchart showing details of the "controller invokes auto adjust enablement processing" step 6050, as called upon in FIG. 26. The process starts in step 6050 and passes on to step 6051. In step 6051, the user can advance through various available menu options. It is of course appreciated that various user interfaces, menu options, and other navigational mechanisms can be utilized by the controller so as to enable the user to access and manipulate various settings of the compounding system. For example, as shown in FIG. 27, such navigation through menu options can include "options" 6051A; "settings" 6051B; and "compounder" 6051C. It is appreciated that the particular sequence of options or menu items can vary greatly as desired.

Figure 33:
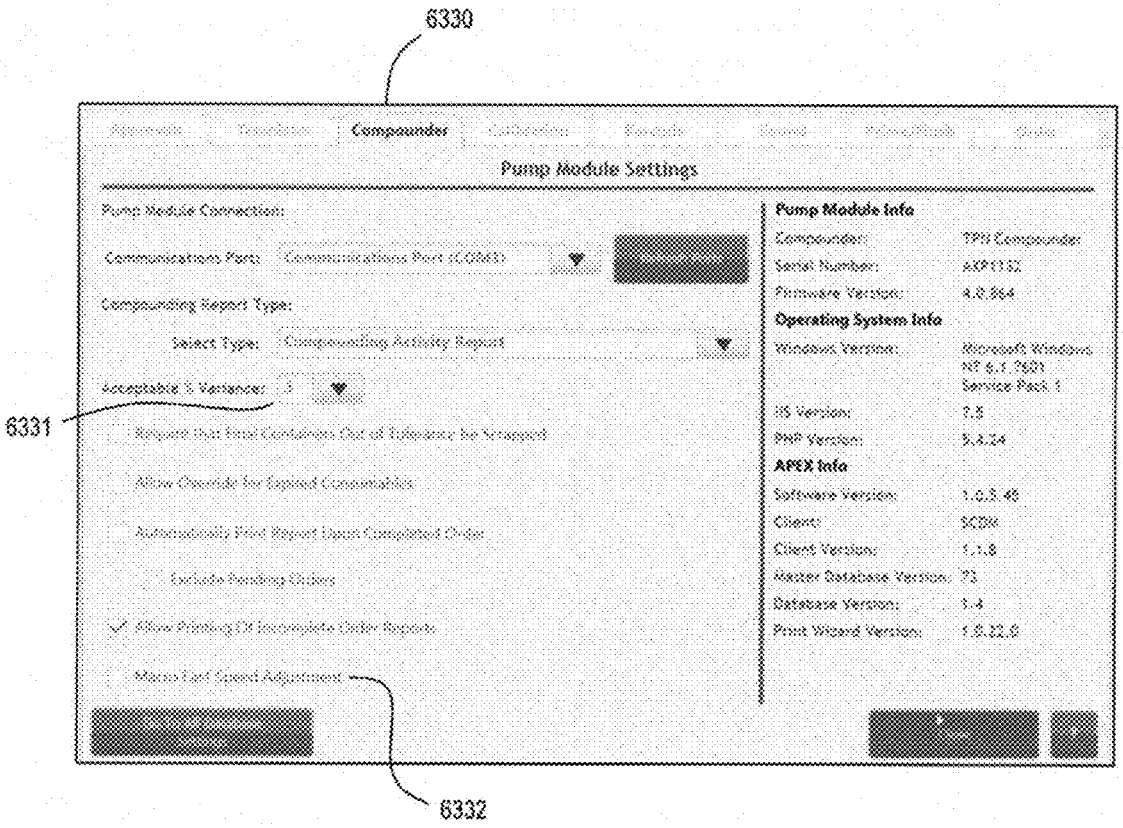

In the example of FIG. 27, the user can navigate such that the controller displays a "compounder screen" that includes macro high-speed adjustment. That is, the processing of FIG. 27 can pass from step 6051 on to step 6052. As reflected at 6052', such compounder screen can be in the form of a GUI 6330 as shown in FIG. 33. The GUI 6330 can provide the user various options associated with pump module settings. Illustratively, the GUI 6330 shows that acceptable percent variance is set to 3%. The user can vary such percent by manipulation of the field 6331. Additionally, the GUI 6330 includes an option "Macro Fast Speed Adjustment" 6332. Such option controls whether the "auto adjust feature" described above is turned on or off. If option 6332 is checked, then the auto adjust feature is turned on. If option 6332 is not checked, then the auto adjust feature is turned off. In some embodiments of the disclosure, the auto adjust feature can only be applied to macro dispensing. However, in other embodiments of the disclosure, the auto adjust feature can be applied to micro dispensing. In other embodiments of the disclosure, the auto adjust feature can be applied to the final bag weight. That is, weight of the bag may not be checked after individual micro or macro dispensing. Rather, weight of the bag is checked after all the micro and macro dispensing has been performed. The particular application of the auto adjust feature can be considered in setting the various operating parameters of the auto adjust feature. For example, the maximum adjustment per run, as well as the maximum absolute adjustment allowed, might be less for micro dispensing as compared to macro dispensing.

With further reference to FIG. 27, after the user has selected the macro fast speed adjustment 6332 of FIG. 27, the processing can pass from step 6053 on to step 6054. In step 6054, the user can save the changes. In response to the save of such changes, the controller can generate an appropriate alert, such as shown by dialog box 6054' of FIG. 27.

Then, the process passes from step 6054 on to step 6055. Step 6055 reflects an operating condition that the controller will perform auto adjust processing upon the next order being run.

Figure 40:
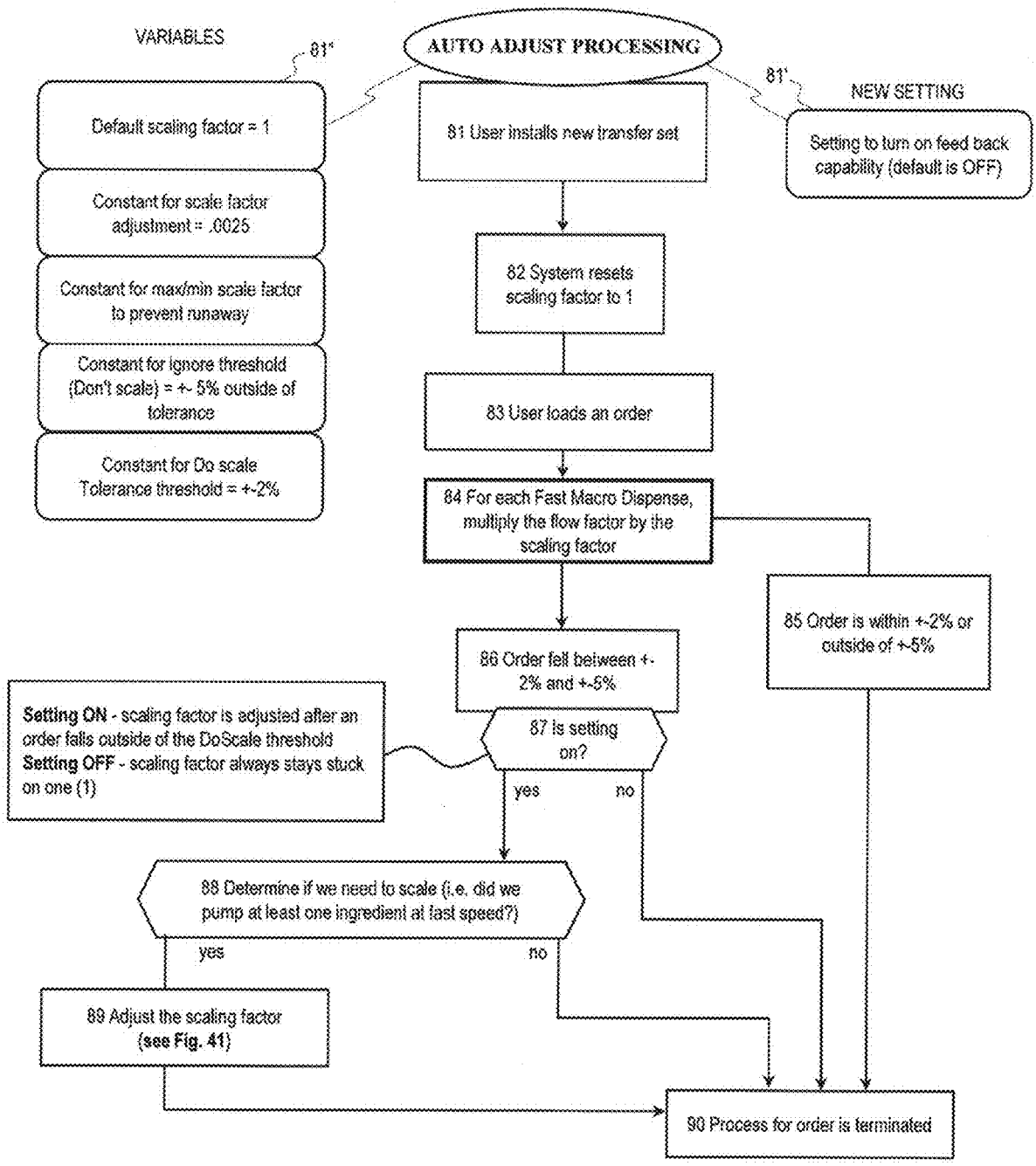
FIG. 40 is a flowchart showing further details of auto adjust processing in accordance with the principles of the disclosed subject matter.

FIG. 40 is a flowchart showing further details of auto adjust processing. As shown at 81', a setting can be provided to turn on and off the feedback capability provided by auto adjust processing. As shown at 81", and as described above, many different variables can be utilized in auto adjust processing. These variables can include a default scaling factor, a constant for scale factor adjustment, a constant for max/min scale factor to prevent runaway (i.e. the system will only scale to a certain degree), a constant for ignore threshold (i.e. variances outside ±5% will not be addressed) and a constant for "do scale" tolerance threshold (i.e. scaling will be performed if this tolerance threshold is satisfied).

In the further illustration of auto adjust processing shown in FIG. 40, the process starts in step 81. In step 81, a user installs a new transfer set. Then, in step 82, the system resets the scaling factor to 1, for example, as a result of the install of the new transfer set. Then, the process passes to step 83. In step 83, the user loads an order. Then, in step 84, for each fast macro dispense, in this example, the system multiplies the flow factor by a scaling factor that has been established in the system. By default, that scaling factor can be of value "1". In the processing shown in FIG. 41, the scaling factor can be adjusted based on the results of sequential runs and based on the constant for scale factor adjustment.

As shown in step 85, if the order is within ±2% or outside of ±5%, then no auto adjust processing will be performed. That is, if the order is within ±2%, then the tolerance of the order is acceptable. On the other hand, if the order is outside of ±5%, then the order is beyond acceptable limits and beyond auto adjust processing, at least in accordance with some embodiments of the disclosure.

Step 86 of FIG. 40 reflects that the order fell between ±2% and ±5%. Accordingly, this window or range results in possible application of auto adjust processing. In step 87, a determination is made by the system of whether the auto adjust processing setting is "ON". If no, then the process passes onto step 90. In step 90, the process for the particular order is terminated.

On the other hand, if "YES" is indicated in step 87, then the processing passes onto step 88. In step 88, a further determination is performed of whether to scale or not to scale. As shown, this can be based on a determination of whether at least one ingredient was pumped at fast speed. If no, then the process passes onto step 90—and the process for the particular order is terminated. If yes in step 88, then the process passes onto step 89.

In step 89, processing is performed to adjust the scaling factor. An example of such processing is shown in FIG. 41.

Figure 41:
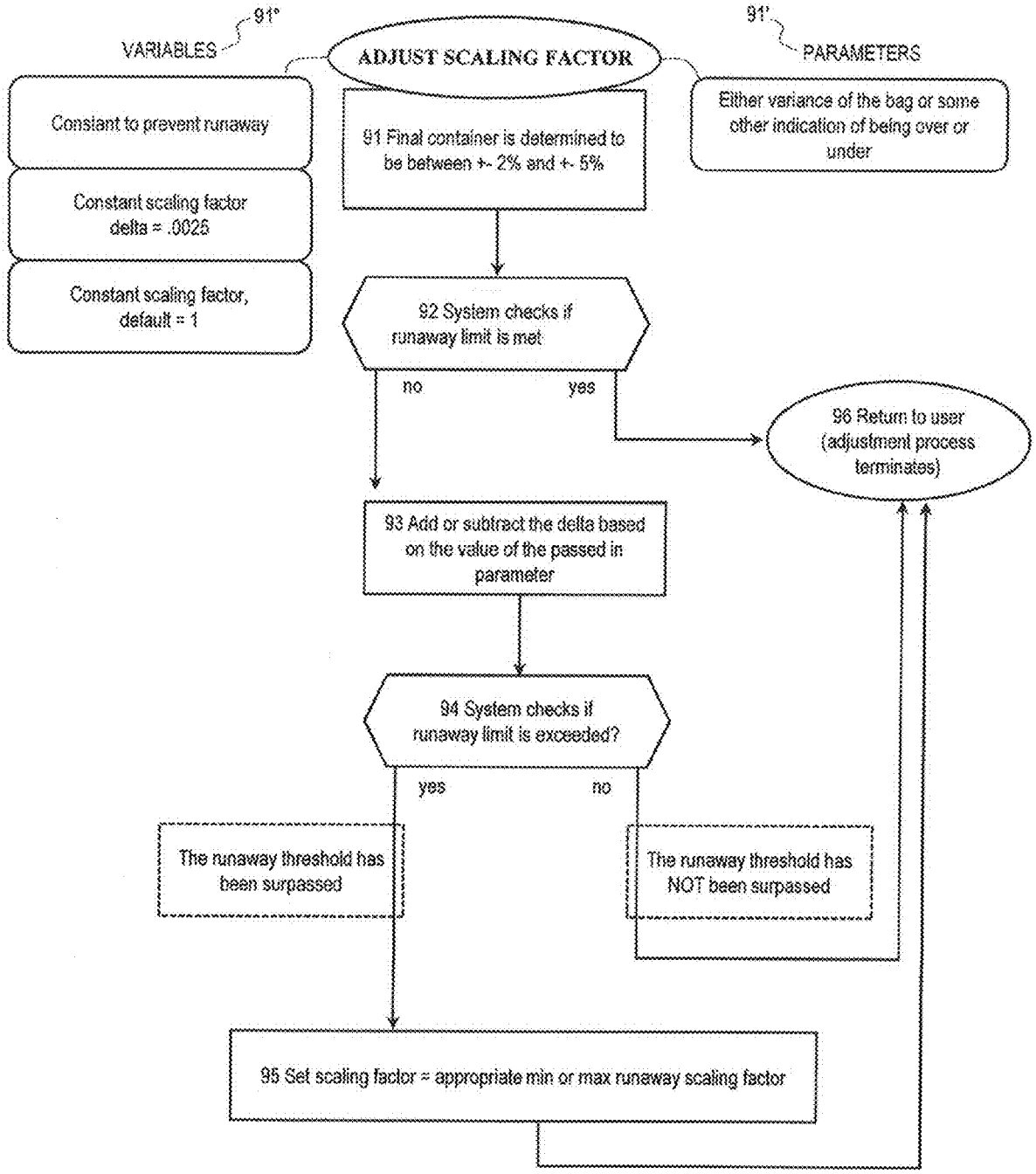
FIG. 41 is a flowchart showing an illustrative process to adjust scaling factor in auto adjust processing, in accordance with principles of the disclosed subject matter.

FIG. 41 is a flowchart showing an illustrative process to adjust the scaling factor in auto adjust processing, in accordance with principles of the disclosure. As shown at 91', either variance of the bag or some other indication of being over or under, for example, the filled bag being over or under weight, can trigger the adjustment of the scaling factor. As shown at 91" and as described above, many different variables can be utilized in the processing of FIG. 41.

The processing of FIG. 41 starts in step 91. Step 91 reflects that the final container that has been filled is determined to be between ±2% and ±5%. After step 91, the process passes onto step 92. In step 92, the system checks if the runaway limit is exceeded. In other words, is there any more room to adjust up or down. For example, the runaway limit may be ±5%. If in step 92 the system determines that the runaway limit is met in the direction that the factor is adjusted, then the process passes onto step 96. In step 96, control returns to the user and the adjustment process terminates.

On the other hand, if the runaway limit has not been exceeded as determined in step 92, then the process passes onto step 93. In step 93, the system adds or subtracts the difference "delta" based on the value of the passed in parameter, i.e. whether the bag was overfilled or under filled. Then, in step 94, the system checks if the runaway limit is exceeded. If no, then the new scaling factor will be retained as determined in step 93. Accordingly, the process again passes onto step 96.

If the system determines that the runaway limit has been exceeded in step 94, then the processing passes onto step 95. In step 95, the scaling factor will be set at the appropriate min or max runaway scaling factor. In other words, the scaling factor will be constrained to be the min or max runaway scaling factor. After step 95, the process passes onto step 96. As above, in step 96, control returns to the user and the adjustment process is terminated.

It should be appreciated that the values, ranges and other parameters described herein are for purposes of illustration and can be varied based on various considerations and project applications. Such considerations can include particular attributes of the system used, particular implementation of the system, limits or thresholds deemed satisfactory, particular user requirements, and other considerations.

As described above, FIG. 34 is a flowchart showing details of the "controller performs disable station processing" step 6070, as called upon by FIG. 26. The process starts in step 6070 and passes on to step 6071. In step 6071, the controller identifies that a particular station has malfunctioned and conveys the status of such malfunction to the user. FIG. 35 shows an illustrative GUI 6350. The GUI 6350 shows that station 14 (depicted as reference 6351) has malfunctioned. Such a status is indicated by the demarcation shown at 6352, i.e. an "X" marking. The malfunctioning of the station can be conveyed to the user in any of a variety of manners. In addition, the "X" marking can also be present when a station is not totally ready to be used (for example, the station has yet to be primed), as opposed to the system specifying that the station malfunctioned. But, there are cases where a station malfunctions and the same X is shown in the screen.

Figure 34:
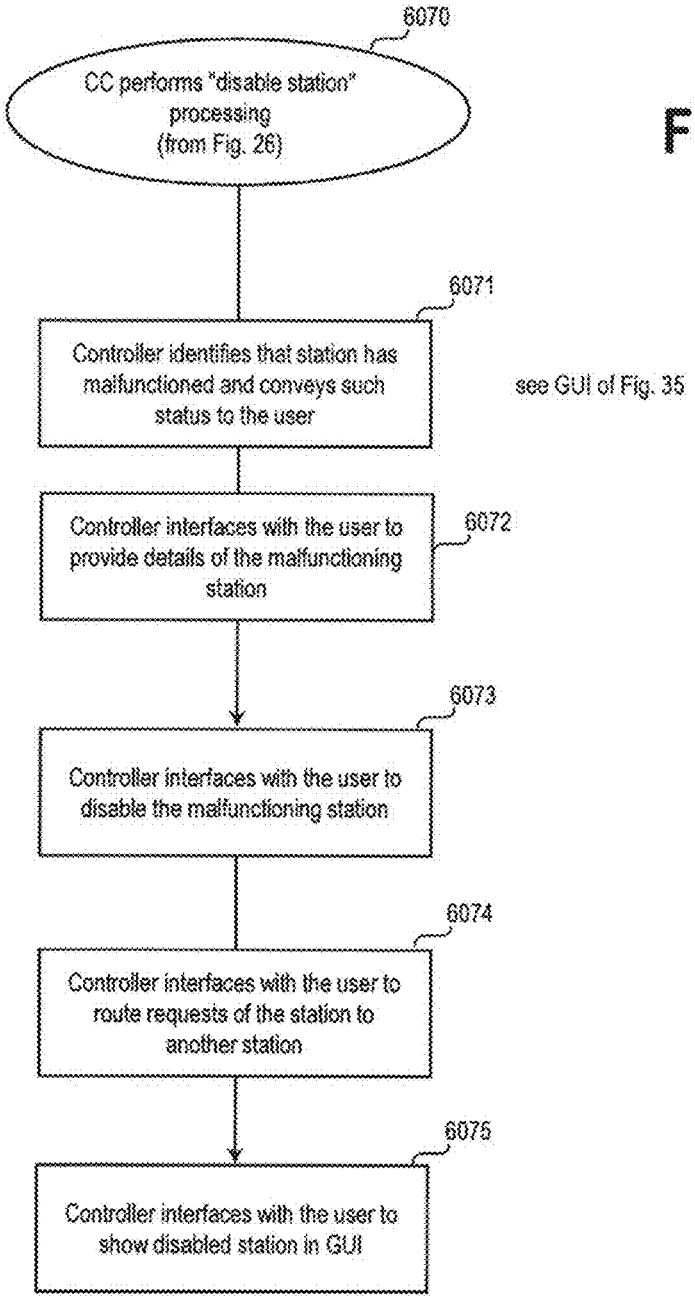
FIG. 34 is a flowchart showing details of the "controller performs disable station processing" step 6070, as called upon by FIG. 26, in accordance with the principles of the disclosed subject matter.
Figure 35:
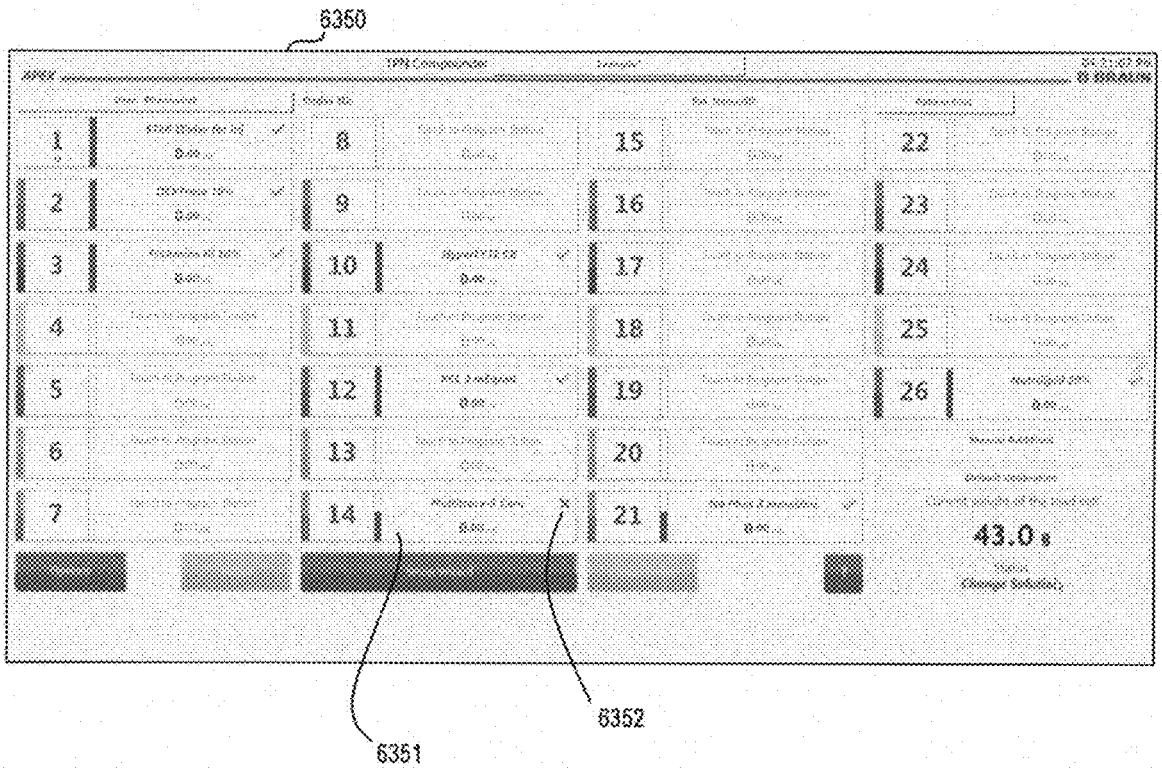
FIGS. 35-36 are graphical user interfaces (GUIs) generated by the controller, in accordance with the principles of the disclosed subject matter.
Figure 36:
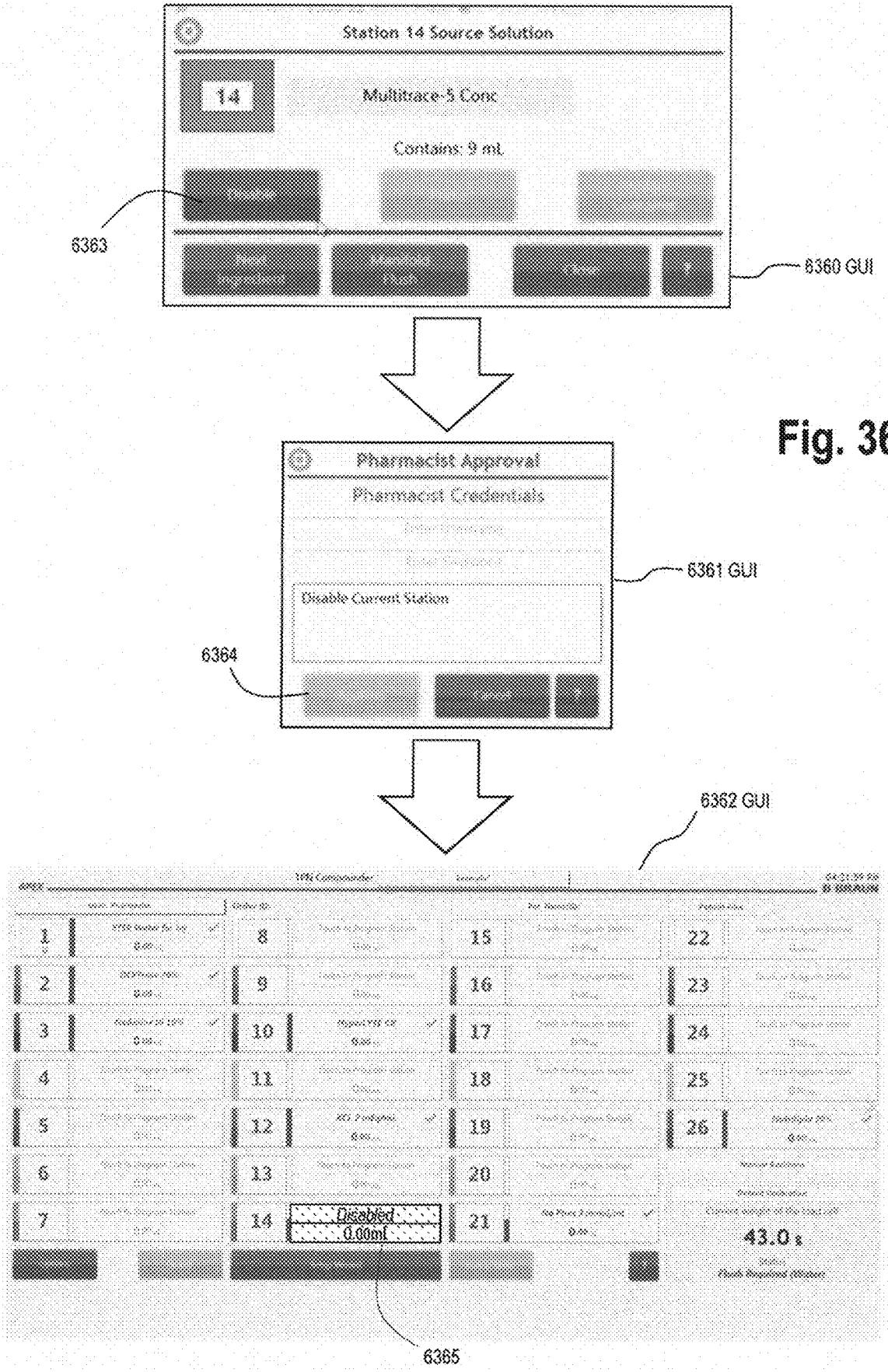

With further reference to FIG. 34, after step 6071, the process passes on to step 6072. In step 6072, the controller interfaces with the user to provide details of the malfunctioning station. Illustratively, the controller, to interface with the user, can generate and output a GUI 6360 as shown in FIG. 36. The GUI 6360 can identify the station number and various attributes of the station. The GUI 6360 can provide details of the amount of solution still remaining in the source container associated with the particular station. The GUI 6360 can include a "disable" button 6363. In order to disable the station, the user can "tap" or otherwise select the disable button 6363. Relatedly, the process of FIG. 34 can pass from step 6072 on to step 6073. In step 6073, the controller further interfaces with the user so as to disable the station. A GUI 6361, shown in FIG. 36, can be used to perform such interface.

The GUI 6361 can include a message such as "Disable Current Station". The GUI 6361 may also include indicia reflecting the particular station to be disabled as well as other attributes of the station to be disabled. The GUI 6361 can include an "Approve" button 6364. The user can tap the "Approve" button 6364 so as to confirm that the particular station should be disabled. As shown in FIG. 36, the approve button 6364 can be "grayed out" or not active until suitable credentials are entered into a GUI 6361. For example, the user (pharmacist) may be required to enter a username and password or other credentials. Once suitable credentials have been entered, the button 6364 will become active. Accordingly, the user can then tap such button so as to disable the station.

After step 6073 of FIG. 34, the process passes on to step 6074. In step 6074, the controller interfaces with the user to route requests of the station to another station. In such functionality, a redirect functionality can be utilized such that requests for the disabled station, here station 14, can be handled by another station. This functionality allows existing order sequences to be utilized without change. For example, a container that was previously associated with station 14 could be moved to station 17. In accordance with at least some embodiments of the disclosure, a redirect setting can be provided. A redirect setting can dictate that any requests placed upon station 14 are to be handled by station 17. Accordingly, the compounding system can continue to operate with minimal burden on the user, even though a station of the compounding system has malfunctioned. In some embodiments, a redirect setting may not be provided. In accordance with at least some embodiments, the system can simply look for the station that is associated with a given ingredient (or a suitable interchangeable ingredient) and then, in the process of loading the order, assign the pertinent ordered volume of that ingredient for that order to that given station. For this process, the system can basically ignore any disabled stations, treating them as if they are not associated with any ingredient.

After step 6074 FIG. 34, the process passes on to step 6075. In step 6075, the controller interfaces with the user to show the disabled station in a suitable GUI 6362 shown in FIG. 36. The controller can generate the GUI 6362 to include indicia 6365 that reflects that station 14 has been disabled. For example, the GUI 6362 can include text such as "Disabled" that is highlighted in black so as to be apparent to the user. It is of course appreciated that a wide variety of indicia can be utilized to alert the user that the particular station has been disabled.

Hereinafter, various further features and functionality of the systems and methods of the disclosure will be described.

As referenced above, the disclosed embodiments can include the generation of instructions for controlling the operation of the pumps. As stated above, some compounding devices use a peristaltic pump mechanism driven by a stepper or servo type motor to turn the pump mechanism in precisely measurable increments. The system and methods according to the disclosed embodiments can also determine whether a pharmaceutical or other source solution should be delivered using a micro fluid flow path or a macro fluid flow path to the final container 80. An examination of input data can result in a logical decision by the controller 2900 to activate the corresponding macro or micro pumps 41, 42. The software in the controller 2900 can also control the use of a flex line. This logical decision can be based upon the type of fluid to be delivered, the volume to be delivered, and other factors.

Thus, the disclosed systems and methods utilize the controller 2900 for storing in a memory instructions for activating the micro and macro fluid flow paths depending upon the ingredients to be dispensed. The processing method can include receiving setup data in the controller 2900, the setup data being indicative of a plurality of micro and macro source solutions connected to a plurality of macro fluid lines or a plurality of micro fluid lines. The setup data can also be indicative of a plurality of micro valves connecting the micro fluid lines to a micro pump, and a plurality of macro valves connecting the macro fluid lines to a macro pump. The setup data can also include a script that is to be dispensed using the micro and macro source solutions. The controller 2900 can prepare the system 1 for fulfilling the script grouping the source solutions into a micro group that is transferred by the micro pump and a macro group that is transferred by the macro pump. The controller 2900 can generate instructions for preparing the compounding system 1 to selectively transfer the micro group source solutions using the micro pump 41 and to selectively transfer the macro group source solutions using the macro pump 42. The controller 2900 can receive pump data from one or more sensors that sense actions of the micro pump 41 and the macro pump 42, the pump data being indicative of an amount of source solution displacement by the macro pump 42 or the micro pump 41. The controller 2900 can then operate the micro pump 41 and the macro pump 42 to selectively dispense the source solution amounts according to the preparation order.

A process of the controller 2900 can receive information relating to the material source solutions located across all of the input stations (for example, in the micro and macro input containers 4*a*, 4*b*). The type of data relating to the material source solutions can include the identity of each fluid on each line.

The controller 2900 can associate the micro flow path components, including the input containers 4*a*, micro input lines 2011, valves 21*a*, manifold channel 24*a*, output line 25*a* and the micro pump 41. The controller 2900 can associate the macro flow path components, including the input containers 4*b*, macro input lines 2021, valves 21*b*, manifold channel 24*b*, output line 25*b* and the macro pump 42.

The controller 2900 can also associate flex line flow path components including the input containers 4*b*, fluid lines 2011, 2021, valves 21*a*, 21*b*, manifold 20, channels 24*a*, 24*b*, and pumps 41, 42.

The controller 2900 can create a logic table of associated flow paths, including operations for the micro flow path, the macro flow path, and the flex line flow path components. The controller 2900 can examine the scripted volumes and the dispensing sequence to prepare the operation instructions for the micro and macro pumps 41, 42.

The controller 2900 can receive user interface input to initiate compounding activity. Micro and Macro dispensing can be performed in parallel. The controller 2900 can determine the first or next solution to be dispensed along the micro flow path. The controller 2900 can apply flow rate factors pertinent to the source solution about to be dispensed. The flow rate factors refer to characteristics of each fluid and can be based upon various fluid characteristics such as viscosity, specific gravity, etc. The flow rate factors of a fluid can also be determinative of whether a particular fluid is more prone to forming an occlusion within a fluid line. The flow factors can also be a function of other factors, including the source container, the spike type, the line type and the pump speed.

In a point in the processing, the controller 2900 can determine whether there are any additional micro line source solutions to be pumped for the current order. Further micro line source solutions can then be pumped as dictated by the particular sequence.

As referenced above, the controller 2900 can include an algorithm or process for pump control to prevent simultaneous drawing of incompatible liquids into a common flow path. In the compounding process, fluid solutions are drawn from small or large containers 4*a*, 4*b* into micro input lines 2011 or macro input lines 2021. The compounding system 1 can be configured to combine the input lines into a single output line 2031 at the union junction 60, and subsequently to the final collection point, such as the intravenous fluid bag 80. Much of the complexity of a pharmacy practice involves determining if different ingredients within solutions or materials of a prescription will have compatibility issues caused by the concentrations or preparation order of the script. Compatibility of material sources for a script can be defined as an interaction between a material source ingredient, such as a drug, and all other ingredients and components with which the drug comes into contact. "Compatibility" of a drug or other material ingredient in a compounding process refer to either a physical compatibility or a chemical compatibility. Physical compatibility can be an incompatibility that will alter the physical appearance of an ingredient, which can result in a visual change such as precipitation, gas evolution, or a change in color. Chemical incompatibilities may not always be visually observable but must be analytically tested. Chemical incompatibilities can occur as a result of changes in the active ingredient such as oxidation or photodegradation. Factors that can influence compatibility include, but are not limited to, the total diluent volume, concentration levels, the order of admixing, and the pH. However, it can be difficult to determine material source incompatibilities in a high-volume, automated compounding device that can implement custom scripts, custom preparation orders, and even manual fluid inputs.

In one example, the compatibility between a material source solution being added to the final container 80 or the common output line 2031 and the solution present in the final container 80 or the common output line 2031 can be evaluated. In some instances, material source solutions that are packaged at concentrations that are incompatible with other material source solutions must be diluted before they come into contact with each other in common fluid lines or containers. In an admixture process, the highest dilution will occur when the greatest amount of diluting fluids are already present in the container into which the solutions are being dispensed. Thus, these solutions can be transferred first to a final container as a diluent to concentrated material source ingredients that may be incompatible with each other at packaged concentrations. In the context of the compounding systems and methods disclosed herein, the mixing of incompatible fluids can occur when two fluids meet at the union junction 60. For example, in the system 1, material source solutions are drawn from either micro or macro fluid sources 4*a*, 4*b* into a plurality of micro tubing or macro tubing that are all joined together downstream of the pump rotors 41, 42 at the union junction 60 before being dispensed into the final IV bag 80. The sequence of fluid delivery can be based upon pre-programmed templates that provide a preparation order, which is a pumping sequence for fluid transfer. Incompatible fluids should not be delivered simultaneously because they may negatively react at the union junction 60 and/or downstream in the output line 2031, where the solutions may remain highly concentrated in the flow path.

Figure 39A:
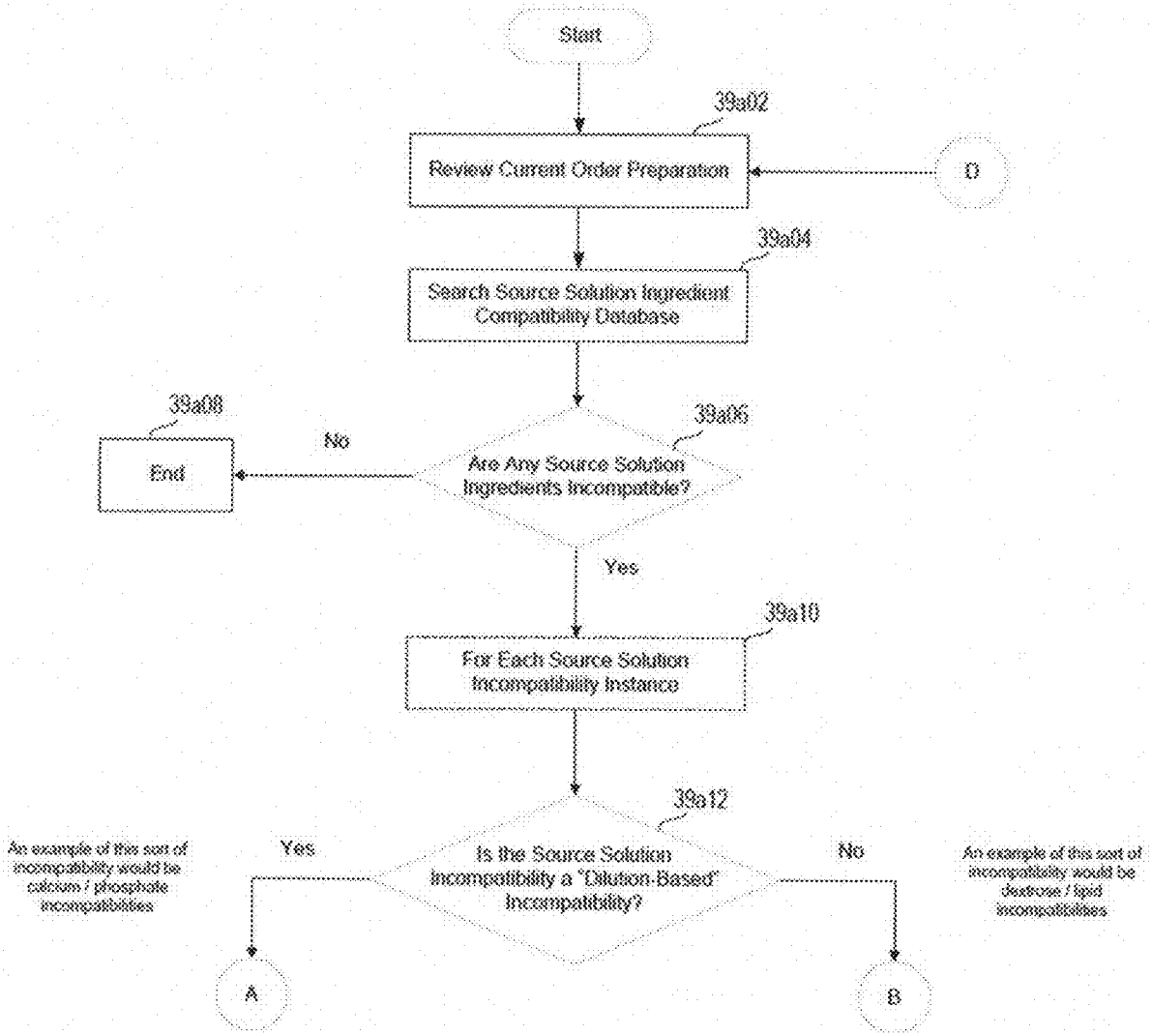
FIGS. 39*a*-39*d* together comprise a flow chart illustrating logic for controlling the compounding process to prevent simultaneous drawing of incompatible fluids in accordance with the principles of the disclosed subject matter.
Figure 39B:
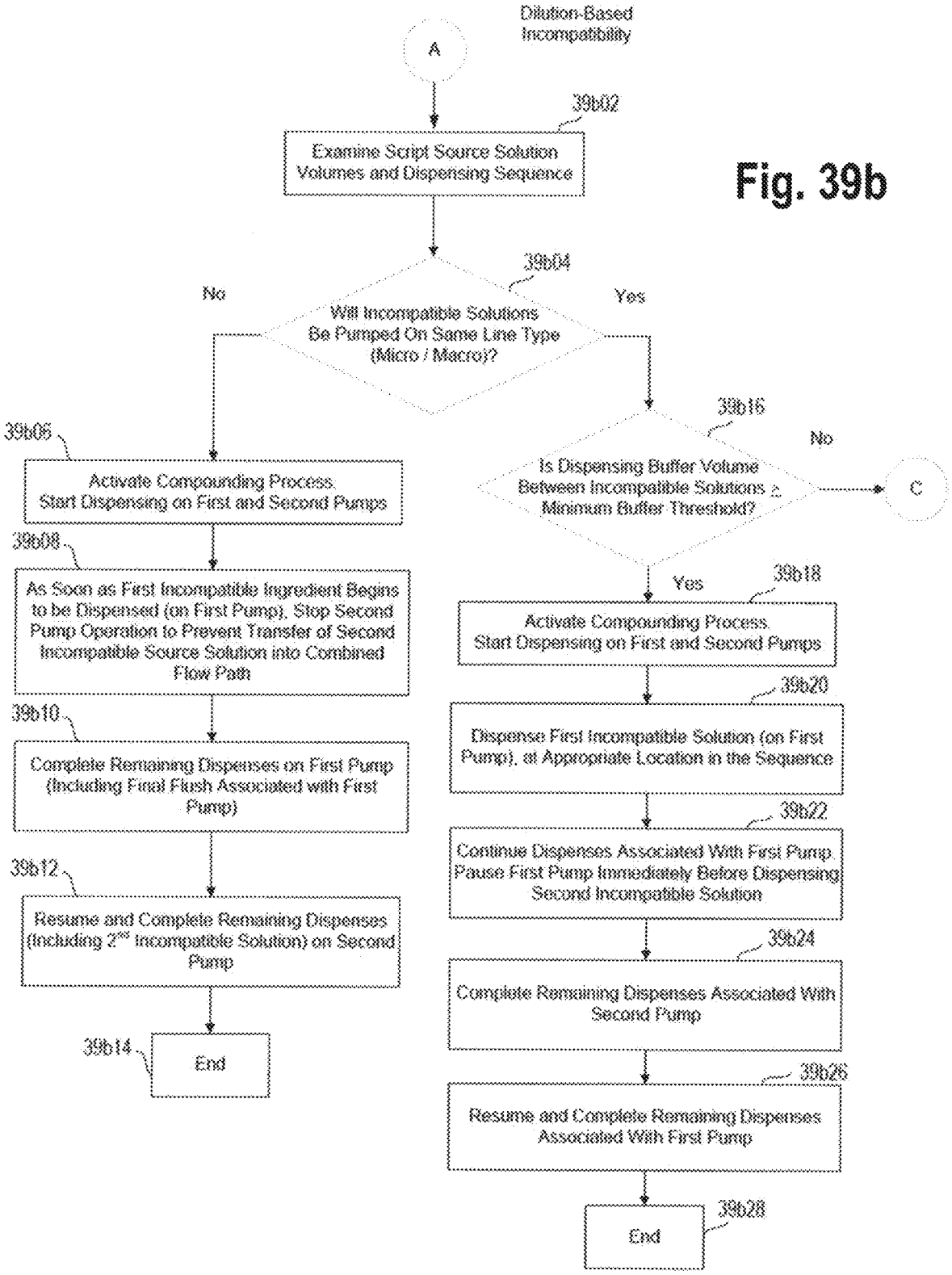

FIG. 39*a* illustrates a process for preventing simultaneous drawing of incompatible liquids into a common flow path. The process begins at step 39*a*02 where the current order preparation is reviewed. The process then moves to step 39*a*04 where the controller 2900 searches the source solution ingredient compatibility database. The process then moves to step 39a06 where the system determines whether any of the source solutions are incompatible. If the system determines that the solutions are compatible, then the process ends at step 39a08. Otherwise, the process moves to step 39a10 where the controller 2900 determines each instance of a source solution incompatibility. The process then moves to step 39a12 where the controller 2900 determines whether the source solution incompatibility is a "dilution based" incompatibility. If the source solution incompatibility is a "dilution based" incompatibility, then the process moves to step 39b02 in FIG. 39b. If the source solution incompatibility is not "dilution based," then the process moves to step 39c02 shown in FIG. 39c.

In step 39b02, the script source solution volumes and dispensing sequences are examined. The process then moves to step 39b04 where the controller 2900 determines whether incompatible solutions will be pumped on the same line type (a micro or macro line). If the controller 2900 determines that incompatible solutions will be pumped along the same line, then the process moves to step 39b16. If the controller 2900 determines that incompatible solutions will not be pumped along the same line, then the process moves to step 39b06.

In step 39b06, the controller 2900 activates the compounding process, and dispensing on the first and second pumps is commenced. The process then moves to step 39b08 where as soon as the first incompatible ingredient starts dispensing (via the first pump), the second pump stops operating to prevent the transfer of the second incompatible source solution into the combined flow path. The process then moves to step 39b10 where dispensing of all of the fluid along the first pump is completed, including a final fluid flush using the first pump. The process then moves to step 39b12 where the controller 2900 resumes and completes the remaining dispenses, including any and all remaining dispenses using the second pump. The process then moves to step 39b14 where the process ends.

Returning to step 39b16, the controller 2900 determines whether the dispensing buffer volume between incompatible solutions is greater than a minimum buffer threshold. If the dispensing buffer volume between incompatible solutions is not greater than a minimum buffer threshold, then the process moves to step 39d02 in FIG. 39d. Otherwise the process moves to step 39b18.

In step 39b18, the controller 2900 activates the compounding process so that the first and second pumps are both activated. The process then moves to step 39b20 where the first incompatible solution is dispensed using the first pump at an appropriate location in the dispensing sequence. The process then moves to step 39b22 where dispensing continues via the first pump and is then paused immediately before dispensing the second incompatible solution.

The process them moves to step 39b24 where the remaining dispenses associated with the second pump are completed. The process then moves to step 39b26 where the remaining dispenses associated with the first pump are resumed and then completed. The process then moves to step 39b28 where it ends.

Figure 39C:
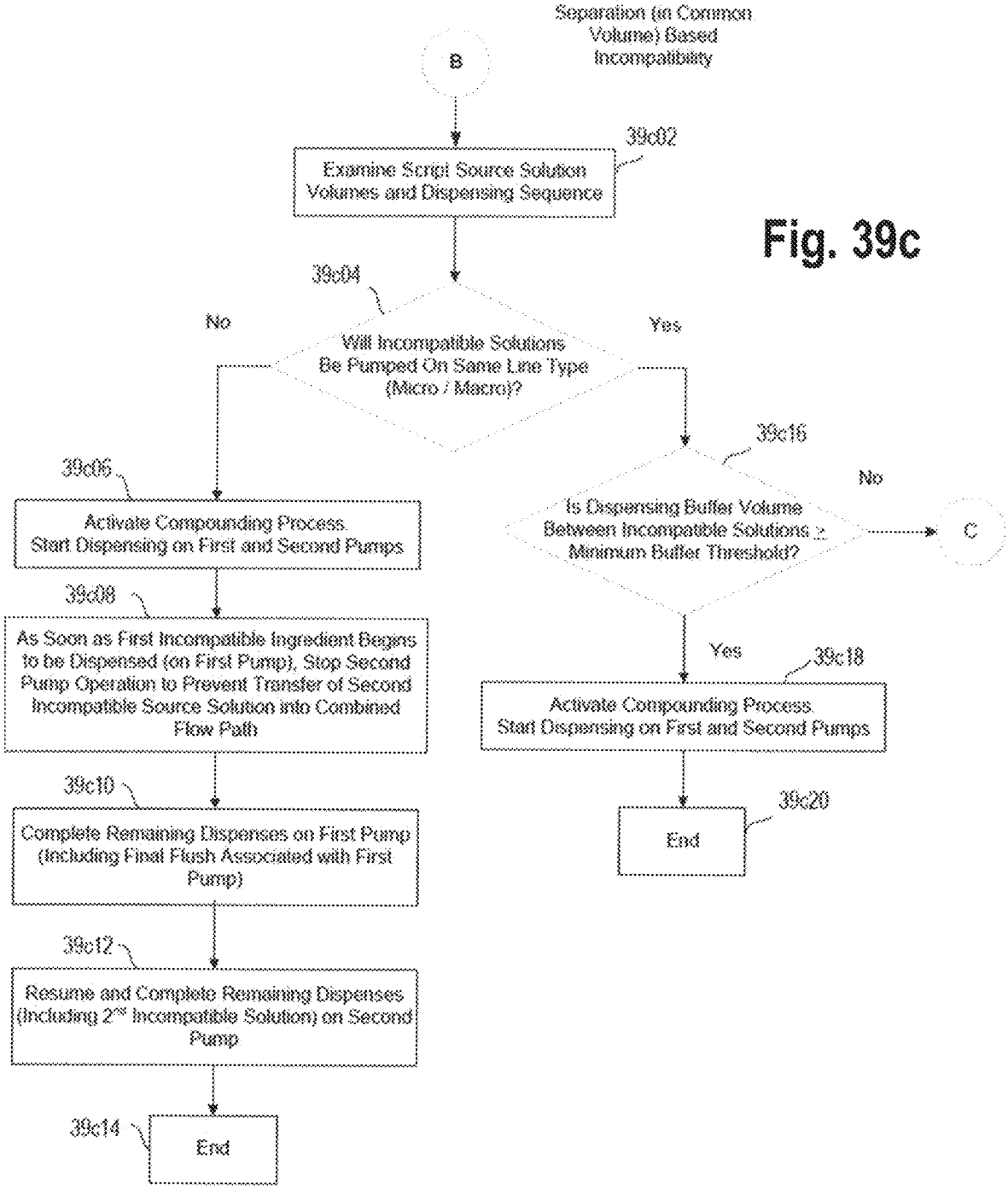

FIG. 39c illustrates the process that occurs when a determination has been made that the source solution incompatibility is not a "dilution based" incompatibility. FIG. 39c shows step 39c02 whereby the controller 2900 examines the script source solution volumes and the dispensing sequence. The process then moves to step 39c04 where the controller 2900 determines whether the incompatible solutions will be pumped on the same line. If the controller 2900 determines that the incompatible solutions will not be pumped on the same line, then the process moves to step 39c06. Otherwise, the process moves to step 39c16. In step 39c06, the controller 2900 activates the compounding process and dispensing starts using the first and second pumps. The process then moves to step 39c08 where the system stops the second pump operation as soon as the first incompatible ingredient begins to be dispensed (via the first pump). This step prevents the transfer of a second incompatible source solution into the combined flow path. The process then moves to step 39c10 where the controller 2900 completes the remaining dispenses on the first pump, including a final flush. The process then moves to step 39c12 whereby the remaining dispenses are resumed on the second pump. The process then moves to step 39c14 and ends.

In step 39c16, the controller determines whether the dispensing buffer volume between incompatible solutions is greater than the minimum buffer threshold. If the dispensing buffer volume between incompatible solutions is greater than the minimum buffer threshold, then the process moves to step 39c18 where the controller 2900 activates the compounding process and starts dispensing on the first and second pumps. The process then ends at step 39c20.

Figure 39D:
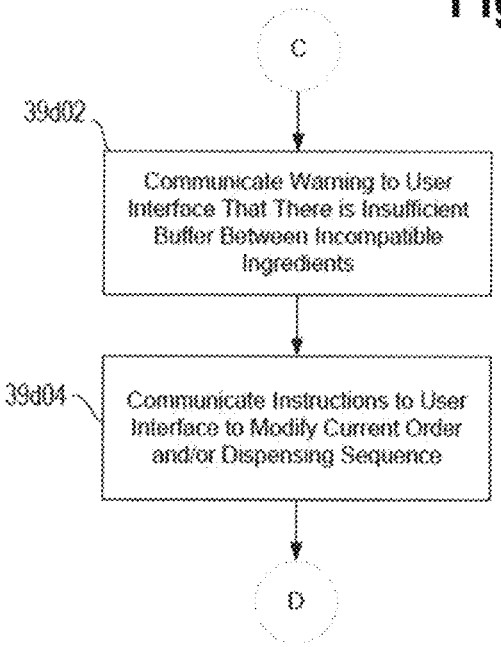

In step 39c16, if the controller 2900 determines that the dispensing buffer volume between incompatible solutions is not greater than the minimum buffer threshold, then the process moves to step 39d02 shown in FIG. 39d. In step 39d02, the controller 2900 communicates a warning to the user interface that there is an insufficient buffer between incompatible ingredients. The process then moves to step 39d04 where the controller 2900 communicates instructions to the user interface to modify the current order and/or dispensing sequence. The process then moves to step 39a02 (FIG. 39a) where the process begins again.

The process for managing the dispensing of incompatible fluids is now complete.

Figure 38:
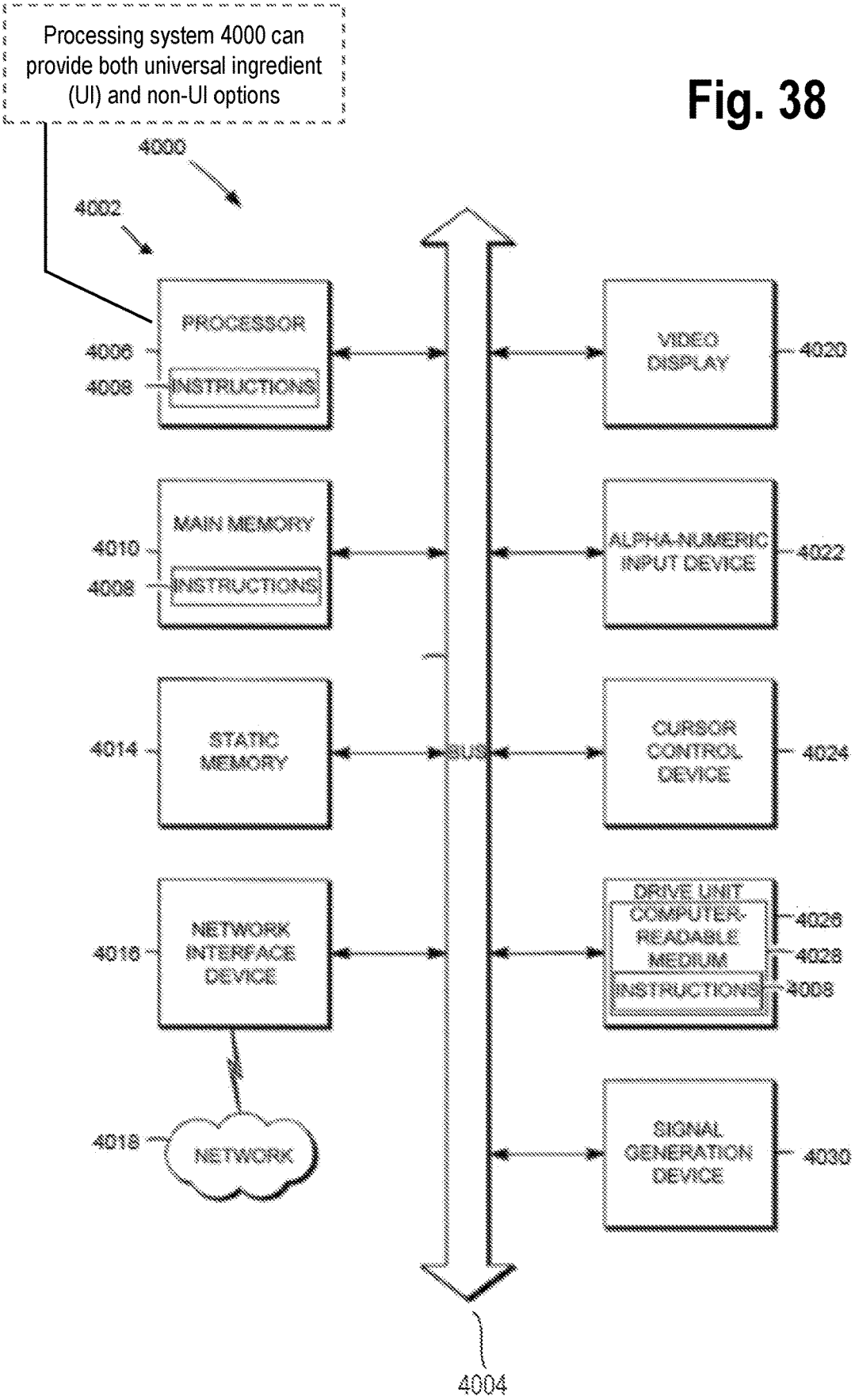
FIG. 38 is a block diagram of a processing system of the exemplary compounding device controller in the example form of a computer system within which a set of instructions for causing the controller to perform any one or more of the methodologies discussed herein may be executed.

FIG. 38 is a block diagram of an exemplary processing system 4000 of the controller 2900 in the example form of a computer system 4002 within which a set of instructions for causing the processing system 4000 to perform any one or more of the methodologies discussed for the embodiments may be executed. The controller 2900 and any other sub-controller of the compounding system 1 may include functionality of the one or more computer systems 4002. In an exemplary embodiment, the processing system 4000 operates as an integrated device, a standalone device, or may be connected (e.g., networked) to other computer systems, machines, or processing systems. In a networked deployment, the processing system 4000 may operate in the capacity of a server or a client machine in a server-client network environment, or as a peer machine in a peer-to-peer (or distributed) network environment. The processing system may be a server computer, a client computer, a personal computer (PC), a tablet PC, a set-top box (STB), a personal digital assistant (PDA), a cellular telephone, a smart phone, a Web appliance, a network router, switch, or bridge, or any machine capable of executing a set of instructions (sequential or otherwise) that specify actions to be taken by that machine. Further, while only a single processing system is illustrated, the term "processing system" or "machine" or "computer system" shall also be taken to include any collection of machines that can individually or jointly execute a set (or multiple sets) of instructions to perform any one or more of the methodologies discussed herein.

The exemplary computer system 4002 can include a processor 4006 (e.g., a central processing unit (CPU) a graphics processing unit (GPU) or both), a main memory

4010 and a static memory 4014, which can communicate with each other via a bus 4004. The computer system 4002 can further include a video display unit 4020 (e.g., a liquid crystal display (LCD) or a cathode ray tube (CRT)). The computer system 4002 also can include an alphanumeric input device 4022 (e.g., a keyboard), a cursor control device 4024 (e.g., a mouse), a drive unit 4026, a signal generation device 4030 (e.g., a speaker) and a network interface device 4016 (e.g., a network interface card (NIC)).

The drive unit 4026 can include a non-transitory computer-readable medium 4028 on which can be stored one or more sets of instructions 4008 (e.g., software) embodying any one or more of the methodologies or functions described herein. The software 4008 may also reside, completely or at least partially, within the main memory 4010 and/or within the processor 4006 during executing thereof by the computer system 4002, the main memory 4010 and the processor 4006 also constituting non-transitory computer readable media.

The software 4008 may be further transmitted or received over a network 4018 that may include a peer-to-peer network with other processing systems 4000 or over one or more of the broadband network 3004 and the LAN 3002 (shown in FIG. 37) via the network interface device 4016 with the interconnected devices described above. While the non-transitory computer readable medium 4028 is shown in an exemplary embodiment to a single medium, the term "non-transitory computer readable medium" should be understood to include a single medium or multiple media (e.g., a centralized or distributed database, and/or associated caches and servers) that store the one or more sets of instructions. The term "non-transitory computer readable medium" should also be understood to include any medium that is capable of storing or encoding a set of instructions for execution by the computer system 4002 and that cause the computer system 4002 to perform any one or more of the methodologies of the embodiments. The term "non-transitory computer readable medium" should further be understood to include, but not be limited to, solid-state memories, and optical media, and magnetic media.

Certain systems, devices, apparatus, applications, methods, processes, or controls are described herein as including a number of modules or component parts. A component part may be a unit of distinct functionality that may be presented in software, hardware, or combinations thereof. When the functionality of a component part is performed in any part through software, the component part includes a non-transitory computer-readable medium. The component parts may be regarded as being communicatively coupled. The embodiments according to the disclosed subject matter may be represented in a variety of different embodiments of which there are many possible permutations.

In one embodiment, small or large containers 4*a*, 4*b* may be in fluidic communication with a plurality of valves. The valves may have valve actuators with valve stepper motors that may be operatively connected to the controller 2900 to facilitate opening and closing of the valves. The valves may be fluidly connected to a micro or macro flow paths that are fluidly connected to a micro or macro pumps 41, 42, respectively. The motors for the micro or macro pumps 41, 42 are operatively connected to the computer system 4000 of the controller 2900, which is also operationally connected to one or more of the valve stepper motors 102*a*, 102*b*.

While the subject matter has been described in detail with reference to exemplary embodiments thereof, it will be apparent to one skilled in the art that various changes can be made, and equivalents employed, without departing from the scope of the invention. All related art references discussed in the above Description of the Related Art section are hereby incorporated by reference in their entirety.

The methods described herein do not have to be executed in the order described, or in any particular order. Moreover, various activities described with respect to the methods identified herein can be executed in serial or parallel fashion. In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, the claimed subject matter may lie in less than all features of a single disclosed embodiment.

What is claimed is:

1. A compounding apparatus for facilitating formation of an admixture that involves mixing at least two materials selected among multiple distinct materials, the compounding apparatus being usable (a) with an admixture container that is configured to contain the admixture, and (b) with multiple material containers that are each configured to respectively contain one of the materials, the compounding apparatus comprising:

a delivery device that is configured to deliver the at least two selected materials, including a first selected material and a second selected material, from the material containers to the admixture container to facilitate formation of the admixture, the delivery device including first and second actuators, the first actuator being configured such that actuation thereof delivers the first selected material from a first associated material container to the admixture container, and the second actuator being configured such that actuation thereof delivers the second selected material from a second associated material container to the admixture container;

a processor including a memory that is configured to store admixture data representing amounts of the at least two selected materials required to form the admixture, and incompatibility data to identify one material as being incompatible with another material, and the processor configured to selectively actuate the first and second actuators to supply the amounts of the at least two selected materials to the admixture container pursuant to the stored admixture data so as to facilitate formation of the admixture, and the processor configured to perform processing including:

input a first ingredient list, through interfacing with a user, that includes the at least two selected materials;

identify the first selected material as incompatible with the second selected material, such that (a) the first selected material constitutes the one material, and (b) the second selected material constitutes the another material;

prevent un-buffered sequential delivery of the at least two selected materials, which are incompatible, including controlling the delivery device to deliver a third material, of the multiple distinct materials, to the admixture container, the third material to separate the two selected materials from each other;

identify an incompatibility in the first input ingredient list based on an insufficient amount in the third material acting as a buffer;

generate, based on the identification of the incompatibility in the first input ingredient list, a graphical user interface (GUI) that presents options to the user to address the incompatibility, the options of the GUI including (a) a universal ingredient (UI) option that relates to use of a UI contained in the compounding apparatus, and (b) a non-UI option that relates to use of a non-UI contained in the compounding apparatus, and the GUI reflecting a distinction between the UI option and the non-UI option;

the UI option including the processor being configured to:

(a) interface with the user to select a universal ingredient (UI) as a substitute for the third material;

(b) substitute the UI for the third material in a further ingredient list; and (c) assess compatibility of the further ingredient list; AND the non-UI option including the processor being configured to:

(a) interface with the user to select a non-UI as a substitute for the third material;

(b) substitute the non-UI for the third material in another ingredient list; and (c) assess compatibility of the another ingredient list.

2. The compounding apparatus of claim 1, wherein the interface with the user to select the non-UI as a substitute for the third material includes:

determining a list of candidate non-UIs based on (a) ingredients present in the order, and (b) of those ingredients, which ingredients are identified in the memory as being viable as non-UIs, and presenting the list to the user for selection of one of the candidate non-UIs to constitute the non-UI.

3. The compounding apparatus of claim 2, wherein the list is in the form of a menu, presented with a graphical user interface, and includes a plurality of fields that contain the candidate non-UIs.

4. The compounding apparatus of claim 3, wherein the non-UI option includes the processor configured to:

display the another ingredient list to the user after the identify an incompatibility in the first ingredient list;

input a selection from the user of a selected buffered ingredient of the ingredients; and associate the non-UI to be run as the selected buffered ingredient.

5. The compounding apparatus of claim 4, wherein the non-UI option includes the processor configured to display, in the another ingredient list, indicia reflecting the non-UI.

6. The compounding apparatus of claim 1, wherein the non-UI option includes the processor configured to:

display the another ingredient list to the user after the identify an incompatibility in the first ingredient list;

input a selection from the user of a selected buffered ingredient of the ingredients; and associate the non-UI to be run as the selected buffered ingredient.

7. The compounding apparatus of claim 6, wherein the non-UI option includes the processor configured to display, in the another ingredient list, indicia reflecting the non-UI.

8. The compounding apparatus of claim 1, wherein the interface with the user to select a non-UI as a substitute for the third material includes:

presenting the user a button on a further GUI that invokes such selection of the non-UI.

9. The compounding apparatus of claim 1, wherein the insufficient amount in the third material acting as a buffer is a result of either an absence of the third material or an inadequate amount of the third material.

10. The compounding apparatus of claim 1, wherein the first actuator is selected from the group consisting of a pump and valve; and the second actuator is selected from the group consisting of a second pump and a second valve.

11. The compounding apparatus of claim 1, wherein the interface with the user to select a non-UI as a substitute for the third material is performed by the processor interfacing with the user through a GUT.

12. The compounding apparatus of claim 1, wherein the processor is configured to deliver the admixture using the non-UI as a substitute for the third material.

13. The compounding apparatus of claim 12, wherein the non-UI is constituted by a selected material, and the processor is configured to reduce another occurrence of the selected material in the admixture.

14. The compounding apparatus of claim 13, the another occurrence of the selected material in the admixture is reduced so as to correspond with an amount of the selected material used as the non-UI.

15. A compounding apparatus for facilitating formation of an admixture that involves mixing at least two materials selected among multiple distinct materials, the compounding apparatus being usable (a) with an admixture container that is configured to contain the admixture, and (b) with multiple material containers that are each configured to respectively contain one of the materials, the compounding apparatus comprising:

a delivery device that is configured to deliver the at least two selected materials, including a first selected material and a second selected material, from the material containers to the admixture container to facilitate formation of the admixture, the delivery device including first and second actuators, the first actuator being configured such that actuation thereof delivers the first selected material from a first associated material container to the admixture container, and the second actuator being configured such that actuation thereof delivers the second selected material from a second associated material container to the admixture container;

a processor including a memory that is configured to store admixture data representing amounts of the at least two selected materials required to form the admixture, and the processor configured to selectively actuate the first and second actuators to supply the amounts of the at least two selected materials to the admixture container pursuant to the stored admixture data so as to facilitate formation of the admixture; and the processor configured to perform adjustment processing including:

engaging with a user for the user to select an auto adjust feature;

generating an adjustment ratio for adjusting delivery of the first selected material; and applying the adjustment ratio to the delivery of the first selected material and adjusting the adjustment ratio based on a weight check of the admixture container.

16. The compounding apparatus of claim 15, wherein the generating the adjustment ratio includes:

comparing a prior target value, for a prior dispense, with a prior observed value, for the prior dispense;

generating a comparison value based on the comparing; and adjusting the adjustment ratio based on the comparison value.

17. The compounding apparatus of claim 16, wherein the adjusting the adjustment ratio is constrained to be limited to a predetermined incremental adjustment for each respective delivery performed by the compounding apparatus.

18. The compounding apparatus of claim 17, wherein the adjusting the adjustment ratio is constrained to be limited to a predetermined absolute value of the adjustment ratio.

19. The compounding apparatus of claim 16, wherein the adjusting the adjustment ratio is constrained to be limited to a predetermined absolute value of the adjustment ratio.

20. The compounding apparatus of claim 15, wherein the adjustment processing further includes:

performing a determination of whether the adjustment ratio should be varied based on a further prior dispense; and assessing that the adjustment ratio should not be varied based on the further prior dispense, and the assessing being based on an anomaly associated with the further prior dispense.

21. A compounding apparatus for facilitating formation of an admixture that involves mixing at least two materials selected among multiple distinct materials, the compounding apparatus being usable (a) with an admixture container that is configured to contain the admixture, and (b) with multiple material containers that are each configured to respectively contain one of the materials, the compounding apparatus comprising:

a delivery device that is configured to deliver the at least two selected materials, including a first selected material and a second selected material, from the material containers to the admixture container to facilitate formation of the admixture, the delivery device including first and second actuators, the first actuator, associated with a first station, being configured such that actuation thereof delivers the first selected material from a first associated material container to the admixture container, and the second actuator, associated with a second station, being configured such that actuation thereof delivers the second selected material from a second associated material container to the admixture container;

a processor including a memory that is configured to store admixture data representing amounts of the at least two selected materials required to form the admixture, and the processor configured to selectively actuate the first and second actuators to supply the amounts of the at least two selected materials to the admixture container pursuant to the stored admixture data so as to facilitate formation of the admixture; and the processor configured to perform disable station processing including:

identifying, based on user input or processing by the processor, that the first station is not operating properly so as to deliver the first selected material;

engaging with a user to require the user to submit credentials in order for the user to select a disable station feature for disabling the first station;

inputting, in response to the engaging, credential data from the user;

determining that the credential data satisfies the requiring the user to submit credentials;

based on the credential data, input from the user, activating a disable option to disable the first station;

presenting the disable option, which has been activated, to the user;

inputting a selection of the disable option from the user; and based on the selection of the disable option, by the user, disabling the first station.

22. The compounding apparatus of claim 21, wherein the disabling the first station is performed, by the processor, in conjunction with the processor associating a further station to the first station which is disabled;

the associating the further station including routing delivery requests, which are directed to the first station, to the further station; and the further station configured to complete such delivery requests.

23. The compounding apparatus of claim 21, wherein the disable station processing further includes interfacing with the user so as to communicate that the first station is not operating properly, and such interfacing being performed through a GUI presented to the user by the processor.

24. The compounding apparatus of claim 23, wherein the GUI includes an order sequence that includes the first selected material and the second selected material.

25. The compounding apparatus of claim 21, wherein the first station includes the first associated material container.

26. The compounding apparatus of claim 21, wherein the first station includes the first associated material container and structure to connect the first associated material container to the first actuator, and such structure including a line, an inlet tubing port and a spike.

* * * * *